US007681333B2

(12) United States Patent
Dardinski et al.

(10) Patent No.: US 7,681,333 B2
(45) **Date of Patent: *Mar. 23, 2010**

(54) SHOE FOOTBED SYSTEM WITH INTERCHANGEABLE CARTRIDGES

(75) Inventors: Alexander Dardinski, Newburyport, MA (US); John Healy, Madbury, NH (US); Peter Dillon, Topsfield, MA (US); David E. Miller, Dayton, ME (US); Simon Luthi, Lake Oswego, OR (US); Charles Kraeuter, Lake Oswego, OR (US); Douglas E. Clark, Durham, NH (US)

(73) Assignee: The Timberland Company, Stratham, NH (US)

( * ) Notice: Subject to any disclaimer, the term of this patent is extended or adjusted under 35 U.S.C. 154(b) by 1183 days.

This patent is subject to a terminal disclaimer.

(21) Appl. No.: 11/259,563

(22) Filed: Oct. 26, 2005

(65) Prior Publication Data

US 2006/0107552 A1 May 25, 2006

Related U.S. Application Data

(60) Provisional application No. 60/667,970, filed on Apr. 4, 2005, provisional application No. 60/623,475, filed on Oct. 29, 2004.

(51) Int. Cl.
*A43B 3/24* (2006.01)

(52) U.S. Cl. ..... 36/100; 36/30 R; 36/97

(58) Field of Classification Search ..... 36/100, 36/43, 44, 97, 30 R, 155–163
See application file for complete search history.

(56) References Cited

U.S. PATENT DOCUMENTS

| | | | |
|---|---|---|---|
| 981,154 | A | 1/1911 | Austin |
| 1,061,353 | A | 5/1913 | Everston |
| 1,075,806 | A | 10/1913 | Austin |
| 1,079,535 | A | 11/1913 | Austin |
| 1,115,038 | A | 10/1914 | Tweedie |
| 1,191,122 | A | 4/1916 | Brown |
| 1,289,711 | A | 12/1918 | Sweasy |

(Continued)

FOREIGN PATENT DOCUMENTS

| | | |
|---|---|---|
| DE | 3106729 | 9/1982 |

(Continued)

*Primary Examiner*—Marie Patterson
(74) *Attorney, Agent, or Firm*—Lerner, David, Littenberg, Krumholz & Mentlik, LLP

(57) ABSTRACT

The present invention provides an interchangeable shoe footbed cartridge system. The system includes a footbed such as a midsole, insole or a sockliner. A cartridge is inserted into or otherwise attached to the forefoot section of the footbed. Multiple cartridges of varying depths, widths and/or lengths may be provided. The wearer can select a cartridge to achieve a desired fit. Because right and left feet may be of different sizes, different cartridges may be chosen for each foot. Furthermore, the user may swap cartridges depending upon different conditions, or to change the stiffness of the cartridge. Additionally, a slipcover having a stretchable portion may be placed over the cartridge system. The cartridges enable a footwear manufacturer to produce fewer shoe sizes while fitting more of the population. This reduces manufacturing, shipping, warehousing and accounting costs. All levels of the supply chain, as well as the end customers, will greatly benefit from the method of supplying footwear.

31 Claims, 36 Drawing Sheets

U.S. PATENT DOCUMENTS

| | | | | |
|---|---|---|---|---|
| 1,375,340 | A * | 4/1921 | Wilms | 36/159 |
| 1,401,981 | A | 1/1922 | Hill | |
| 1,408,267 | A | 2/1922 | Caterini | |
| 1,477,825 | A | 9/1923 | Heitler | |
| 1,523,956 | A | 1/1925 | Grosjean | |
| 1,524,997 | A | 2/1925 | Potter | |
| 1,546,245 | A | 7/1925 | Luck | |
| 1,733,678 | A | 10/1929 | Torchia | |
| 1,739,538 | A | 12/1929 | Block | |
| 1,853,998 | A | 4/1932 | Sadler | |
| 1,872,604 | A | 8/1932 | Pierce | |
| 1,895,327 | A | 1/1933 | Horning | |
| 1,907,997 | A | 5/1933 | Nickerson | |
| 1,964,806 | A | 7/1934 | Barnett | |
| 1,986,124 | A | 1/1935 | Smith | |
| 1,999,507 | A | 4/1935 | Lyss | |
| 2,035,561 | A | 3/1936 | McCullough | |
| 2,053,910 | A | 9/1936 | Kingsburry | |
| 2,090,065 | A | 8/1937 | Parker | |
| 2,127,255 | A | 8/1938 | Flint | |
| 2,194,637 | A | 3/1940 | Burger | |
| 2,212,414 | A | 5/1940 | Burger | |
| 2,220,439 | A | 11/1940 | Block | |
| 2,260,270 | A | 10/1941 | Boos | |
| 2,312,370 | A | 3/1943 | Soule | |
| 2,482,333 | A * | 9/1949 | Everston | 36/43 |
| 2,581,524 | A | 1/1952 | Ford | |
| 2,605,559 | A | 8/1952 | Vail | |
| 2,835,908 | A | 5/1958 | Mott | |
| 3,091,042 | A | 5/1963 | Gilkerson | |
| 3,124,887 | A | 3/1964 | Vassar | |
| 3,442,031 | A * | 5/1969 | Antell | 36/97 |
| 4,231,169 | A | 11/1980 | Toyama et al. | |
| 4,481,726 | A | 11/1984 | Phillips | |
| 4,523,395 | A | 6/1985 | Borsoi et al. | |
| 4,557,060 | A | 12/1985 | Kawashima et al. | |
| 4,608,988 | A | 9/1986 | Dananberg | |
| 4,624,061 | A | 11/1986 | Wezel et al. | |
| 4,674,206 | A | 6/1987 | Lyden | |
| 4,739,765 | A | 4/1988 | Sydor et al. | |
| 4,765,070 | A | 8/1988 | Chemello et al. | |
| 4,783,910 | A | 11/1988 | Boys, II et al. | |
| 4,791,736 | A | 12/1988 | Phillips | |
| 4,794,707 | A | 1/1989 | Franklin et al. | |
| 4,858,341 | A | 8/1989 | Rosen | |
| 4,864,740 | A | 9/1989 | Oakley | |
| 4,897,938 | A | 2/1990 | Otsuka et al. | |
| 4,918,838 | A | 4/1990 | Chang et al. | |
| 4,924,605 | A | 5/1990 | Spademan | |
| 4,924,606 | A | 5/1990 | Montgomery et al. | |
| 4,967,492 | A | 11/1990 | Rosen | |
| RE33,648 | E | 7/1991 | Brown | |
| 5,060,402 | A | 10/1991 | Rosen | |
| 5,123,181 | A | 6/1992 | Rosen | |
| 5,138,774 | A | 8/1992 | Sarkozi | |
| 5,163,237 | A * | 11/1992 | Rosen | 36/97 |
| 5,179,791 | A | 1/1993 | Lain | |
| 5,187,883 | A | 2/1993 | Penney | |
| 5,212,878 | A | 5/1993 | Burke et al. | |
| 5,226,247 | A | 7/1993 | Ambrose | |
| 5,241,762 | A | 9/1993 | Rosen | |
| 5,255,451 | A | 10/1993 | Tong et al. | |
| 5,325,614 | A | 7/1994 | Rosen | |
| 5,345,701 | A | 9/1994 | Smith | |
| 5,367,791 | A | 11/1994 | Gross et al. | |
| 5,404,658 | A | 4/1995 | Rosen | |
| 5,438,768 | A | 8/1995 | Bauerfeind et al. | |
| 5,497,566 | A | 3/1996 | Kousaka et al. | |
| 5,528,842 | A | 6/1996 | Ricci et al. | |
| 5,533,280 | A | 7/1996 | Halliday | |
| 5,572,805 | A | 11/1996 | Giese et al. | |
| 5,647,147 | A | 7/1997 | Coomer | |
| 5,655,315 | A | 8/1997 | Mershon | |
| 5,659,980 | A | 8/1997 | Lin et al. | |
| 5,724,753 | A | 3/1998 | Throneburg et al. | |
| 5,727,335 | A | 3/1998 | Kousaka et al. | |
| 5,732,481 | A | 3/1998 | Farhad | |
| 5,733,647 | A | 3/1998 | Moore, III et al. | |
| 5,768,803 | A | 6/1998 | Levy | |
| 5,799,414 | A | 9/1998 | Kellerman | |
| 5,813,145 | A | 9/1998 | Prober et al. | |
| 5,813,146 | A | 9/1998 | Gutkowski et al. | |
| 5,855,079 | A | 1/1999 | Herbert et al. | |
| 5,881,478 | A | 3/1999 | McMahon et al. | |
| 5,892,171 | A | 4/1999 | Ide et al. | |
| 5,958,546 | A | 9/1999 | Mardix et al. | |
| 6,000,147 | A | 12/1999 | Kellerman | |
| 6,023,857 | A | 2/2000 | Vizy et al. | |
| 6,092,310 | A | 7/2000 | Schoesler et al. | |
| 6,092,311 | A * | 7/2000 | MacNamara | 36/97 |
| 6,092,314 | A | 7/2000 | Rothbart | |
| 6,101,743 | A | 8/2000 | Brown | |
| 6,125,557 | A | 10/2000 | Brown | |
| 6,138,382 | A | 10/2000 | Schoesler et al. | |
| 6,170,176 | B1 | 1/2001 | Clough | |
| 6,178,663 | B1 | 1/2001 | Schoesler et al. | |
| 6,205,683 | B1 | 3/2001 | Clark et al. | |
| 6,205,685 | B1 | 3/2001 | Kellerman | |
| 6,259,555 | B1 | 7/2001 | Meli et al. | |
| 6,269,555 | B1 | 8/2001 | Brown | |
| 6,349,487 | B1 | 2/2002 | Hice | |
| 6,374,515 | B1 | 4/2002 | Davis | |
| 6,408,543 | B1 | 6/2002 | Erickson et al. | |
| 6,442,874 | B1 | 9/2002 | Long | |
| 6,453,578 | B1 | 9/2002 | Yung et al. | |
| 6,470,599 | B1 | 10/2002 | Chu | |
| 6,474,003 | B2 | 11/2002 | Erickson et al. | |
| 6,481,120 | B1 | 11/2002 | Xia et al. | |
| 6,484,419 | B1 * | 11/2002 | Rohde et al. | 36/10 |
| 6,513,265 | B2 | 2/2003 | Hanks | |
| 6,536,137 | B1 | 3/2003 | Celia | |
| 6,584,476 | B1 | 6/2003 | Chatterjee et al. | |
| 6,584,707 | B1 | 7/2003 | Racine et al. | |
| 6,601,320 | B1 | 8/2003 | Brown | |
| 6,601,321 | B1 | 8/2003 | Kendall | |
| 6,606,804 | B2 | 8/2003 | Kaneko et al. | |
| 6,609,314 | B1 | 8/2003 | Dubner | |
| 6,625,906 | B2 | 9/2003 | Mayer et al. | |
| 6,701,638 | B1 | 3/2004 | Polato et al. | |
| 6,708,427 | B2 | 3/2004 | Sussmann et al. | |
| 6,718,658 | B2 | 4/2004 | Karasawa et al. | |
| 6,732,457 | B2 * | 5/2004 | Gardiner | 36/155 |
| 6,748,676 | B1 | 6/2004 | Chenevert et al. | |
| 6,792,699 | B2 | 9/2004 | Long et al. | |
| 6,802,138 | B2 | 10/2004 | McManus et al. | |
| 6,848,200 | B1 | 2/2005 | Westin | |
| 6,871,421 | B2 | 3/2005 | Potter et al. | |
| 6,920,707 | B1 * | 7/2005 | Greene et al. | 36/97 |
| 7,155,845 | B2 * | 1/2007 | Durand | 36/97 |
| 7,210,250 | B2 | 5/2007 | Gallegos | |
| 7,461,470 | B2 * | 12/2008 | Dardinski et al. | 36/100 |
| 2002/0014042 | A1 | 2/2002 | Price | |
| 2002/0017035 | A1 | 2/2002 | Treptow et al. | |
| 2002/0020078 | A1 | 2/2002 | Bressoux et al. | |
| 2002/0020081 | A1 | 2/2002 | Brooks | |
| 2002/0189135 | A1 | 12/2002 | Hanks | |
| 2003/0005599 | A1 * | 1/2003 | Panaccione | 36/43 |
| 2003/0097770 | A1 | 5/2003 | Karasawa | |
| 2003/0106244 | A1 * | 6/2003 | Miller et al. | 36/97 |
| 2003/0200675 | A1 | 10/2003 | Gross | |
| 2003/0200676 | A1 | 10/2003 | Gross | |
| 2003/0226288 | A1 | 12/2003 | Brown | |
| 2004/0049950 | A1 | 3/2004 | Van Horne | |
| 2004/0049951 | A1 | 3/2004 | Chen | |

| | | | | |
|---|---|---|---|---|
| 2004/0064974 | A1 | 4/2004 | Schuster | |
| 2004/0068893 | A1 | 4/2004 | Kendall | |
| 2004/0103561 | A1 * | 6/2004 | Campbell et al. | 36/88 |
| 2004/0111923 | A1 | 6/2004 | Brooks | |
| 2004/0118017 | A1 | 6/2004 | Dalton et al. | |
| 2004/0128861 | A1 * | 7/2004 | Durand | 36/97 |
| 2004/0143998 | A1 | 7/2004 | Yang | |
| 2004/0194344 | A1 | 10/2004 | Tadin | |
| 2004/0194348 | A1 | 10/2004 | Campbell et al. | |
| 2004/0194352 | A1 | 10/2004 | Campbell et al. | |
| 2004/0211090 | A1 * | 10/2004 | Miller et al. | 36/97 |
| 2004/0221489 | A1 | 11/2004 | Hung | |
| 2004/0226114 | A1 | 11/2004 | Karasawa | |
| 2004/0226192 | A1 | 11/2004 | Geer et al. | |
| 2004/0255486 | A1 | 12/2004 | Pawlus et al. | |
| 2005/0034335 | A1 | 2/2005 | Shows | |
| 2005/0034338 | A1 | 2/2005 | Footman | |
| 2005/0050772 | A1 | 3/2005 | Miller et al. | |
| 2005/0076539 | A1 | 4/2005 | Klein | |
| 2005/0086838 | A1 | 4/2005 | Khantzis | |
| 2005/0102771 | A1 | 5/2005 | Nguyen | |
| 2006/0048414 | A1 * | 3/2006 | Takada | 36/93 |
| 2006/0080869 | A1 | 4/2006 | Johnson | |
| 2007/0062069 | A1 | 3/2007 | Durand | |

FOREIGN PATENT DOCUMENTS

| | | |
|---|---|---|
| EP | 0 287 662 | 10/1988 |
| EP | 0 528 130 | 2/1993 |
| EP | 0 571 730 | 12/1993 |
| JP | 3085101 | 4/1991 |

* cited by examiner

BOTTOM VIEW
204a
224a
220
LARGE
L
LARGE

TOP VIEW
204a
218
230
232
234a
212

BOTTOM VIEW
204b
224b
220
MEDIUM
M
MEDIUM

TOP VIEW
204b
218
230
232
234b
212

BOTTOM VIEW
204c
224c
220
SMALL
S
MEDIUM

TOP VIEW
204c
218
230
232
234c
212

540
550a
548a
552
546
542
544a 550b
548b
546
544b 550c
548c
544c 560
574a
564a
508
562

574b
566
564b 572
570

580
584a
592
586
588a
582
590a 584b
588b
590b 584c
588c
590c

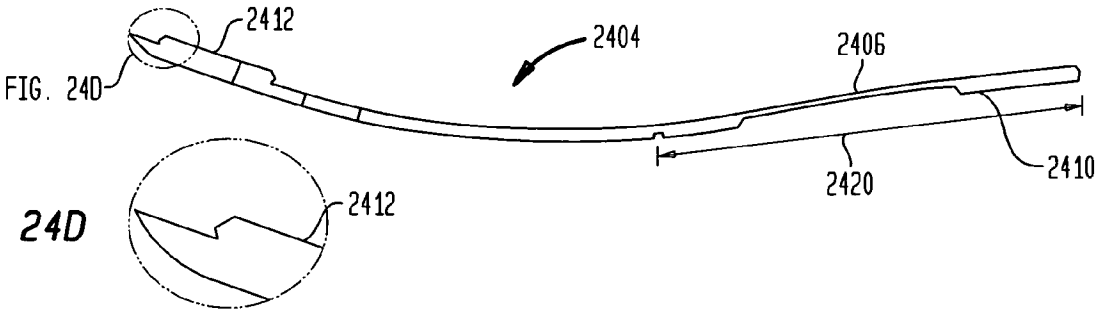
FIG. 24C
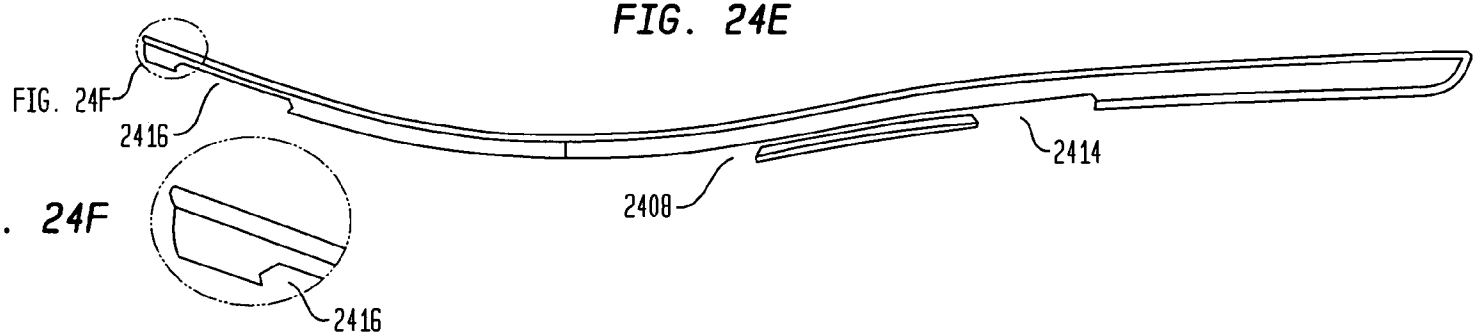
FIG. 24E
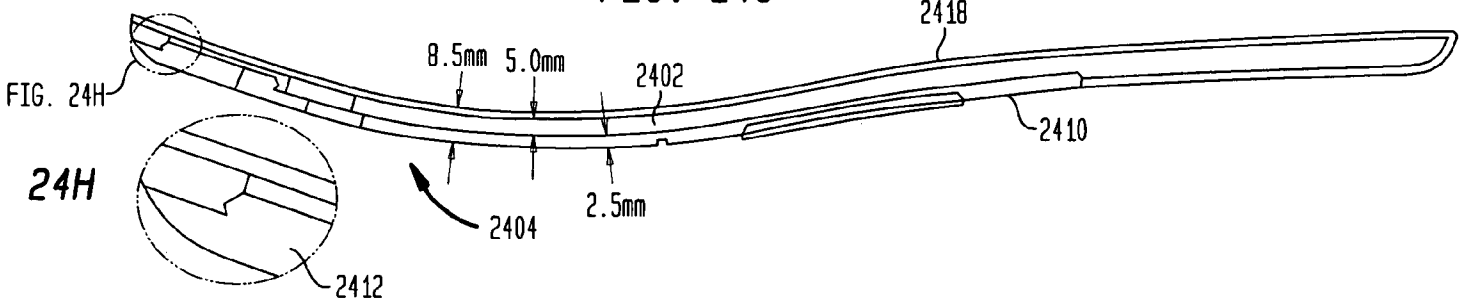
FIG. 24G
FIG. 24D
FIG. 24F
FIG. 24H 2500
Narrow
Red=Small
Gray=Medium
Yellow=Large
2504
2508
2510
2512
2516
2514
2506
2502

2504
2508
2506
2502

ET
6.5mm
2508
6.5mm
3.5mm
2512
2506
17.090mm
2502

2516
2512
2506
2514
2512

SHOE FOOTBED SYSTEM WITH INTERCHANGEABLE CARTRIDGES

CROSS-REFERENCE TO RELATED APPLICATIONS

This application claims the benefit of the filing dates of U.S. Provisional Patent Application No. 60/623,475 filed Oct. 29, 2004 and entitled "Shoe Footbed With Interchangeable Cartridges," and U.S. Provisional Patent Application No. 60/667,970 filed Apr. 4, 2005 and entitled "Shoe Footbed With Interchangeable Cartridges," the entire disclosures of which are hereby incorporated by reference herein. This application is also related to U.S. patent application Ser. No. 11/259,587, filed concurrently herewith and entitled "SHOE FOOTBED SYSTEM AND METHOD WITH INTERCHANGEABLE CARTRIDGES," the entire disclosure of which is hereby expressly incorporated by reference herein.

BACKGROUND OF THE INVENTION

Fit and comfort are arguably the two most important components of an article of footwear. This is especially true of any shoe type of footwear that includes some form of side or top restraint such as in a contoured sneaker or loafer. Improper fit can quickly lead to discomfort due to a tightly fitting shoe that pinches on the user's foot or a loosely fitting shoe that moves independently of the foot causing rubbing, irritation, and blisters. When shoes are made to a custom fit, these problems are rarely an issue. However, custom fitting presents a problem in today's economy where the cost of custom-made shoes is prohibitive. Moreover, one manufacturing trend is to produce generic, reusable components in order to reduce manufacturing costs, thus lowering the cost to the consumer.

These manufacturing constraints create significant limitations in the footwear industry. Each shoe size requires its own set of molds and therefore a capital investment on the part of the footwear company. Additionally, since different molds are created per shoe size, footwear companies need to spend time and effort to develop molds for each shoe size. Moreover, manufacturers tend to make sizes geared towards the mean or average dimensions of the population. This presents fit and comfort issues to users whose foot dimensions fall outside of the mean values. Furthermore, it is well known that there is a large range in foot dimensions within one shoe size.

To overcome these and other limitations, some companies produce shoes in different widths—smaller widths such as A and B, and wide widths, for instance E, EE or EEE. Although this helps some users with fit issues, it fails to satisfy many in the footwear wearing population and it presents significant complexity to the footwear company as they must offer, manufacture, stock, distribute, and account for more stock keeping units ("SKUs"). Also, it is well known that footwear companies accommodate for width adjustment by creating upper patterns with a larger girth and make no adjustments to other portions of the shoe, such as the outsole or the midsole. Therefore, it should be questioned how effective this manufacturing strategy is with supplying the most comfortable footwear. What is needed are improved shoes, as well as a method of manufacturing improved shoes that allows for the best fit and comfort for the user without creating additional complexity for the footwear manufacturer.

Anthropometric data of the foot determines the general shape and size of contemporary footwear. As discussed above, this data is used to develop shoes for the most likely consumer population and does not account for fit concerns of wearers outside of the statistical norm. In addition to the concerns of manufacturing to the mean of a population, there are a number of other issues that create fit and comfort issues.

By way of example only, there is a weak correlation between foot size versus height and weight. It is as likely to have a male with a weight of 145 pounds with a size 9 foot as it is to have a 225 pound male with a size 9 foot. This makes it difficult to adjust shoe and material specifications that would benefit comfort concerns for both males based solely on shoe size. For this reason, adjusting the density of the footbed to accommodate greater than normal loads should not be based solely on shoe size, but should also take into account the wearer's body mass and other factors.

Another issue is the fact that the shape and volume of the feet change under different conditions. Such conditions include the degree of weight bearing, the type of activity, and the climate. Feet tend to swell in hot and humid environments. The shape and volume of the foot also tends to change with age.

Yet another issue is the high incidence of mismatched feet (left/right) with regard to length, width, and girth of the feet. Left/right foot length differences of 15 mm (approximately 1.5 typical shoe sizes) are not uncommon. Approximately 30% of the population has foot lengths that have a difference of at least ½ shoe size, which is on the order of 5 mm.

In each of the above issues, adjusting shoe size due to the variability of the conditions cannot solve the problems. Therefore, it is desirable to solve the aforementioned problems in shoes that can be used by people with a wide spectrum of foot shapes and sizes, and allows the wearer to adjust shoe size to meet anatomical, physiological and environmental factors. It is also desirable to reduce the number of "Stock Keeping Units" ("SKUs") offered in a product line, as this can generate substantial benefits throughout the supply chain.

SUMMARY OF THE INVENTION

It has been discovered that there is a strong correlation between overall foot length and all other foot length measurements (e.g. heel to $1^{st}$ metatarsal length, heel to $5^{th}$ metatarsal length). However, the correlations between foot length and forefoot width and forefoot girth are not as strong. This indicates greater variability in forefoot width and girth given the same foot length. Therefore, the predictability of length measurements makes it possible to address fit through standard size grading, such as whole size grading (e.g., U.S. men's sizes 8, 9, 10, 11, etc). However, the poor predictability of length to forefoot width and girth due to the large variability in these measures make proper size grading a challenge that has not been solved to date.

Given that the large variation in foot dimensions within the same shoe/foot size occurs in the forefoot region of the foot with either a large variation in the volume of the foot or in forefoot width, proper sizing is needed to address these variations. The current invention presents a system and method that allows for adjustment of volume and/or width in the forefoot region of the foot.

In addition to the current invention addressing fit concerns, it can also supply adjustability to comfort and cushioning by allowing the forefoot portion of the footbed to be replaced with a similar component made from a material that better suits the wearer's specific requirements, for example a more or less rigid material.

As previously mentioned, shoe size alone is a poor predictor of body mass. Two people with a similar shoe size can vary greatly in body mass and, therefore, place greatly different loads on footwear during locomotion. It is well known that during locomotion the human body generates peak ground reaction forces of 1.5-2.0 times their body weight while walking and 2.0-3.5 times their body weight while running. Peak forces of up to 10 times a person's body weight have been recorded while landing from a jump. Given a comparison between a 150 and 225 pound person, the smaller person might generate peak forces of 450 pounds while running, while the 225 pound person would generate 675 pounds of force during the same activity. Both of these individuals might wear identical footwear during these activities.

An ideal footbed system would allow for adjustment of the materials under the wearer's foot to account for body mass differences, changes in locomotion style, differences in footwear use, and personal preference. For instance, heavier users might place a denser material under the forefoot for greater attenuation of the landing forces. Materials that are more suitable for the distribution of pressure, such as gel-based materials, might also be used to reduce peak pressure points under the forefoot.

The replacement of existing parts provides a method of refreshing a previously worn footbed. Footbeds commonly use elastomeric foams such as ethyl vinyl acetate ("EVA") and polyurethane ("PU"). The foaming process that produces the foam creates open or closed cell air bubbles that are distributed in the elastomeric foam. These air cells create a lighter weight part and allow for cushioning properties through the compressing of the air cells. It is well known that these air cells rupture during extended use, creating a compression set in the material and causing the material to lose its cushioning properties. Replacing a worn component with a new one provides rejuvenated cushioning and extends the life of the shoe. Advantageously, the wearer does not have to replace the entire footbed and, therefore, can do so at a greatly reduced cost. Furthermore, such pieces could be interchanged for different activities and/or as the wearer's foot changes shape.

Cartridges in accordance with the present invention may also be designed with a medial-lateral depth change or bias in order to supply a corrective geometry to the wearer. It is well known that certain orthopedic ailments to the lower leg, knee, hip, and back, are caused by poor alignment of the foot and ankle. Also, certain dynamic ailments such as flat or flexible feet may allow for excess motion in the normal gait. For instance, a person who over-pronates during the walking gait cycle would benefit from a forefoot component that elevates the medial side of the foot. This "posting" of the medial foot border is a common technique when developing custom orthotics. Placing the medial side of the forefoot in a posted position reorients the foot's alignment and reduces the amount of pronation. Therefore, cartridges that are wedged shaped in cross section could be supplied at various geometries so that the wearer can choose a cartridge to benefit their personal anatomical alignment.

In accordance with one embodiment of the present invention, a cartridge system for adjusting sizing in an article of footwear is provided. The cartridge system comprises a footbed and a cartridge. The footbed has a forefoot region, and the footbed is removably insertable into the article of footwear. The cartridge has a predetermined sizing and includes a connection member for releasably attaching the cartridge to the forefoot region of the footbed. The cartridge adjusts the volume available to a wearer's foot within a forefoot region of the article of footwear.

In an example, the connection member is insertable into a receptacle on the footbed. Here, the connection member preferably has a length of at least 5 mm. In another example, the footbed includes a top surface for supporting the wearer's foot and a bottom surface remote from the top surface. The cartridge is connectable to the bottom surface of the footbed. Alternatively, the footbed includes a stiffening member therein. In this case, the stiffening member is preferably disposed in a heel region of the footbed.

In another example, the cartridge further includes a fastening member for releasably securing the cartridge to the forefoot region of the footbed. Here, the connection member is desirably disposed along a posterior region of the cartridge and the fastening member is desirably disposed along an anterior region of the cartridge. In this case, the fastening member is preferably a post operable to connect to a receptacle in a toe region of the footbed.

In a further example, the cartridge includes a flex area on at least one of medial and lateral sides of the cartridge. In another example, the footbed comprises a pair of footbeds and the cartridge comprises a pair of cartridges. A first one of the footbeds and a first one of the cartridges are adapted for use with the wearer's left foot, and a second one of the footbeds and a second one of the cartridges are adapted for use with the wearer's right foot. In this case, the predetermined sizing of the first cartridge may be different than the predetermined sizing of the second cartridge.

In an alternative example, the cartridge includes a sizing identifier for indicating the predetermined sizing. In this case, the cartridge preferably includes a first surface adjacent to the footbed and a second surface remote from the first surface, and the sizing identifier is preferably disposed on the second surface. Here, the system may further comprise a slipcover adapted to receive the footbed and the cartridge therein. The slipcover includes an exposed opening configured so that the sizing identifier is readily observable through the exposed opening. In yet another example, the cartridge preferably comprises a plurality of cartridges each having a different predetermined sizing.

In accordance with another embodiment of the present invention, a cartridge system for adjusting forefoot sizing in an article of footwear comprises a footbed and a cartridge. The footbed has a forefoot region and a heel region, and the heel region includes a receptacle therein. The cartridge has a first section of predetermined sizing in communication with the forefoot region of the footbed and a second section including at least one tab for releasably connecting the cartridge to the receptacle in the heel region of the footbed.

In one example, the tab includes a first end connected to the first section and a second end remote from the first end. In this case, the receptacle of the footbed preferably includes an exterior opening and the second section preferably includes a lip member that is received in the exterior opening. In another example, the tab is at least 30 mm in length. Here, the first section preferably has a thickness on the order of 2.5 mm. In another example, the first section has a thickness of at least 2 mm.

In yet another example, the first section of the cartridge includes a first surface adjacent to the footbed and a second surface remote from the first surface. The cartridge further includes a sizing identifier for indicating the predetermined sizing. The sizing identifier is disposed on the second surface of the first section. Here, the footbed desirably includes a sizing identification thereon. Alternatively, the first surface of the first section includes a fastening member for releasably securing the cartridge to the forefoot region of the footbed. In a further example, the cartridge provides forefoot sizing adjustment in the article of footwear but does not provide sizing adjustment in a heel region of the article of footwear.

In accordance with yet another embodiment of the present invention, a cartridge system for adjusting sizing in an article of footwear comprises a footbed and a plurality of cartridges.

The footbed has a forefoot region and a heel region. The plurality of cartridges each have a first section of predetermined sizing adapted to mate with the forefoot region of the footbed and connection means for releasable connection to the footbed. The volume available to a wearer's foot within a forefoot region of the article of footwear is adjusted by selecting one of the plurality of cartridges based on the predetermined sizing.

In one example, the connection means attaches each cartridge to the heel region of the footbed. Preferably, each of the cartridges further includes fastening means for releasably securing the first section to the forefoot region of the footbed.

Another embodiment of the present invention provides an article of footwear comprising an outsole for contacting the ground, an upper attached to the outsole, a footbed and at least one cartridge. The upper and outsole define an enclosure for receiving a wearer's foot. The footbed has an anterior region and a posterior region. The posterior region including a receptacle therein. The footbed is removably insertable into the enclosure. The at least one cartridge has a first section of predetermined sizing for mating to the anterior region of the footbed and a second section including at least one tab for releasably connecting the cartridge to the receptacle in the posterior region of the footbed.

A further embodiment of the present invention comprises a cartridge having an anterior forefoot section of a predetermined thickness and a posterior connection section adjacent to the forefoot section. The connection section includes a tab that is adapted for removable insertion into a footbed. The forefoot section of the cartridge is adapted for positioning in a mating relationship with the footbed, e.g., at least one surface of the forefoot section of the cartridge is placed face to face with at least one surface of the footbed. In one alternative, the tab includes a lip member at a first end thereof remote from the forefoot section of the cartridge. The lip member is adapted for releasable connection to a receptacle opening in the footbed. Here, the cartridge further includes a fastening member on the forefoot section thereof for releasably securing the cartridge in the mating relationship with the footbed.

Another embodiment of the present invention comprises a footbed having a forefoot section and a heel section attached to the forefoot section. The forefoot section includes a mating region adapted to receive a cartridge, e.g., a surface of the forefoot section of the footbed is placed face to face with a surface of the cartridge. The cartridge is interchangeable with other cartridges of different thickness. The footbed has a connection region adapted to receive a connector of the cartridge. The connection region is adapted to removably secure the connector. In one alternative, the forefoot section of the footbed includes first fastening means for detachable connection to second fastening means of the cartridge. Here, the connection region includes an interior channel and an exterior window adjacent thereto. The interior channel is adapted to receive a tab section of the cartridge connector and the exterior window is adapted to receive a lip member of the cartridge connector.

According to a further embodiment of the present invention, a cartridge system for adjusting sizing in an article of footwear comprises a footbed, a cartridge and a support saddle. The footbed has a forefoot region and a heel region. The heel region includes a receptacle therein. The cartridge has a first section of predetermined sizing for mating to the forefoot region of the footbed and a second section including at least one tab for releasably connecting the cartridge to the receptacle in the heel region of the footbed. The support saddle connects to the heel region of the footbed.

In one example, the support saddle is removably attached to the footbed. In another example, the support saddle includes at least one sidewall member disposed along at least a medial side or a lateral side of the support saddle. In yet another example, the system further comprises a board member disposed in communication with the footbed. The board member provides enhanced protection to a wearer of the article of footwear.

Another embodiment of the present invention comprises a cartridge system for adjusting sizing in an article of footwear. The system includes a footbed and a cartridge. The footbed has a forefoot region and a heel region. The heel region includes a receptacle therein, and the footbed includes a plurality of drainage channels therein. At least one of the drainage channels is disposed in the forefoot region thereof. The cartridge has a first section of predetermined sizing for mating to the forefoot region of the footbed and a second section including at least one tab for releasably connecting the cartridge to the receptacle in the heel region of the footbed. The first section includes at least one drainage channel therein. The at least one drainage channel of the forefoot region of the footbed is aligned with the at least one cartridge drainage channel.

In accordance with another embodiment of the present invention, a cartridge system kit for adjusting sizing in an article of footwear is provided. The kit comprises a footbed and a plurality of interchangeable cartridges. The footbed has a forefoot region, and the footbed is removably insertable into the article of footwear. The plurality of interchangeable cartridges is adapted to mate with the forefoot region of the footbed. Each cartridge includes a connection member for releasably attaching the cartridge to the footbed. A user can adjust the volume available to a wearer's foot within a forefoot region of the article of footwear by selecting one of the plurality of cartridges.

In one alternative, a first one of the cartridges has a thickness between about 2 to 3 mm and a second one of the cartridges has a thickness between about 4 to 6 mm. In another alternative, at least some of the plurality of interchangeable cartridges are stackable. In a further alternative, first and second ones of the plurality of cartridges have the same predetermined sizing. Here, the first cartridge has a first hardness, and the second cartridge has a second hardness different from the first hardness. The user may select either the first cartridge or the second cartridge based upon hardness.

Another embodiment of the present invention provides a cartridge system kit for adjusting sizing in articles of footwear. The kit comprising a plurality of articles of footwear having different sizes, a plurality of footbeds, and a plurality of sets of interchangeable cartridges. The footbeds each include a forefoot region therealong. Each footbed has a different size and is adapted for removable insertion into a corresponding one of the different sized articles of footwear. Each set of interchangeable cartridges is for use with a corresponding one of the plurality of footbeds. Each cartridge in a given set is adapted to mate with the forefoot region of the corresponding footbed, and each cartridge in the given set includes a connection member adapted to releasably attach the cartridge to the corresponding footbed. A user adjusts the volume available to a wearer's foot within a forefoot region of a chosen one of the articles of footwear by selecting a corresponding footbed and one of the cartridges in the given set associated with the corresponding footbed.

In one example, each set of interchangeable cartridges comprises a pair of cartridges. Here, a first one of the pair of cartridges in the given set may have a thickness between about 2 to 3 mm and a second one of the pair of cartridges may have a thickness between about 4 to 6 mm. In another example, the forefoot region for at least one of the footbeds is between 2 to 4 mm thick.

The connection member of each respective cartridge may be adapted to attach to a heel region of the corresponding footbed. At least some of the cartridges further include fastening means for releasably securing the cartridge to the forefoot region of the corresponding footbed. Optionally, the forefoot region of each footbed includes a first surface adapted to contact the wearer's foot and a second surface remote from the first surface. Each cartridge in a given set is desirably adapted to mate to the second surface of the forefoot region of the corresponding footbed. In another example, the user may select a right foot article of footwear of a first size and a left foot article of footwear of a second size different from the first size. Alternatively, a first one of the cartridges in the given set has a first sizing and a first hardness, a second one of the cartridges in the given set has the first sizing and a second hardness, and the user selects between the first and second cartridges based on hardness.

In accordance with a further embodiment of the present invention, a method of fitting footwear to a wearer's foot comprises selecting an article of footwear of a predetermined size; providing a footbed including a forefoot region therealong, the footbed being sized in relation to the predetermined size of the article of footwear so as to be removably insertable into the article of footwear; providing a plurality of interchangeable cartridges adapted to mate with the forefoot region of the footbed, each of the cartridges having a predetermined volume and including a connection member for releasably attaching the cartridge to the footbed; selecting one of the cartridges based upon the predetermined volume; and releasably attaching the cartridge to the footbed with the connection member.

The method may further comprise adjusting the fit of the article of footwear to the wearer's foot by replacing the selected cartridge with another cartridge having a different predetermined volume. Alternatively, a first one of the cartridges has a first predetermined volume and a first hardness, a second one of the cartridges has the first predetermined volume and a second hardness, and the method may further comprise selecting between the first and second cartridges based on hardness.

In one example, the steps of selecting an article of footwear, selecting a footbed, providing a plurality of interchangeable cartridges, and selecting one of the cartridges are performed for the right and left feet of the wearer. In another example, the step of selecting a footbed includes electing between first and second footbeds of the same size, the first footbed having a first hardness and the second footbed having a second harness. Here, the forefoot region of the first footbed may have the first hardness and the forefoot region of the second footbed may have the second hardness.

In accordance with yet another embodiment of the present invention, a method of selecting footwear to fit a wearer's foot comprises selecting a style of footwear; selecting an article of footwear in the style having a predetermined size; providing a footbed including a forefoot region therealong, the footbed being sized in relation to the predetermined size of the article of footwear so as to be removably insertable into the article of footwear; selecting one cartridge from among a plurality of interchangeable cartridges adapted to mate with the forefoot region of the footbed, each of the cartridges having a predetermined volume and including a connection member for releasably attaching the cartridge to the footbed; and releasably attaching the selected cartridge to the footbed with the connection member. Here, the selected cartridge may be chosen based upon its predetermined volume. Alternatively the selected cartridge is chosen based on hardness.

In accordance with another embodiment of the present invention, a method of sizing footwear by employing interchangeable cartridges having predetermined sizing along with footwear adapted to receive the interchangeable cartridges comprises determining a range of foot sizes to be fit by the footwear and the interchangeable cartridges; selecting a sizing increment to cover the number of sizing units; calculating a number of sizing units to encompass the range of foot sizes; creating a set of molds based upon the selected sizing increment and the sizing units; and fabricating interchangeable cartridges with the molds.

DETAILED DESCRIPTION

In describing the preferred embodiments of the invention illustrated in the appended drawings, specific terminology will be used for the sake of clarity. However, the invention is not intended to be limited to the specific terms used, and it is to be understood that each specific term includes all technical equivalents that operate in a similar manner to accomplish a similar purpose.

Figures 1A, 1B, 1C:
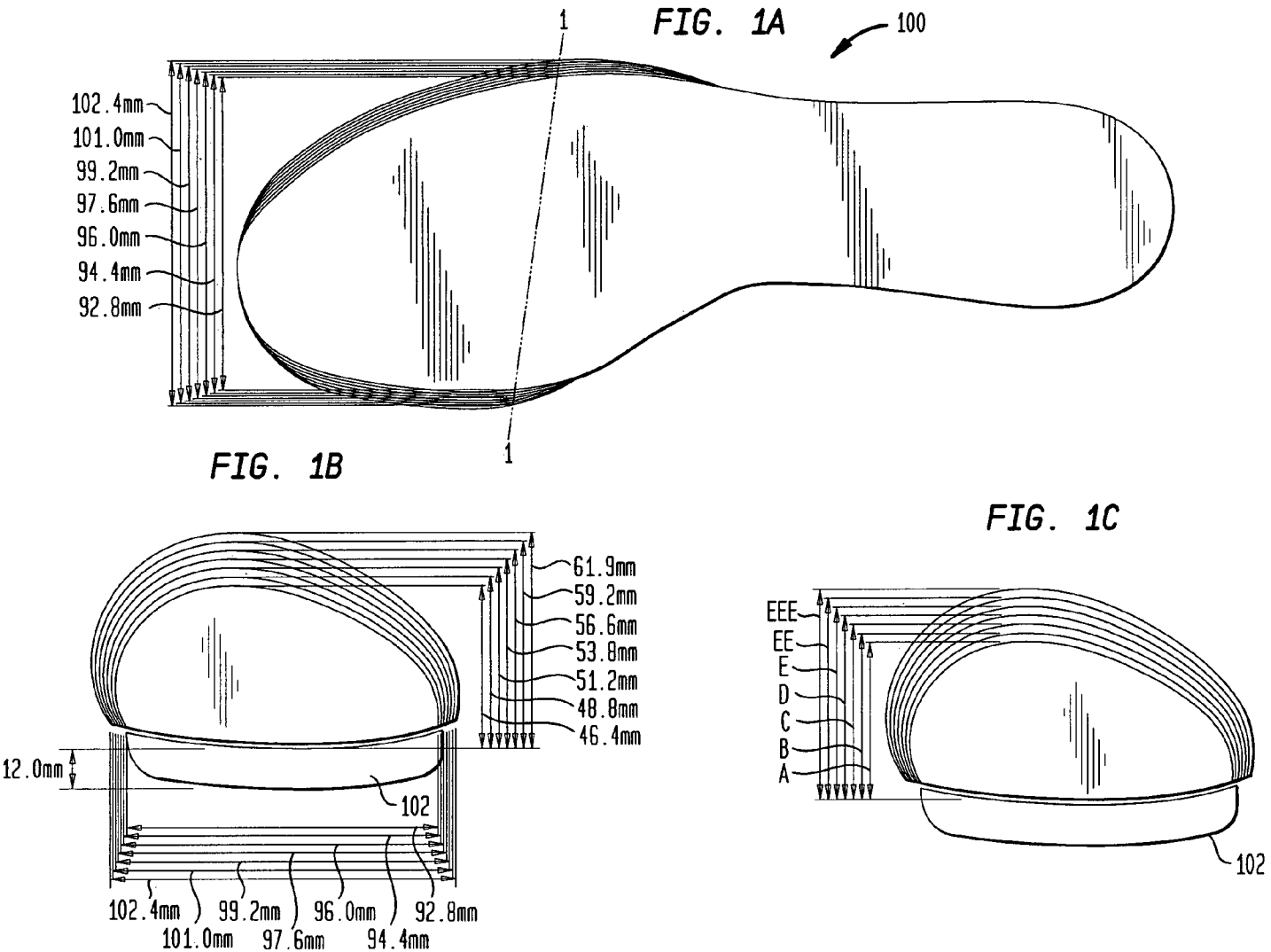
FIGS. 1(*a*)-(*c*) illustrate dimensions of a foot sizing system in accordance with aspects of the present invention.

As discussed earlier, adjusting forefoot volume and/or width within a shoe can significantly help to accommodate individual fit and comfort needs. The forefoot includes the metatarsals and may be considered to be approximately from the high point of the longitudinal arch of the foot forward to the tips of the toes. Reference is now made to FIGS. 1(*a*)-(*c*), which show a template sizing system 100 in accordance with aspects of the present invention. The top view of FIG. 1(*a*) illustrates width variations from size A to size EEE. The widths are calculated at the metatarsal heads, and may be referred to as forefoot breadth. The widths range from about 92.8 mm for size A up to about 102.44 mm for size EEE. The width range is thus on the order of 9.6 mm. This width range covers the vast majority of forefoot widths.

FIG. 1(*b*) is a cross-sectional view taken along the 1-1 line of FIG. 1(*a*). As seen in FIG. 1(*b*), for a given base chassis or footbed 102, in addition to the width, the height can range from size A up to size EEE. Here, the heights range from about 46.4 mm for height A up to about 61.9 mm for height EEE. The height range is thus on the order of 15.5 mm. This height range covers the vast majority of forefoot heights.

As seen in FIG. 1(*c*), the height and width ranges equate to volumes sized from A up to EEE. The A volume is about 3,257 $mm^2$ and the EEE volume is about 5,169 $mm^2$. The volume range in the forefoot region between sizes A and EEE is on the order of 1,912 $mm^2$. Thus, it can be seen that adjusting the forefoot sizing of the shoe, in particular the volume, can enable a footwear manufacturer to supply shoes that fit most or all potential customers.

Figure 2A:
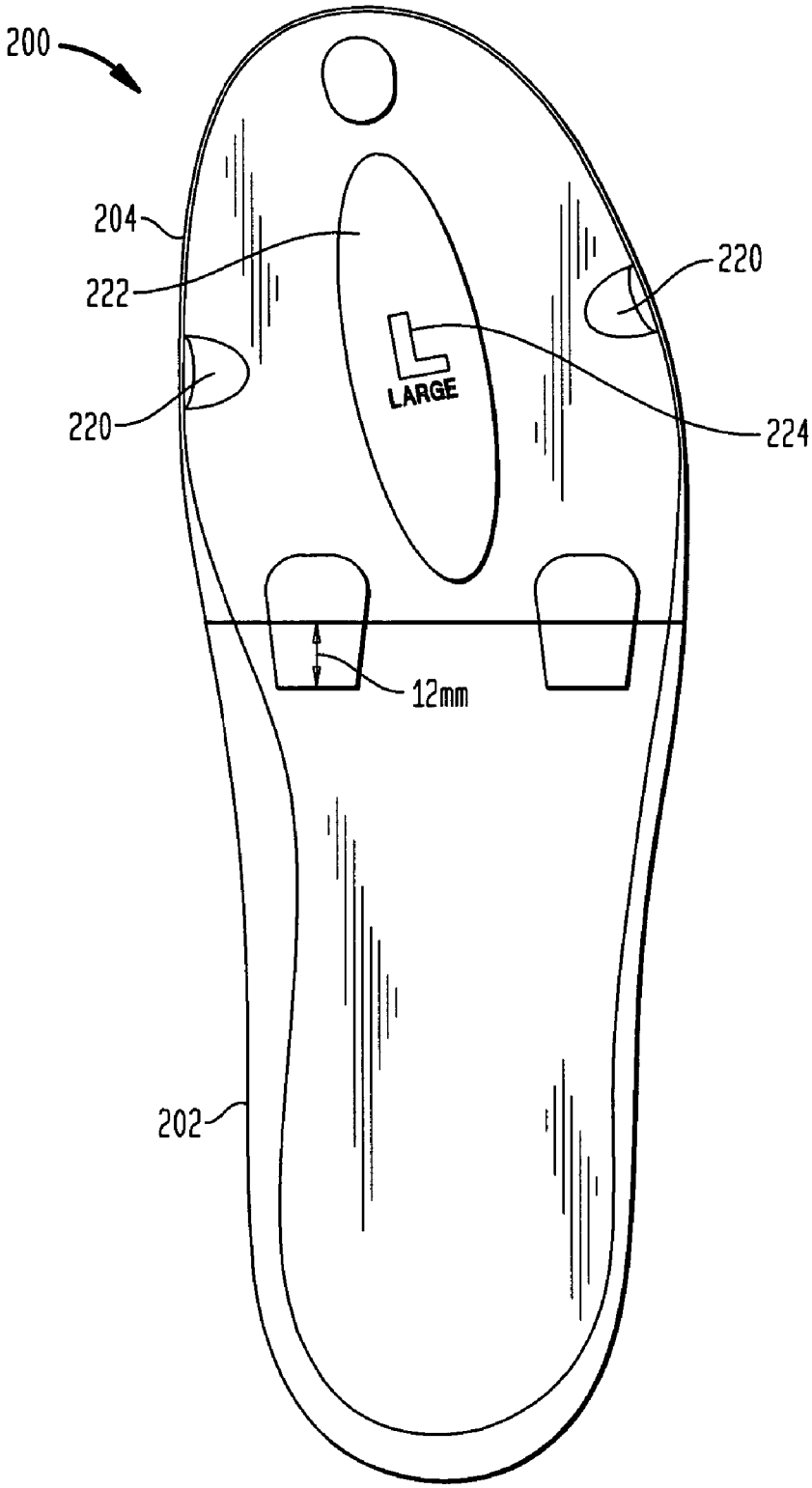
FIGS. 2(*a*)-(*c*) illustrate an interchangeable cartridge system in accordance with aspects of the present invention.
Figure 2B:
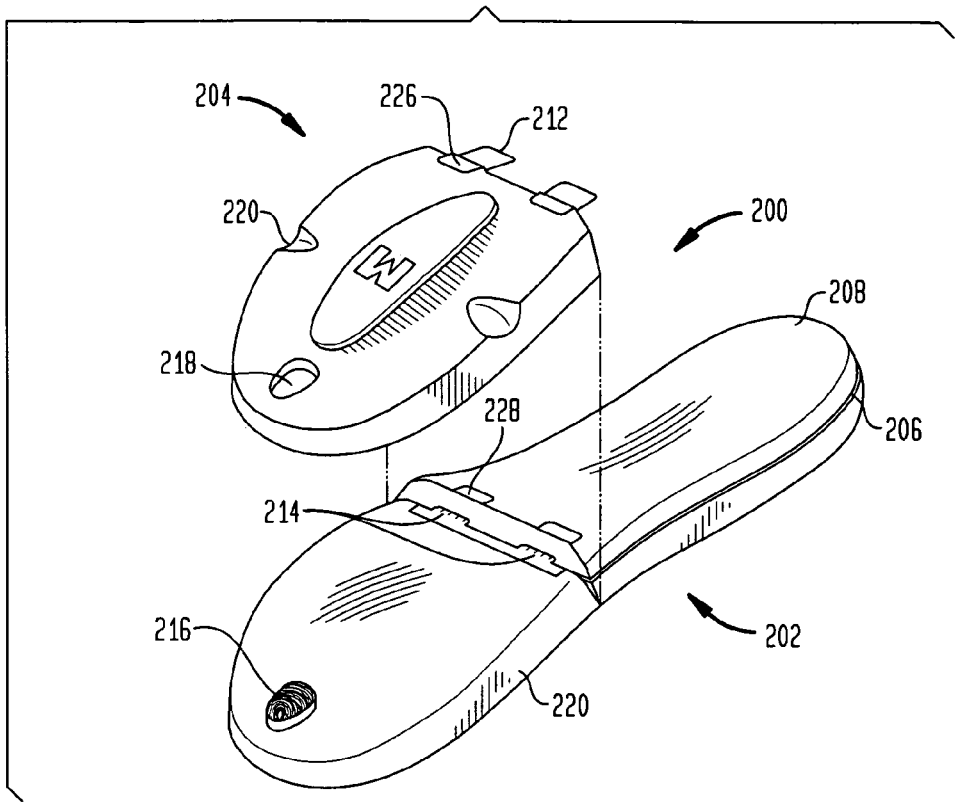
Figure 2C:
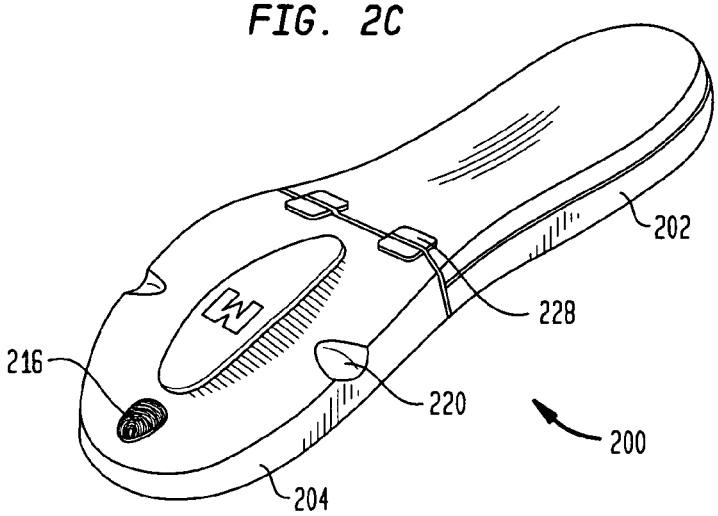
Figure 3A:
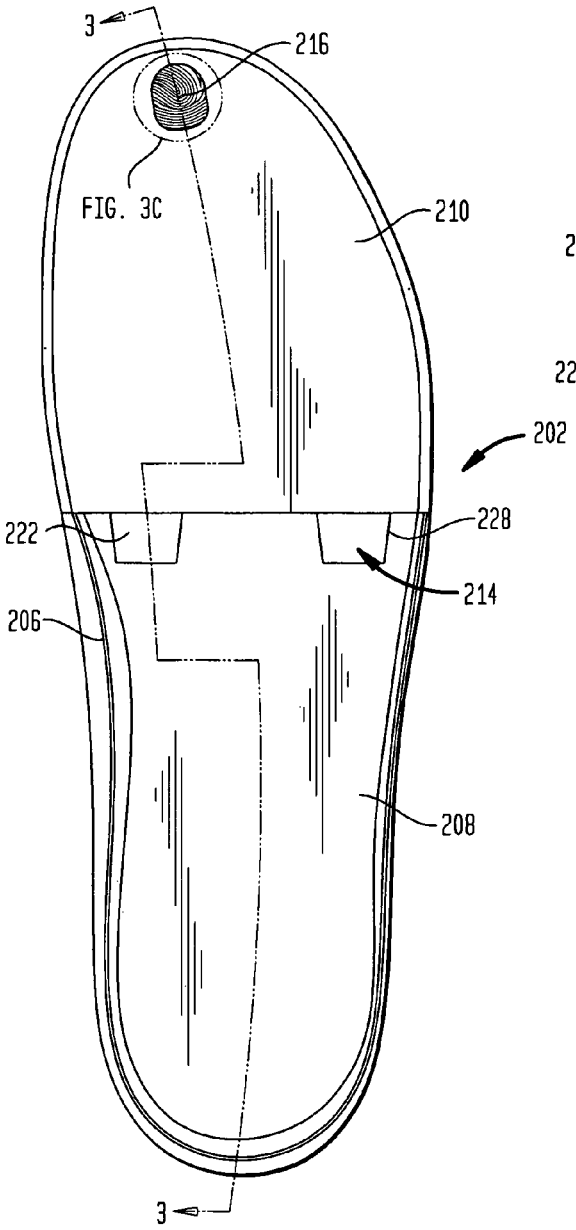
FIGS. 3(*a*)-(*e*) illustrate components of the cartridge system of FIGS. 2(*a*)-(*c*).
Figure 3B:
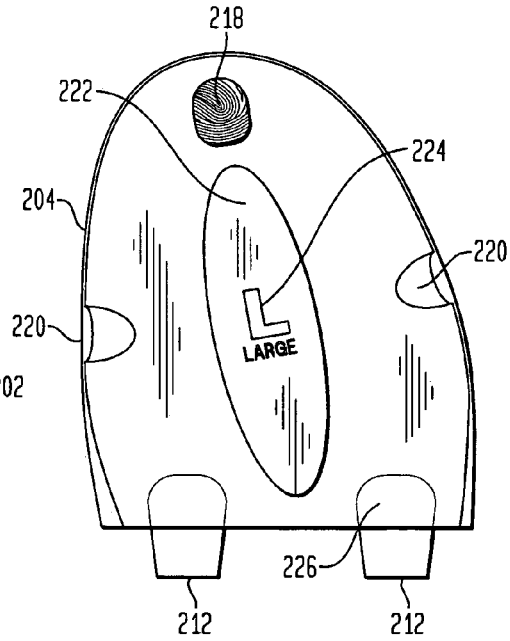
Figure 3C:
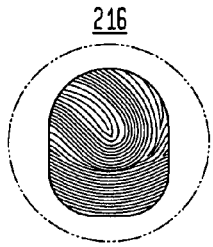
Figure 3D:
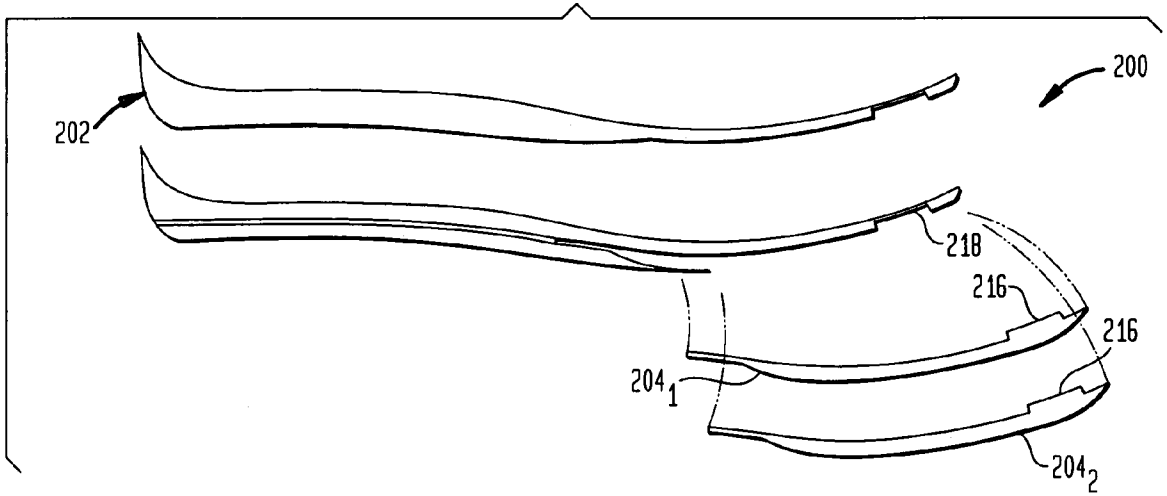
Figure 3E:
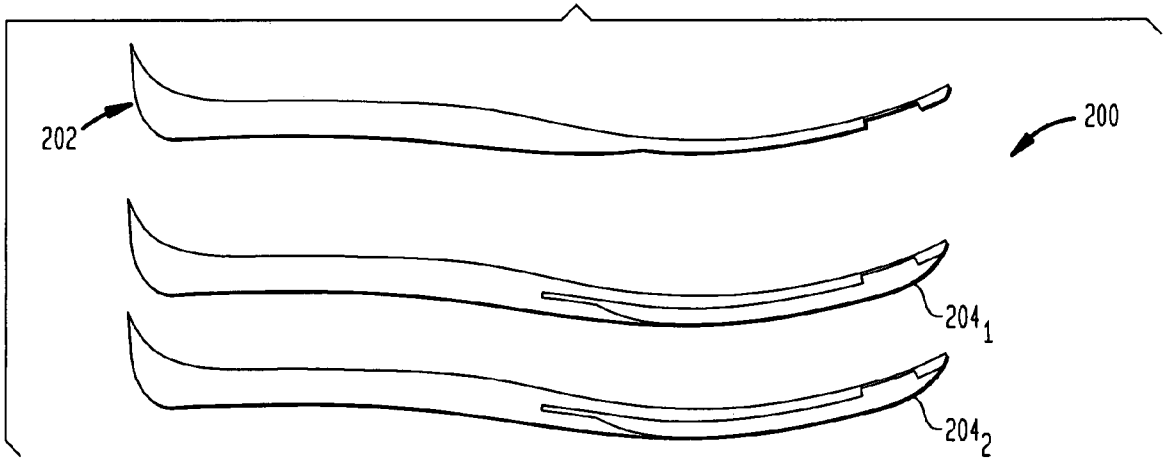
Figures 4A, 4B, 4C, 4D, 4E, 4F:
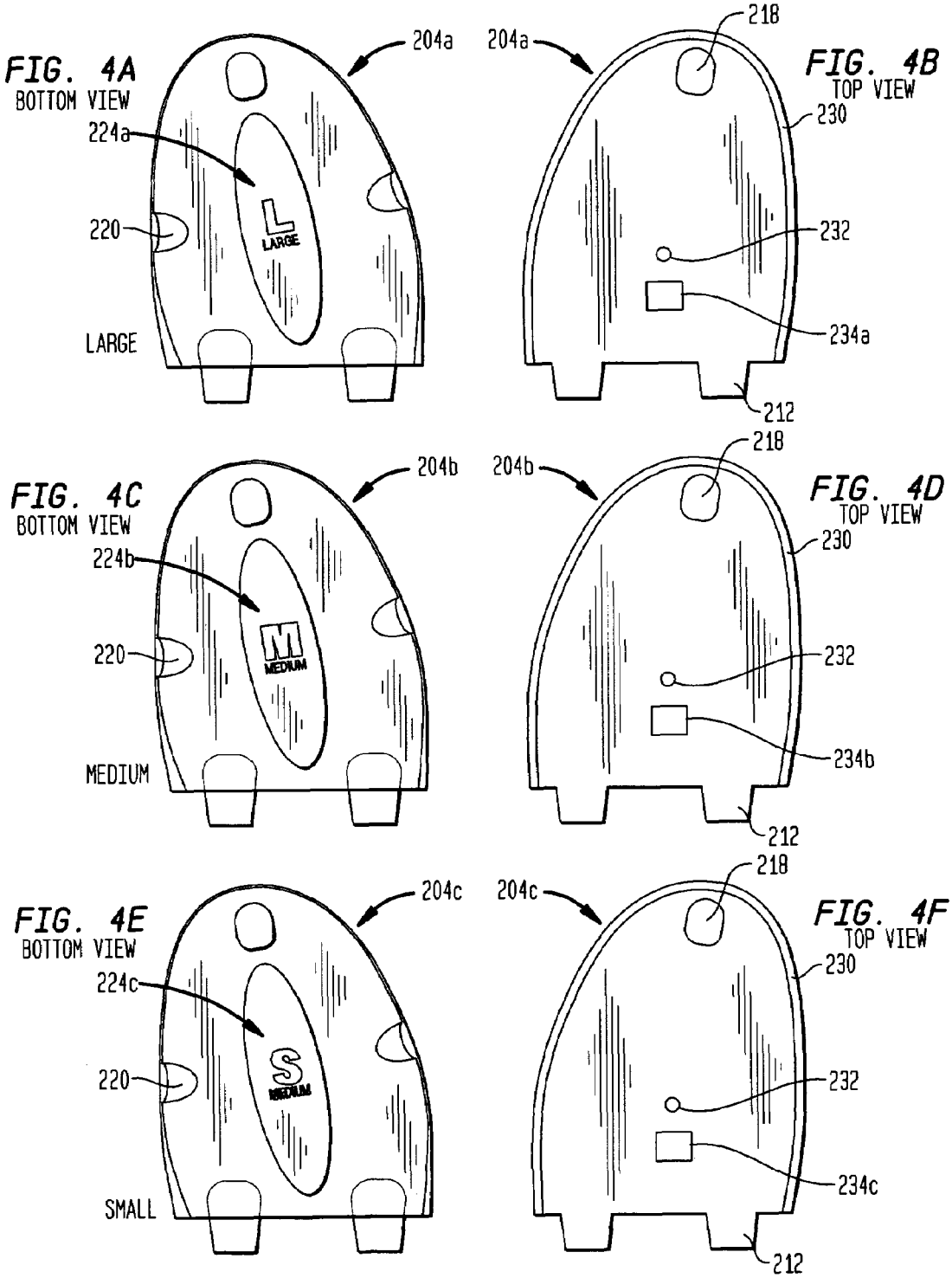
FIGS. 4(*a*)-(*j*) illustrate views of interchangeable cartridges.
Figure 4G:
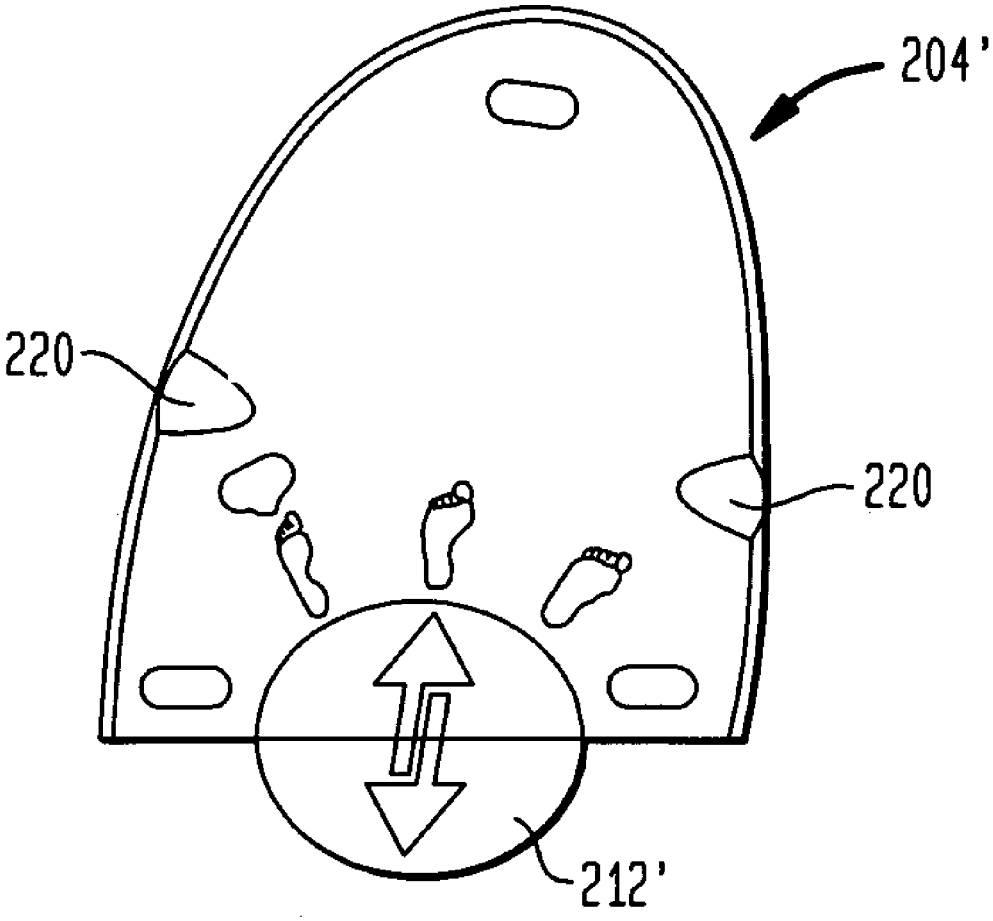
Figure 4J:
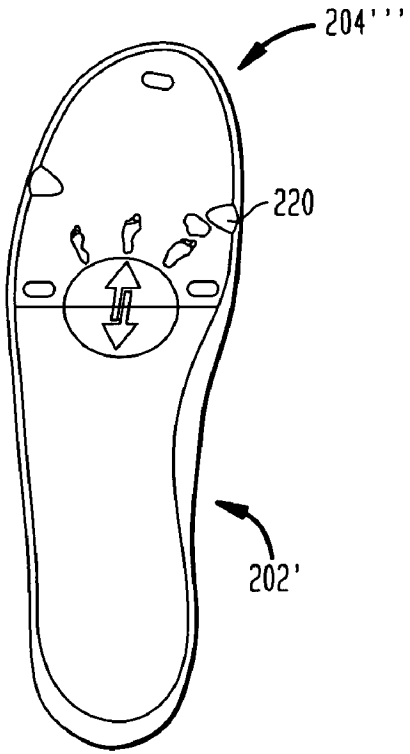
Figure 4I:
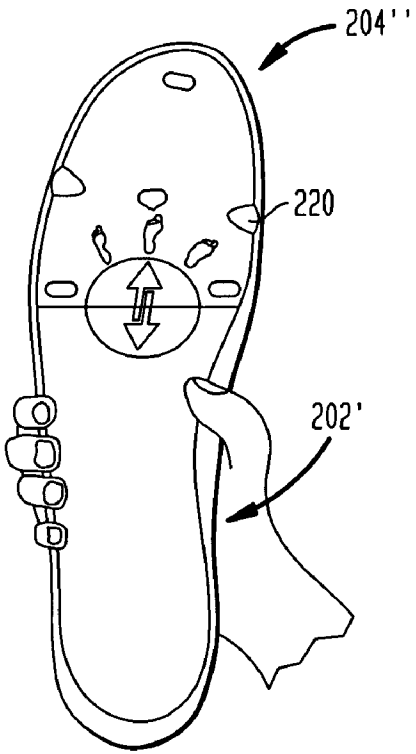
Figure 4H:
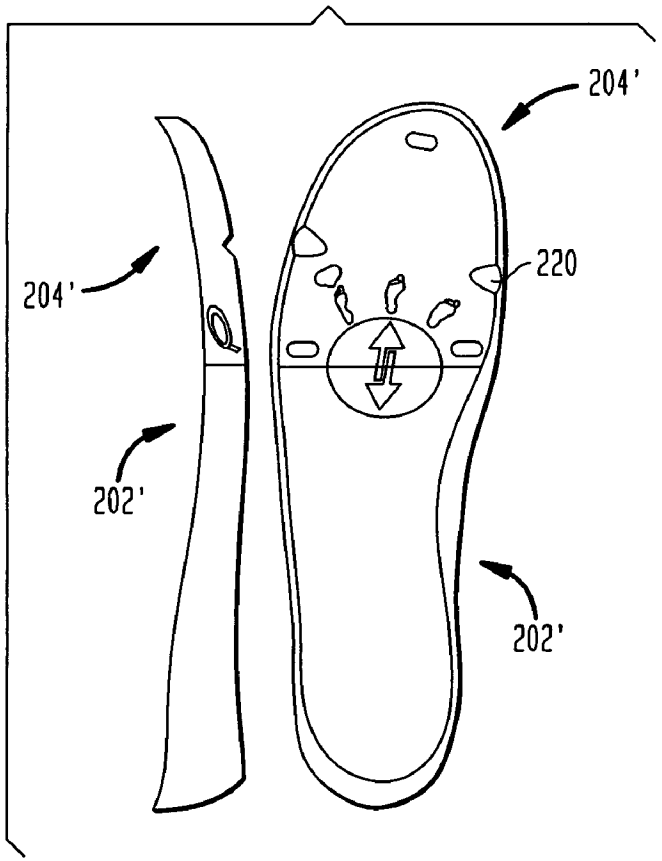
Figure 5A:
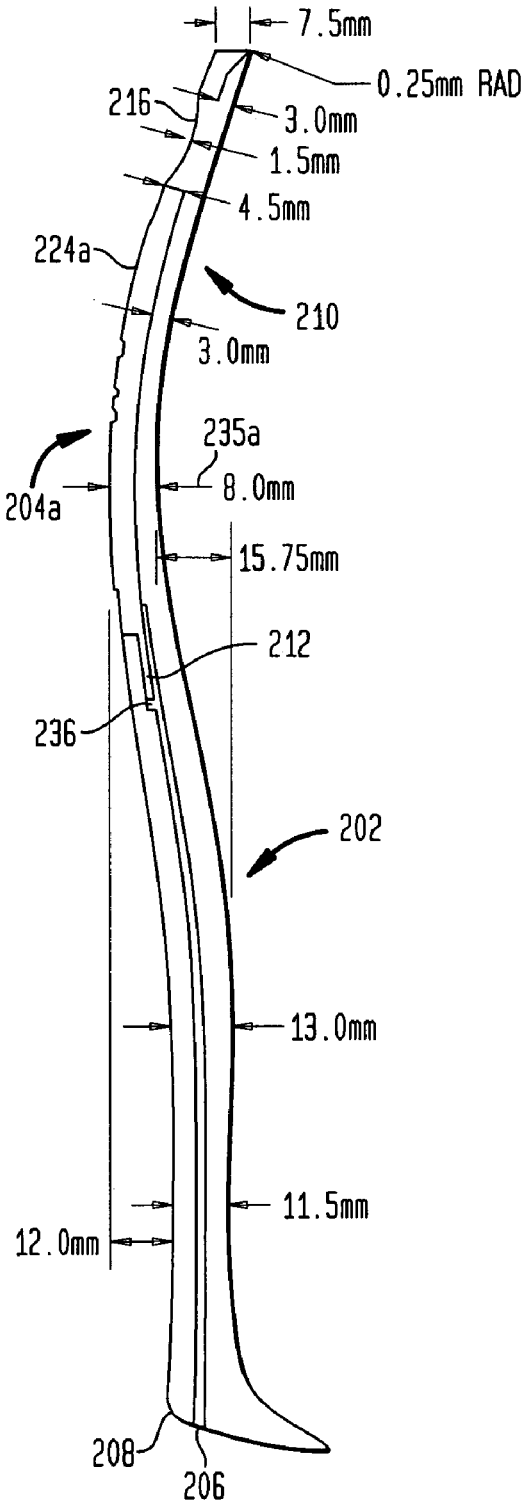
FIGS. 5(*a*)-(*d*) are cross-sectional views of the cartridge system of FIGS. 2(*a*)-(*c*).
Figure 5B:
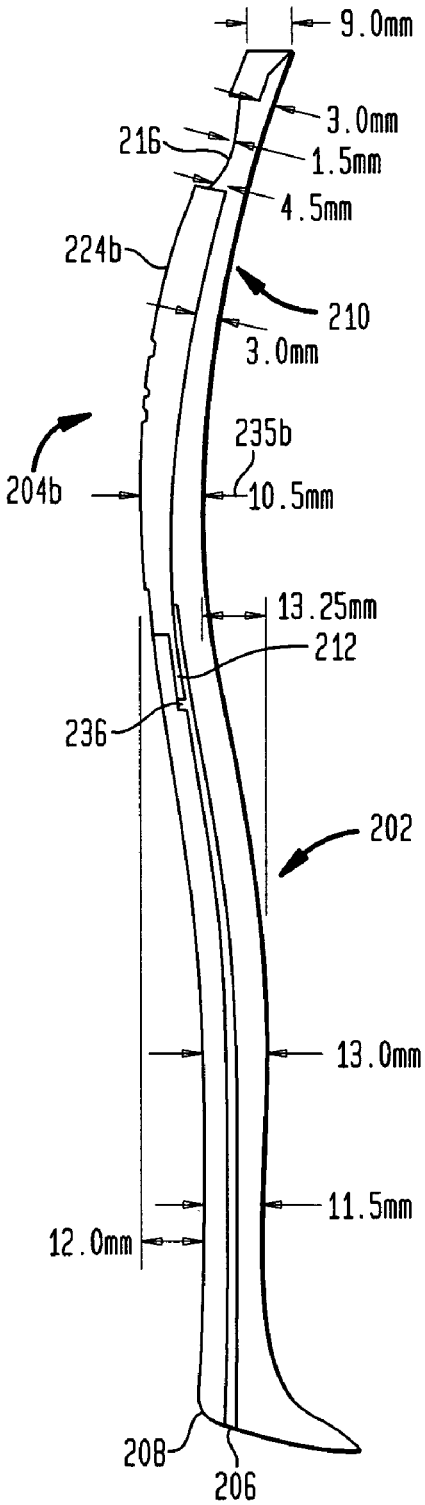
Figure 5C:
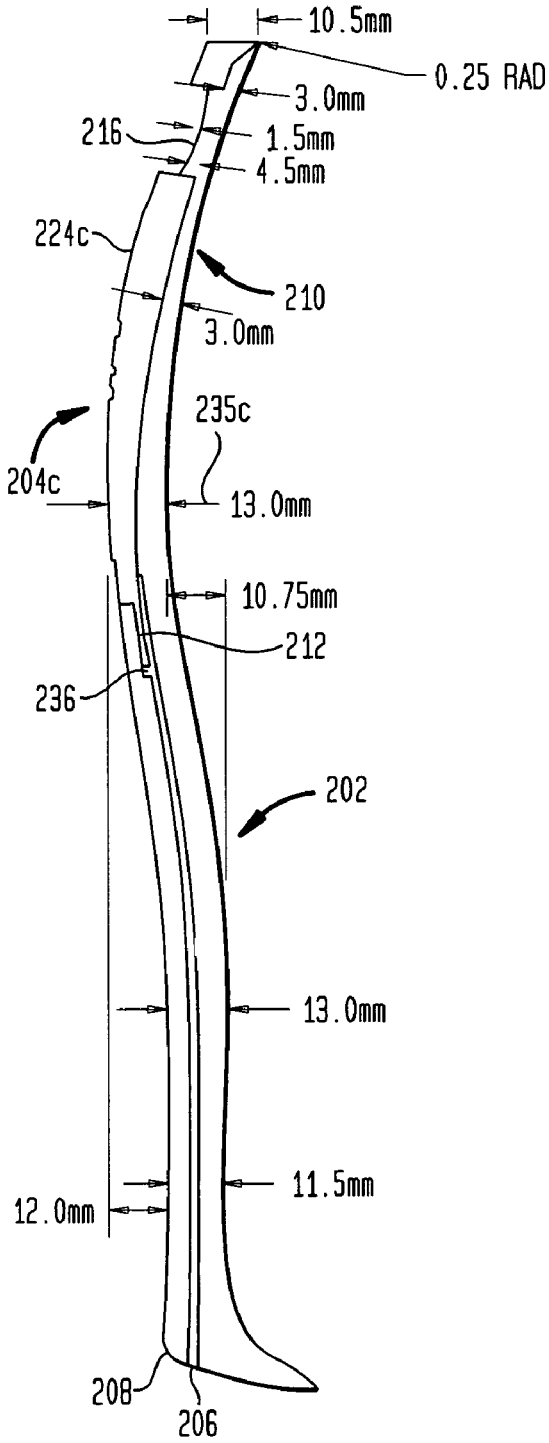
Figure 5D:
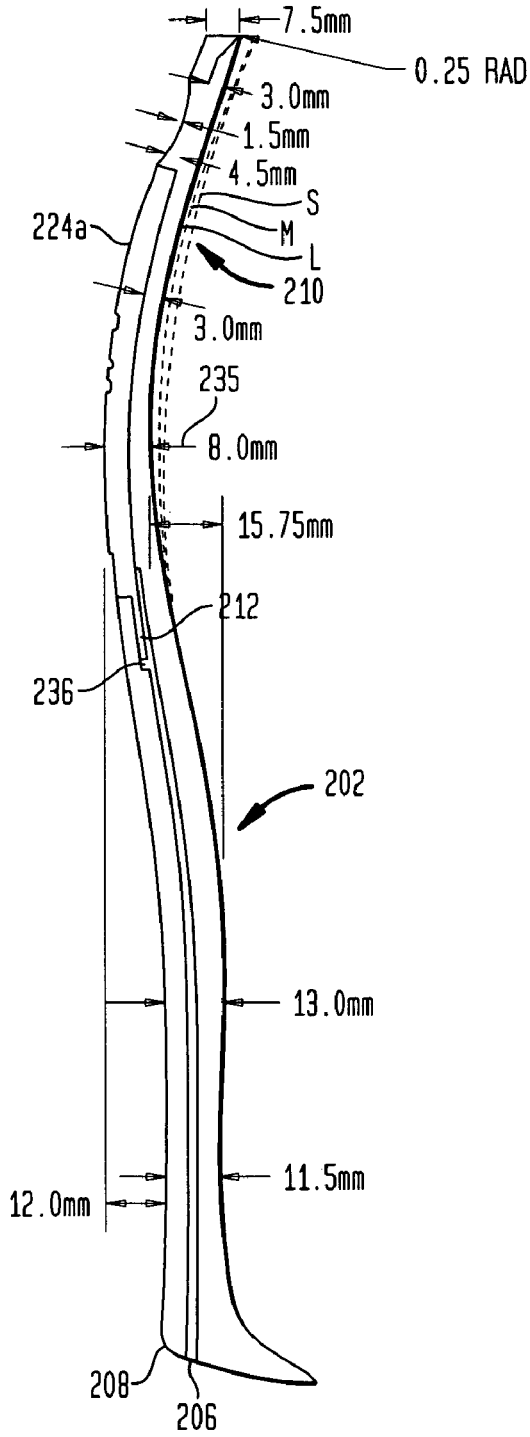

FIGS. 2(*a*)-(*c*) illustrate an interchangeable cartridge system 200 in accordance with an embodiment of the present invention. As seen in the bottom view of FIG. 2(*a*), the cartridge system 200 includes a footbed, insock, or other shaped area 202 for supporting portions of the foot, as well as a cartridge or resizing member 204. As seen in the exploded and assembled perspective views of FIGS. 2(*b*)-(*c*), the cartridge 204 is insertable into the footbed 202 and is secured in place by releasable fastening means as will be described below. The footbed 202 need not extend the entire length of the foot from the toes to the heel. For instance, the footbed 202 may only be positioned in the toe region of the shoe, or extend from the toes through part or all of the instep region of the sole. The footbed 202 and/or the cartridge 204 may be formed from resilient materials such as EVA or PU foams or other such materials commonly used in shoe midsoles, insoles or sockliners. One or both of the footbed 202 and the cartridge 204 may be formed of multiple material layers, regions and/or segments, which may each have a different thickness and/or a different rigidity. For example, the footbed 202 or the cartridge 204 may comprise multiple layers of different rigidity. In this case, a first layer may be, e.g., an EVA layer having a hardness of 20 on the Asker C scale, a second layer may be a PU layer having a hardness of 30 Asker C, and a third may a thermoplastic PU layer having a hardness of 40-50 Asker C. Alternatively, the footbed 202 may have different levels of rigidity in the forefoot and heel regions, respectively. The footbed 202 or the cartridge 204 could also have a first segment about the first metatarsal of a first rigidity and a second segment about the fifth metatarsal of a second rigidity. Alternatively, different cartridges 204 of the same size may have different densities or hardness. In this case, a wearer may swap out one cartridge for another based on the density/hardness. This may be done, for instance, depending upon the type of activity to be undertaken, the type of terrain or other environmental conditions.

FIGS. 3(*a*)-(*b*) are bottom views of the separated footbed 202 and cartridge 204, respectively. As seen in FIG. 3(*a*), the footbed 202 may optionally include a stiffening, stabilizing, or reinforcement member 206. As will be described below, the stiffening member 206 is preferably integral with the rest of the footbed 202. The stiffening member 206 can be made from one or more different materials, including thermoplastic polyurethane ("TPU"), EVA, nylon, etc.

The footbed 202 includes a heel bottom 208 and a forefoot bottom 210, which is recessed relative to the heel bottom 208. In the example shown in FIG. 3(*a*), the width of the forefoot bottom 210 measured along the metatarsal head area is preferably on the order of 96.5 mm. This width is between the C and D widths shown in FIGS. 1(*a*)-(*b*).

The fastening means preferably includes one or more tabs, protrusions, plugs or other connection members 212 on the cartridge 204 that engage respective slots or recesses 214 on the footbed 202. The user may line up the tabs 212 with the slots 214 and then push the tabs 212 fully into the slots 214. The tabs 212 preferably extend at least 5.0 mm away from the body of the cartridge 204. Shorter lengths may be appropriate if fastening can be achieved. More preferably, the tabs 212 are on the order of 12.0 mm long, which provides ample connectivity even when the foot is fully flexed during walking or running. Desirably, the tabs 212 are at least 5.0 mm wide for proper fastening, although as shown the tabs 212 are approximately 15 mm wide. When the tabs 212 are fully inserted into the slots 214, the cartridge 204 is securely connected to the footbed 202. The tabs 212 may be integrally formed with the rest of the cartridge 204, for example as part of a molding process. Alternatively, the tabs 212 may be fabricated apart from the body of the cartridge 204 and may be attached to the body using, for instance, an adhesive material or glue. In this case, the tabs 212 may be the same or a different material from the cartridge 204, such as EVA, PU or TPU. Moreover, the ends of the tabs 212 may have a "lip" or overhang to assist in a secure and releasable connection to the slots 214.

While the male connection members are shown in FIG. 3(*b*) as being part of the cartridge 204 and the female connection members are shown in FIG. 3(*a*) as being part of the footbed 202, it can be appreciated that female connection members may be part of the cartridge 204 and male connection members may be part of the footbed 202. Furthermore, when more than one connection member is utilized, both male and female connection members may be part of the footbed 202 and counterpart female and male connection members may be part of the cartridge 204.

Additional fastening means may include a post or other protruding member 216 in the forefoot bottom 210 and a corresponding receptacle, recess, or other opening 218 in the forward end of the cartridge 204. The post 216 extends outward away from the forefoot bottom 210. Preferably, the post 216 is sized to securely fit into the receptacle 218, which may be a hole through the body of the cartridge 204. This secure fit provides a supplemental connection between the footbed 202 and the cartridge 204. To connect the cartridge 204 to the footbed 202, the tabs 212 are first inserted into the slots 214, and then the post 216 is secured within the receptacle 218.

Details of the post 216 are more clearly seen in the enlarged view of FIG. 3(*c*) and in FIG. 2(*b*). Preferably, the surface of the post 216 is textured. More preferably, the textured surface has the shape of a fingerprint such as a thumbprint. The surface of the post 216 may be flush with the bottom face of the cartridge 204. However, it is preferable to recess the post surface within the receptacle 218.

The post 216 may act as release means in addition to a fastening means. The thumbprint and/or the recessed surface give the user a visual cue to press on the post 216. These features also facilitate disengagement of the post 216. When the post 216 is pressed, the user may also pull on the cartridge 204. The pressing and/or pulling disengage the post 216 from the receptacle 218, allowing the user to quickly and easily pull the cartridge 204 away from the footbed 202. An alternative or complementary release means may include one or more post-like protrusion placed on the top surface of the cartridge 204 (not shown). In this case, the footbed 202 may include recesses or cutouts on either side of the protrusions. These protrusions may also include fingerprint visual cues.

While the post 216 is shown in FIG. 3(*a*) as part of the footbed 202 and the receptacle 218 is shown in FIG. 3(*b*) as being in the cartridge 204, it should be understood that the post 216 may be disposed on the cartridge 204 and the receptacle 218 may be disposed on the footbed 202. As seen in FIG. 3(*d*), the interchangeable cartridge system 200 may employ a pair of cartridges to change the sizing inside an article of footwear to insure proper fit. In this figure, the cartridge system 200 preferably includes the footbed 202 as well as cartridges $\mathbf{204}_1$ and $\mathbf{204}_2$. Here, the posts 216 are disposed on the cartridges $\mathbf{204}_1$ and $\mathbf{204}_2$, and the receptacle 218 is disposed in the footbed 202, for instance along the bottom forefoot region of the footbed 202. As shown in FIG. 3(*e*), the footbed 202 may be used without the cartridges $\mathbf{204}_1$ and $\mathbf{204}_2$ to accommodate feet of different sizes. Preferably, the cartridge $\mathbf{204}_1$ has an average thickness on the order of 2.5 mm, for example between 1.5 and 4.5 mm, and the cartridge $\mathbf{204}_2$ has an average thickness on the order of 5 mm, for example between 3 and 7 mm. Of course, it should be understood that any number of cartridges 204 may be employed, either alone or in combination, to achieve proper fit, and the thickness of each cartridge 204 may be greater or lesser than the specific examples provided.

While the present embodiment shows the use of mating tabs 212 and slots 214, as well as the post 216 and the receptacle 218, it should be understood that a wide variety of other connector means might be also employed. By way of example only, it is within the scope of the invention to use connectors such as hook and loop fasteners, dowels, clips, snaps, etc. In addition, one or both of the mating surfaces of the footbed 202 and cartridge 204 (e.g., the bottom surface of the forefoot region of the footbed 202 and the top surface of the cartridge 204) may comprise a material or coating having a high coefficient of friction to prevent slippage between the footbed 202 and the cartridge 204. Furthermore, the cartridge 204 may comprise multiple layers that connect, either individually or together, to the footbed 202. As mentioned above, the layers may each have a different thickness and/or rigidity. In work boots or other footwear offerings where there is concern regarding relative movement of the footbed and the cartridge, it may be advantageous to make the size adjustment permanent. This should only occur after the user has determined his or her most comfortable size by fitting each cartridge to the footbed and testing the fit. In these situations, the cartridge may be permanently fixed to the footbed with cement, double-sided tape or other suitable bonding methods.

As seen in FIG. 3(*b*), the bottom of the cartridge 204 may include one or more flex grooves, indentations, score lines, sipes or flex areas 220. The flex grooves or flex areas 220 permit the cartridge 204 to flex, for instance when the wearer is walking or running, or otherwise engaged in movement. It is possible to use score lines or other flexion means in place of or in combination with the flex grooves 220. The connecting or parting line between the cartridge 204 and the footbed 202 is desirably located behind the flex area of the shoe. In this way, the shoe, the footbed 202 and the cartridge 204 may flex without placing undue strain on the connection between the mating tabs 212 and slots 214.

The bottom of the cartridge 204 may also include a region 222 that is used to identify the type of cartridge 204. For example, the region 222 in FIG. 3(*b*) has indication means 224 in the displayed embodiment as "L" or "large" to show that this is a large cartridge. The region 222 may be, for instance, a raised plateau or a recess in the cartridge 204. The indication means 224 may be, for example, distinctive lettering, numbers, symbols, colors and/or textures. Preferably, such examples may be independent of a particular language. Preferably, if the region 222 includes, for example, a raised plateau of 0.5 mm, then the indication means 224 includes an indicator recessed approximately 0.5 mm. Similarly, if the region 222 includes, for example, a recess of 0.5 mm, then the indication means 224 preferably includes a raised indicator of approximately 0.5 mm. Furthermore, the cartridge 204 and the heel bottom 208 of the footbed 202 may include raised portions 226 and 228, respectively, to indicate to a user where the tabs 212 and slots 214 are located. Desirably, the raised portions 226 and 228 are non-functional. Preferably, the raised portions 226 and 228 are elevated about 0.5 mm. This provides a substantially flat resultant surface to enhance wearer comfort.

FIGS. 4(*a*)-(*f*) illustrate views of "large", "medium" and "small" cartridges. Specifically, FIGS. 4(*a*)-(*b*) illustrate bottom and top views, respectively, of a large cartridge 204(*a*), FIGS. 4(*c*)-(*d*) illustrate bottom and top views, respectively, of a medium cartridge 204(*b*), and FIGS. 4(*e*)-(*f*) illustrate bottom and top views, respectively, of a small cartridge 204(*c*). The top and bottom views for each cartridge 204(*a*)-(*c*) are structurally very similar, and are readily interchangeable for use with the footbed 202. For example, each cartridge preferably includes the tabs 212, the receptacle 218, the flex grooves 220, a beveled upper edge 230 and a measurement location identifier 232. However, the indication means 224 (*a*)-(*c*) on the bottom side of each cartridge should indicate the different sizes of the respective cartridge 204(*a*)-(*c*). On the top side, each cartridge 204(*a*)-(*c*) may also include another indication means 234(*a*)-(*c*), respectively, which can show the size and/or thickness of the cartridge. Furthermore, different cartridges may be distinguished by using different colors, shading, textures, etc. The different sized cartridges 204(*a*)-(*c*) enable a wearer to select the size which gives him or her the best fit when wearing a shoe. As discussed above, it is not uncommon for the left and right feet to have different shapes and/or sizes. Therefore, because different cartridges 204 or other resizing members are available, the wearer can mix and match cartridges 204 to achieve the best fit possible. While only three sizes are shown, any number of cartridge sizes is possible.

FIGS. 4(*g*)-(*j*) illustrate an alternative embodiment of a footbed and cartridge system in accordance with the present invention. Here, footbed 202' may connect to any of cartridges 204', 204" or 204'", which represent narrow, medium and wide inserts, respectively. Each of the cartridges may include one or more of the flex grooves 220, for instance on the bottom or top surface thereof. A single connection member 212' preferably extends from the cartridge 204', 204" or 204'" and is securely received by the footbed 202'. As shown in FIG. 4(*g*), the connection member 212' may have a geometrical shape such as a partial ellipse or circle, although any other shape may be employed. The footbed 202' preferably includes a receptacle (not shown) akin to slot 214 with a reciprocal shape adapted to receive the connection member 212'. Using a connection member 212' with an ellipse shape has an added advantage of self-centering the cartridge 204', 204" or 204'" into the footbed 202' when the ellipse is inserted into a slot with the reciprocal shape on the footbed 202'.

FIGS. 5(*a*)-(*c*) illustrates side cutaway views along the 3-3 line of FIG. 3(*a*). Specifically, FIG. 5(*a*) shows the large cartridge 204(*a*) connected to the footbed 202, FIG. 5(*b*) shows the medium cartridge 204(*b*) connected to the footbed 202, and FIG. 5(*c*) shows the small cartridge 204(*c*) connected to the footbed 202. Each cartridge 204(*a*)-(*c*) provides a different total cross section 235 along the metatarsal region. It can be seen that the large cartridge 204(*a*) actually provides the smallest total cross section 235(*a*) of approximately 8 mm. In contrast, the medium cartridge 204(*b*) provides a total cross section 235(*b*) of approximately 10.5 mm and the small cartridge 204(*c*) provides a total cross section 235(*c*) of approximately 13 mm. The thickness of each cartridge 204 may vary from the forward end near the receptacle 218 to the rearward end near the tabs 212. Nonetheless, in general, the cartridge 204(*a*) preferably has a thickness on the order of 5 mm, the cartridge 204(*b*) preferably has a thickness on the order of 7.5 mm, and the cartridge 204(*c*) preferably has a thickness on the order of 10 mm. Of course, it should be understood that different cartridges might be chosen to have different thickness greater than 10 mm, less than 5 mm, or any thickness in between.

It can be seen that while the three cartridges 204(*a*)-(*c*) are referred to as large, medium and small, respectively, these terms actually refer to the available volume within the interior of the shoe once the cartridge system 200 is in place. The thinnest cartridge 224(*a*) provides the largest volume available for a wearer's foot, and the thickest cartridge 224(*c*) provides the smallest volume available for the wearer's foot.

The volume differentials are seen more clearly in FIG. 5(*d*), wherein the large cartridge 204(*a*) is connected to the footbed 202. Here, the "L" line indicates that the large cartridge provides approximately 5 mm of additional space relative to the small cartridge, or, as seen in FIG. 5(*a*), approximately 15.75 mm of depth relative to the heel region of the footbed 202. Dashed line "M" indicates that the medium-sized cartridge provides approximately 2.5 mm of additional space relative to the small cartridge, or, as seen in FIG. 5(*b*), approximately 13.25 mm of depth relative to the heel region of the footbed 202. Dashed line "S" indicates space that would be taken up by the small-sized cartridge. As seen in FIG. 5(*c*), the combination of the footbed 202 and the cartridge 204(*c*) takes up approximately 10.75 mm of depth relative to the heel region of the footbed 202.

As seen in FIGS. 5(*a*)-(*d*), the footbed 202 preferably includes the stiffening member 206 or other reinforcement structure. A main function of the stiffening member 206 is to distribute or dissipate forces (e.g., when the wearer is running) across the footbed 202. The stiffening member may include a lip or other type of flange 236 to act as a stopping point for the tab 212, and the lip 236 is placed to match up with the tab 212 when the cartridge 204 is fully inserted into the footbed 202. Desirably, the front end of the heel bottom 208 overlies the tab 212. Preferably, the tab 212 is sandwiched between the stiffening member 206 on one side and the front end of the heel bottom 208 on the other side.

Figure 6A:
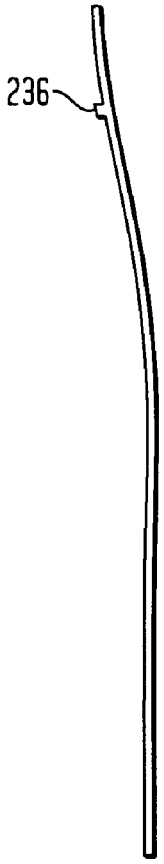
FIGS. 6(*a*)-(*b*) illustrate a stiffening member for use with cartridge systems of the present invention.
Figure 6B:
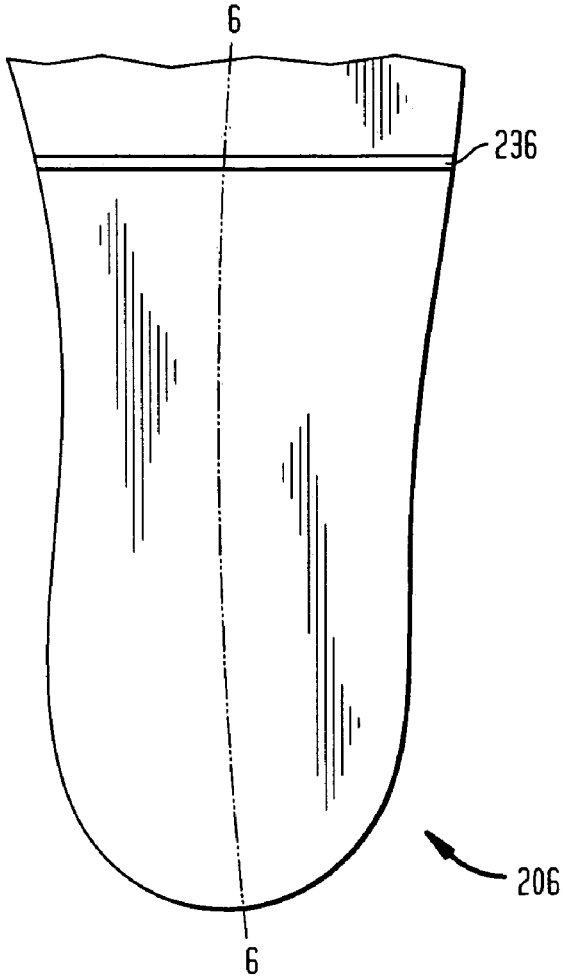

FIGS. 6(*a*)-(*b*) illustrate side and bottom views of the stiffening member 206 in detail. The top of the stiffening member 206 (not shown) is a mirror image of the bottom view of FIG. 6(*b*), with the exception that there is no lip 236 on the top. The stiffening member 206 desirably has the general shape of the footbed, although the width of the stiffening member 206 may be slightly larger (or smaller) than the forefoot bottom 210. FIG. 6(*a*) shows a cutaway view of the stiffening member 206 along the 6-6 line of FIG. 6(*b*).

As discussed above, the stiffening member 206 preferably comprises TPU or a similar material(s). Other materials may include PU or EVA foams having a hardness of at least 20 on the Asker C scale. The material should be selected depending upon the amount of rigidity desired. Furthermore, the stiffening member 206 distributes pressure along the cartridge system 200 during wear. The stiffening member 206 can be contoured to match the general shape of the foot. Another benefit of the stiffening member 206 is that the portion in contact with the tab 212 helps to reduce the amount of flexing by the tab 212 and to prevent the tab 212 from pulling out of the footbed 202.

Figure 7:
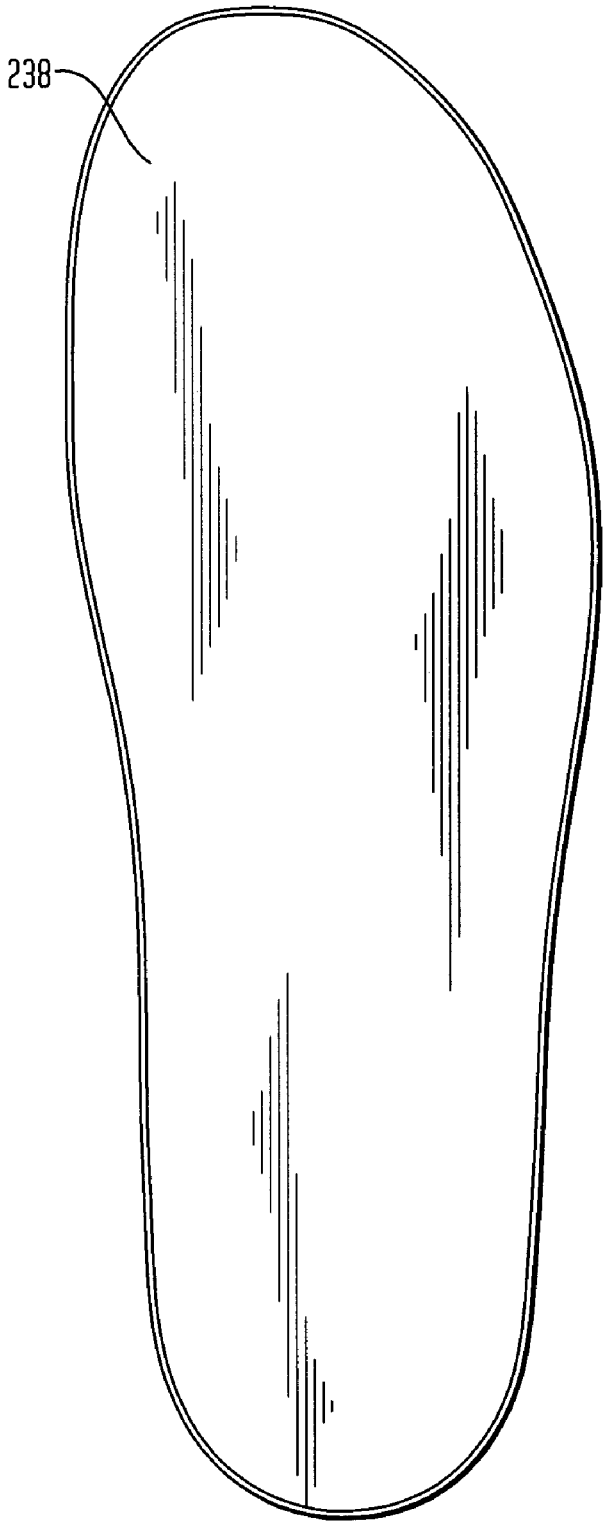
FIG. 7 illustrates a top view of a footbed in accordance with aspects of the present invention.

The top surface of the footbed 202 may include a liner, covering or top layer 238, which is shown in FIG. 7. The liner 238 will be the point of contact between the wearer's foot (or sock) and the footbed 202. The liner 238 preferably substantially or totally covers the surface of the EVA material of the footbed 202. The liner 238 may be, for example, a knit fabric such as brushed nylon or brushed polyester, or a leather.

Figure 8A:
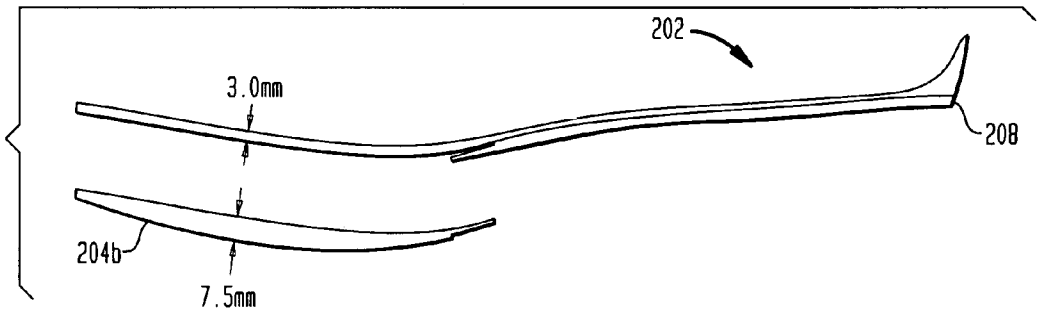
FIGS. 8(*a*)-(*c*) illustrate cross-sectional views of cartridge assemblies in accordance with aspects of the present invention.
Figure 8B:
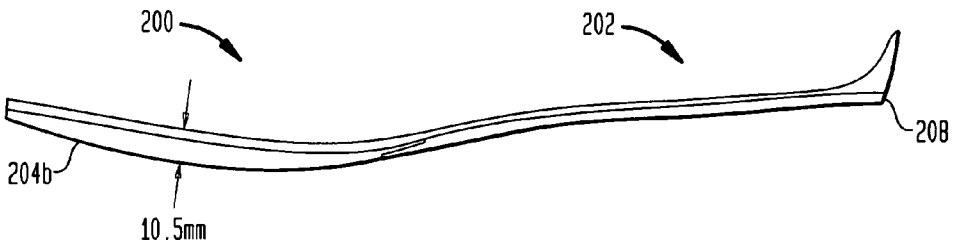
Figure 8C:
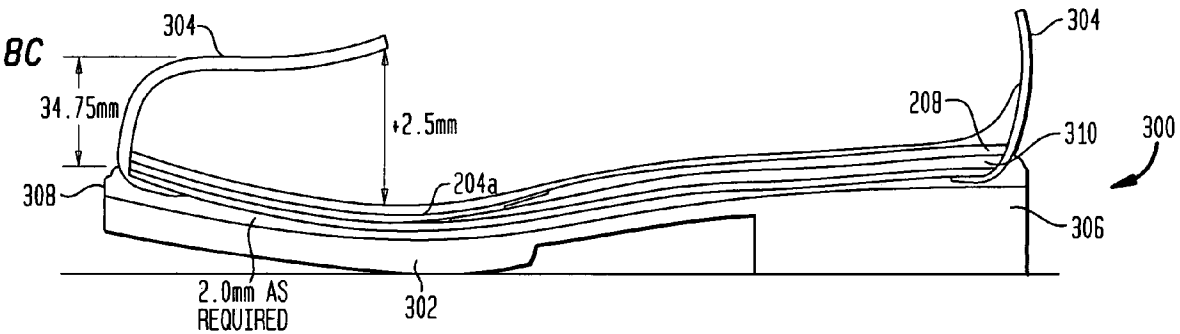

FIGS. 8(*a*)-(*c*) illustrate cutaway views of the cartridge system 200 in relation to a shoe 300. As seen in FIGS. 8(*a*)-(*b*), cartridge 204 (e.g., the cartridge 204(*b*) ) is selected and inserted desirably into the underside of the footbed 202. In this example, the stiffening member 206 is not embedded within the footbed 202, and there is no post on the forefoot portion of the footbed 202. FIG. 8(*c*) shows the cartridge 204 (here, the cartridge 204(*a*)) and the footbed 202 inserted into the shoe 300. As seen in the figure, the large cartridge 204(*a*) provides an additional 2.5 mm of vertical space within the shoe 300 than the medium cartridge 204(*b*).

The shoe 300 may be any type of conventional footwear type, including, but not limited to dress shoes, loafers, athletic shoes such as sneakers, work boots, moccasins, etc. Here, the exemplary shoe is shown having an outsole 302 and an upper 304. A heel 306 may be separate from or part of the outsole 302. A region 308 connects the outsole 302 to the upper 304.

The region 308 may be integral with the outsole 302, a separate midsole, a lasting board, etc. A piece 310, such as a shank piece, arch support, etc., may be fixed within the shoe 300 or may be removable. It should be understood that the heel bottom 208 and/or the cartridge 204 might be shaped to fit the interior of any type of footwear. For example, the cartridge system 200 may be adapted for use in specially made shoes, or are suitable for use as replacement midsoles or insoles in conventional shoes.

Figure 9A:
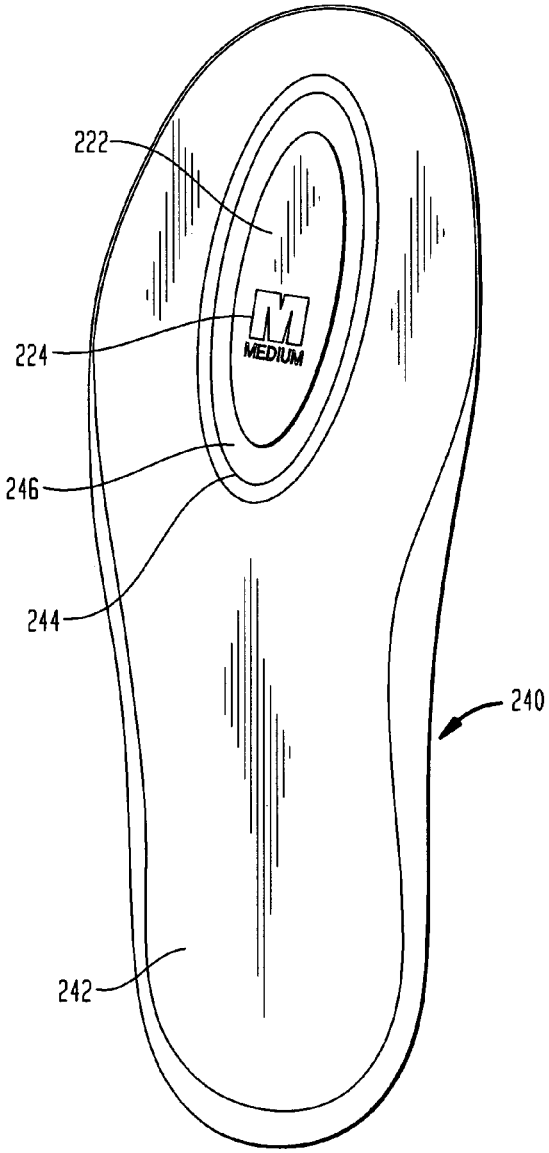
FIGS. 9(*a*)-(*c*) illustrate a slipcover in accordance with aspects of the present invention.
Figure 9B:
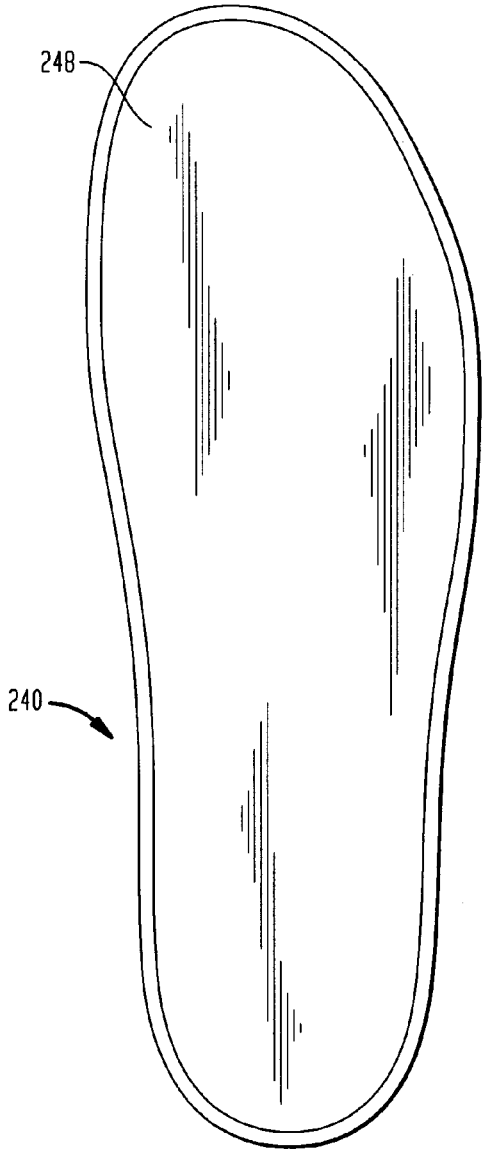
Figure 9C:
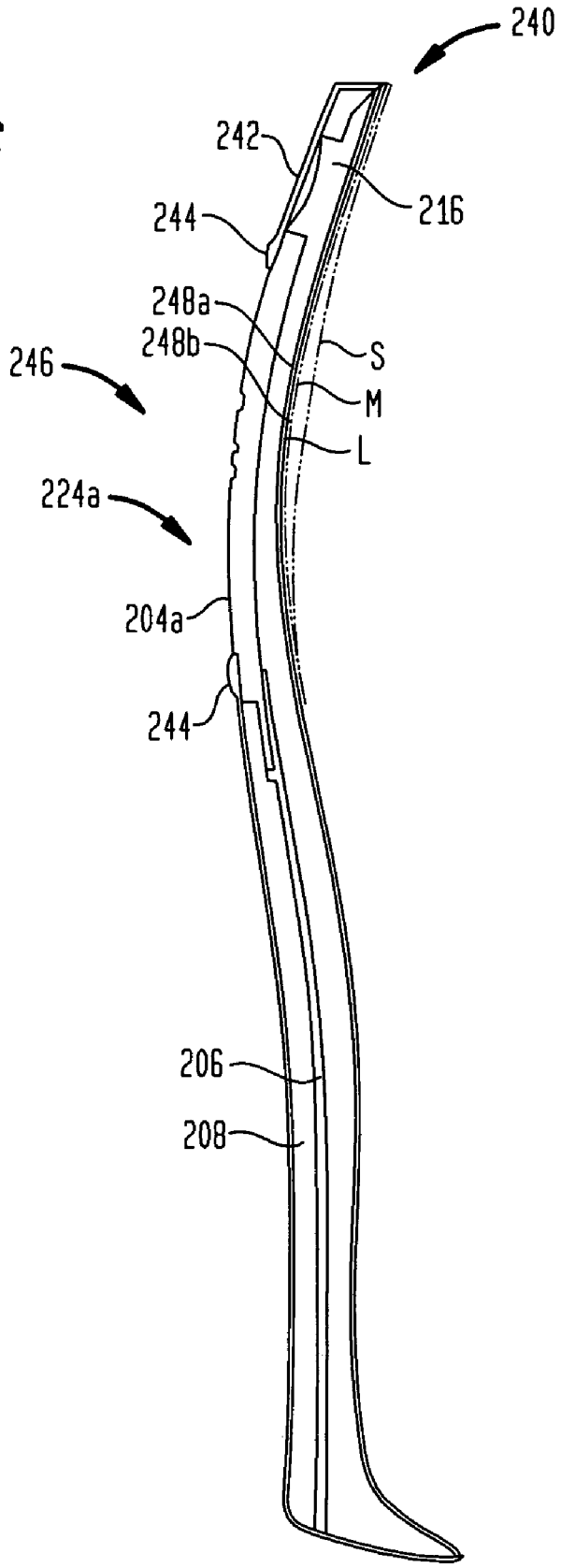

FIGS. 9(*a*)-(*b*) illustrate a slipcover or other retention body 240 that can be used in combination with the cartridge system 200 or by itself. FIG. 9(*a*) shows the bottom 242 of the slipcover 240. The bottom 242 may be made from one or more pieces of material, which may be sewn or otherwise connected to one another. At least a portion of the bottom 242 is preferably a stretchable or elastically resilient material such as spandex textile filament fiber or elastane, for example the LYCRA brand manufactured by E.I. DuPont De Nemours and Company. The bottom may include a rim 244 around an opening 246 into the interior of the slipcover 240.

The bottom 242 is attached to a cover or top liner 248 as shown in FIG. 9(*b*) and in the cutaway view of FIG. 9(*c*). Alternatively, the bottom 242 and the cover 248 may be fabricated from a single material. Preferably, the cover 248 comprises leather, a brushed polyester, a brushed nylon (typically referred to as NYLEX) or some other suitable material. More preferably, the cover 248 includes an EVA backing 248(*a*) bonded to an outer cover 248(*b*). The EVA backing 248(*a*) is preferably on the order of 1 mm thick. Desirably, the top surface of the cover 248 (or the outer cover 248(*b*)) comprises a non-slip or non-skid surface. The cover 248 can be sewn or otherwise attached to the bottom 242. The cover 248 preferably has anti-microbial and/or anti-odor qualities, which may be achieved using embedded chemicals (e.g., silver nitrate has anti-microbial properties), selected materials (e.g., charcoal impregnated materials reduce odors), etc.

The slipcover 240 may be used as follows. After an appropriate cartridge 204 is selected and attached to the footbed 202, the cartridge system 200 is inserted through the opening 246 of the slipcover 240. The opening 246 may be elastic. As seen in FIG. 9(*c*), the cartridge system 200 is preferably positioned so that the region 222 having the indication means 224 is at least partly visible through the opening 246. This way, a wearer can readily determine the size of the cartridge 204 without having to remove the cartridge system 200 from the slipcover 240. Furthermore, the rim 244 can be formed to match the height of the region 222 (e.g., 0.5 mm). This helps to minimize any mismatch of height between the region 222 and the slipcover 240 that a wearer might feel.

Slipcovers 240 are preferably provided in whole sizes, for example 9, 10, 11, etc for U.S. men's shoe sizing. Right foot and left foot slipcovers 240 should be provided, as the cartridge system 200 can be tailored to the variations between the right and left feet. It should be understood that the slipcover 240 may be used not only with the cartridge system 200, but also with all other cartridge systems described herein, as well as with conventional midsoles, insoles and even custom orthotics. The stretchable or elastically resilient material enables the wearer to insert the midsole, insole or custom orthotic, into the slipcover 240. The cover 248 provides a suitable surface for contacting a wearer's foot or sock. The anti-microbial and/or anti-odor means are very beneficial. Furthermore, because the slipcover 240 is readily removable from the shoe, it may be washed and/or dried out quickly and easily. The slipcover 240 may also be used to store one or more cartridges, orthotics, etc. The slipcover 240 may be sold or otherwise provided with a number of different cartridges, for example as a kit.

In the cartridge system 200 described above, the replaceable/interchangeable cartridges 204 are inserted along the underside of the footbed 202 and connect using fastening means such as the tabs 212 and/or the post 216. However, there are other types of cartridges and ways of connecting the cartridges to the footbed. The following embodiments illustrate several types of alternative cartridge systems for use in place of the cartridge system 200.

Figure 10A:
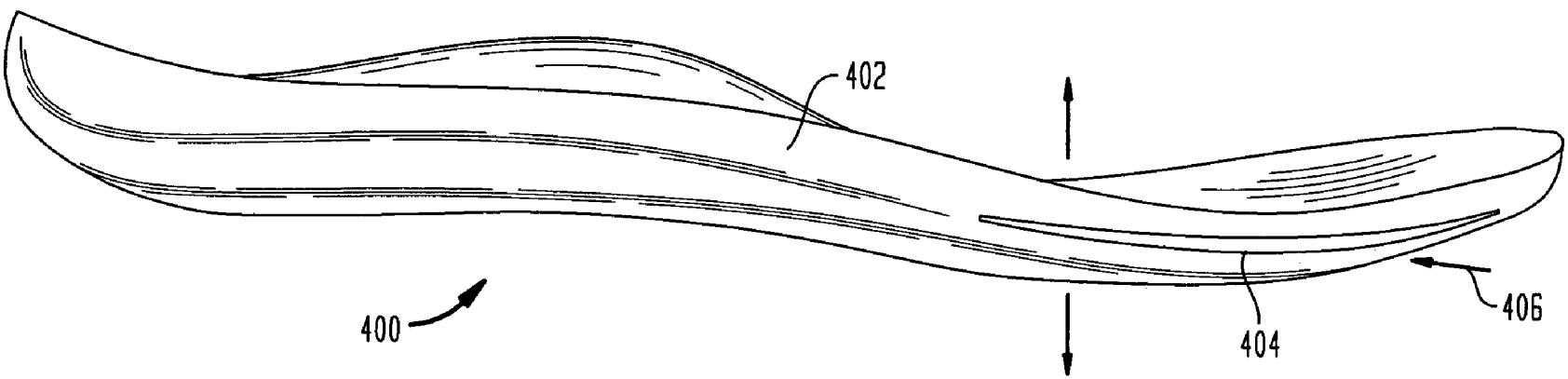
FIGS. 10(*a*)-(*b*) illustrate another interchangeable cartridge system in accordance with aspects of the present invention.
Figure 10B:
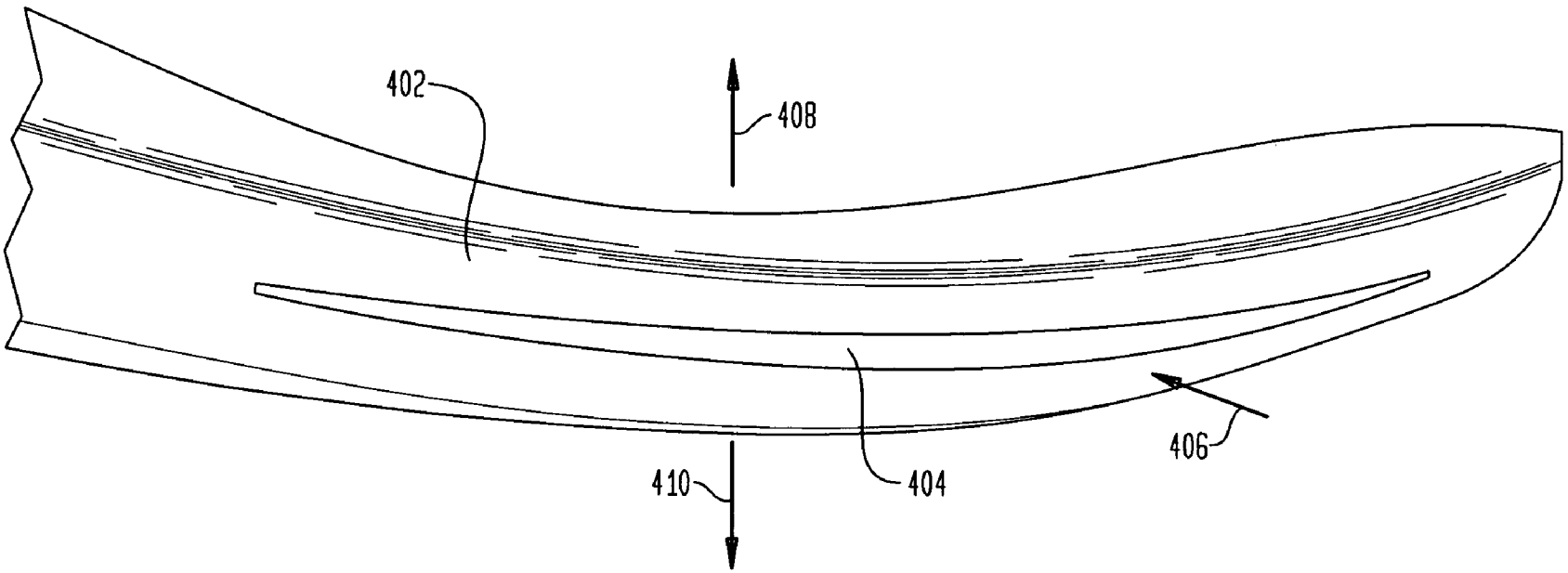

FIGS. 10(*a*)-(*b*) illustrate an interchangeable cartridge or resizing system 400 in accordance with an embodiment of the present invention. As seen in the full perspective view of FIG. 10(*a*), the cartridge system 400 includes a footbed or other shaped member 402 and a cartridge or resizing insert 404. The cartridge 404 is insertable into the forefoot region of the footbed 402 along the side as shown by arrow 406. The cartridge 404 is secured in place due to it being sandwiched between upper and lower portions of the footbed 402.

As with the cartridge system 200 described above, the footbed 402 and/or the cartridge 404 may be formed from resilient materials such as EVA foam or other such materials commonly used in shoe midsoles, insoles or sockliners. One or both of the footbed 402 and the cartridge 404 may be formed of multiple material layers, which may each have a different thickness and/or a different rigidity. Alternatively, different cartridges 404 of the same size may have different densities or hardness. In this case, a wearer may swap out one cartridge for another based on the density/hardness. This may be done, for instance, depending upon the type of activity to be undertaken, the type of terrain or other environmental conditions.

As the cartridge 404 is inserted into a recess or slot within the footbed 402, the cartridge 404 causes an increase in the overall thickness of the cartridge system 400. FIG. 10(*b*) illustrates a close-up view of the cartridge system 400, which shows how upper and lower forefoot portions of the footbed 402 are forced upward and downward, as shown by arrows 408 and 410, respectively.

Figure 11A:
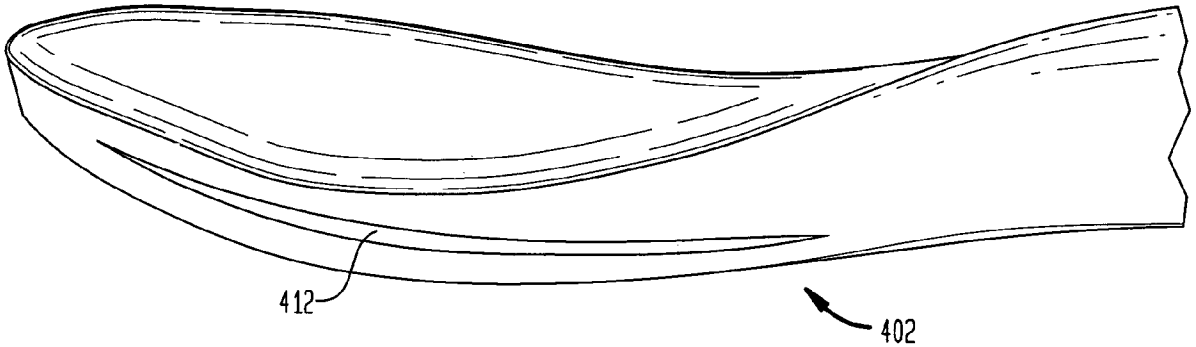
FIGS. 11(*a*)-(*c*) illustrate components of the cartridge system of FIGS. 10(*a*)-(*b*).
Figure 11B:
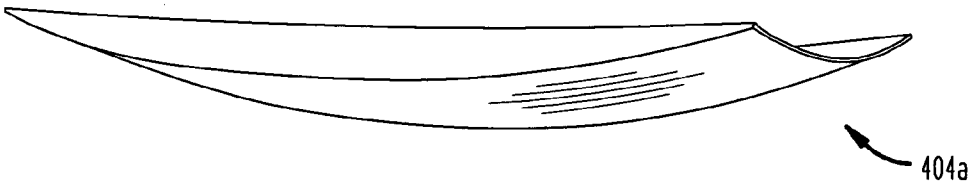
Figure 11C:
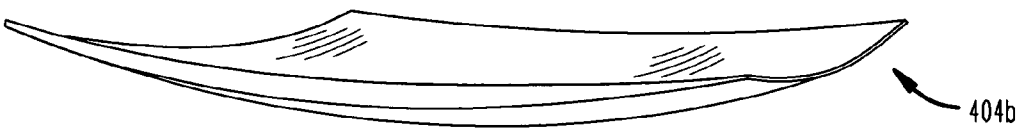

FIG. 11(*a*) illustrates the footbed 402 having a side opening or slot 412 adapted to receive the cartridge 404. Regardless of the particular shape, it should be easy for a wearer to insert and readily remove the cartridge 404 from the footbed 402. The footbed 402 may also include a stiffening member (not shown) similar to the stiffening member 206 described above.

FIGS. 11(*b*)-(*c*) illustrate thick and thin cartridges 404(*a*) and 404(*b*), respectively. The cartridges 404(*a*)-(*b*) can be of any number of shapes or configurations, with the principal feature being that the cartridge 404 effects an increase or decrease in the thickness of the cartridge system 400 and, therefore, the available volume in the shoe or other article of footwear. While only two cartridges 404(*a*)-(*b*) are shown, it should be understood that any number of different sized cartridges may be employed with the invention. Preferably, at least one of the upper and lower surfaces of the cartridge 404 is partly convex. In an alternative, the upper surface of the cartridge 404 is slightly concave and the lower surface is slightly convex. The cartridge 404 may include a region having an indication means (not shown) similar to the indication means 224 on the region 222 of the cartridge 204 described above. For example, the different sized cartridges 404 may also include different colors, shadings, textures, lettering, numbers, etc. to indicate to a wearer what size cartridge is being used. In other examples, the cartridge 404 may comprise multiple separate cartridge members put together for insertion into the footbed 402.

Figure 12A:
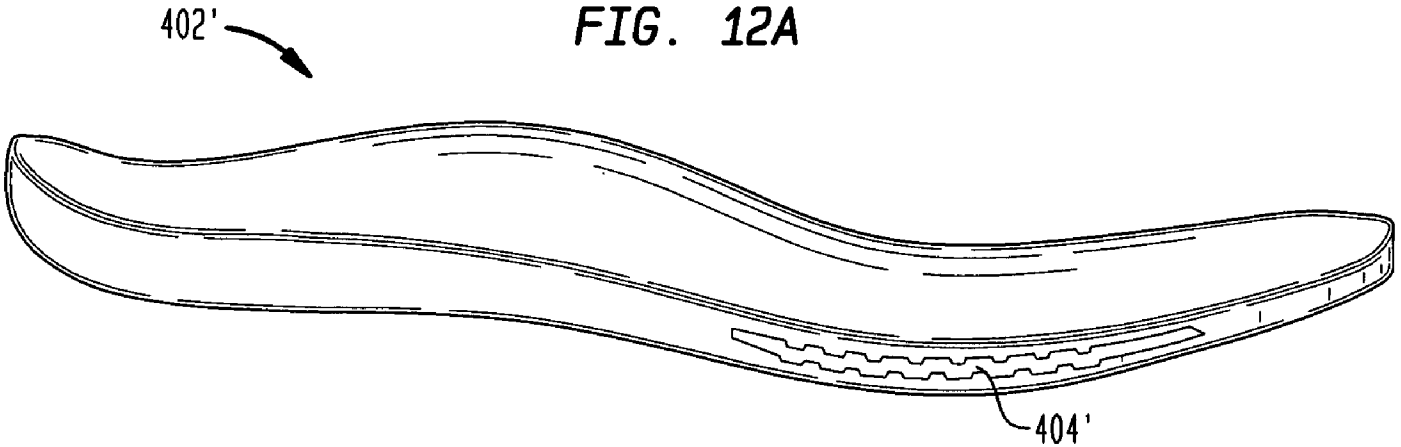
FIGS. 12(*a*)-(*b*) illustrate yet another interchangeable cartridge system in accordance with aspects of the present invention.
Figure 12B:
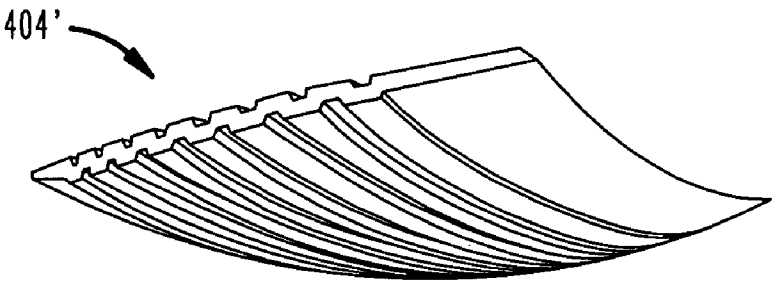
Figure 13A:
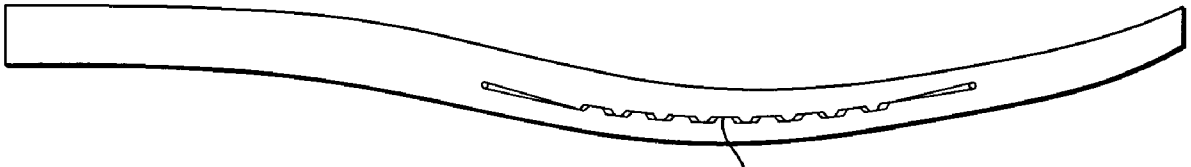
FIGS. 13(*a*)-(*c*) illustrate cross-sectional views of the cartridge system of FIGS. 12(*a*)-(*b*a).
Figure 13B:
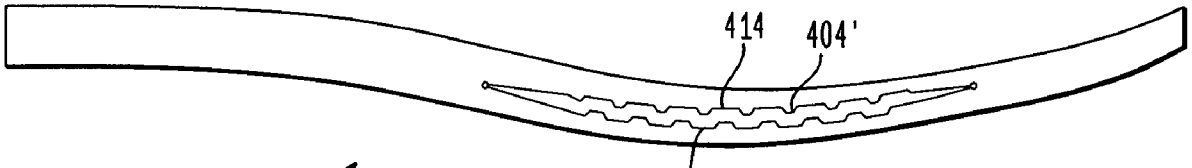
Figure 13C:
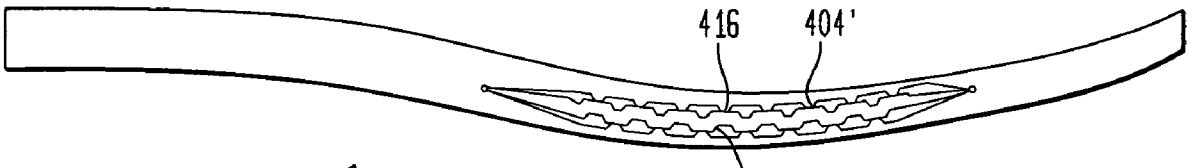

FIGS. 12(*a*)-(*b*) illustrate perspective views of one possible variant of the cartridge system 400. Here, the footbed 402' may include a serrated, "W", or waffle-shaped opening or slot 412' (see FIG. 13(*a*)) into which the cartridge 404' is inserted. As seen in the cross-sectional view of FIG. 13(*a*), if the cartridge 404' is not inserted, the opening or slot 412' closes up to a minimum thickness. As seen in FIG. 13(*b*), inserting the cartridge 404' with a first side 414 facing up causes the footbed 402' to expand vertically by a first amount. As seen in FIG. 13(*c*), inserting the cartridge 404' with a second side 416 facing up causes the footbed. 402' to expand vertically by a second amount. The embodiments shown in FIGS. 10-13, as with all embodiments of the cartridge systems shown herein, may be utilized along with the slipcover 240 described above.

Figure 14A:
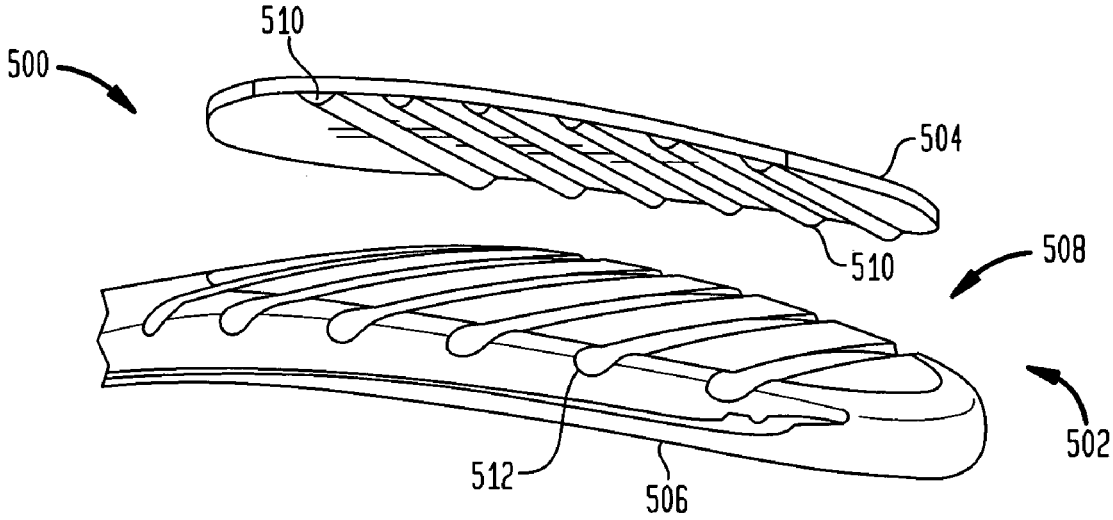
FIGS. 14(*a*)-(*b*) illustrate a further interchangeable cartridge system in accordance with aspects of the present invention.
Figure 14B:
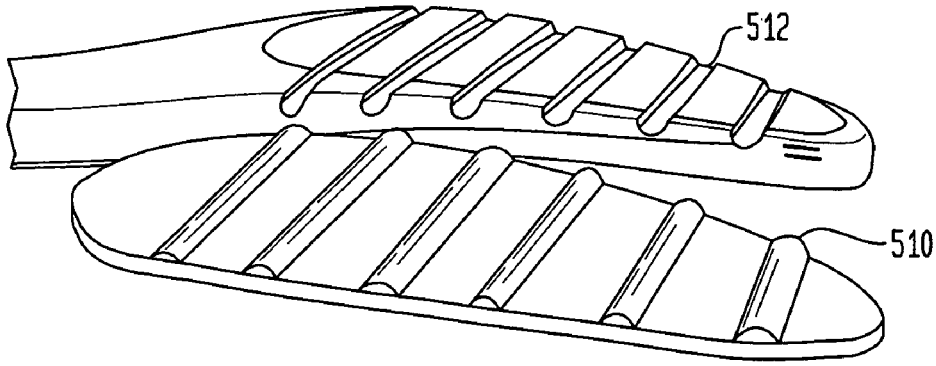

FIGS. 14(*a*)-(*b*) illustrate an interchangeable cartridge system 500 in accordance with yet another embodiment of the present invention. As seen in the exploded view of FIG. 14(*a*), the cartridge system 500 includes a footbed 502 and a cartridge or bottom attachment 504. It should be understood that the footbed 502 is shown inverted in the figure, and that the upper surface 506 of the footbed 502 is shown at the bottom and the lower surface 508 is shown at the top.

The cartridge or bottom attachment 504 preferably includes one or more rounded lines or beveled protrusions 510, which desirably run across the width of the cartridge 504. The cartridge 504 is insertable onto the forefoot region of the footbed 502, and the lines 510 preferably mate with respective receiving areas or grooves 512 in the lower surface 508 of the footbed 502. The cartridge 504 is secured in place due to the connection between the lines 510 and the grooves 512.

As with the cartridge system 200 described above, the footbed 502 and/or the cartridge 504 may be formed from resilient materials such as EVA foam or other such materials commonly used in shoe midsoles, insoles or sockliners. One or both of the footbed 502 and the cartridge 504 may be formed of multiple material layers, which may each have a different thickness and/or a different rigidity. The footbed 502 may also include a stiffening member (not shown) similar to the stiffening member 206 described above.

Figure 15A:
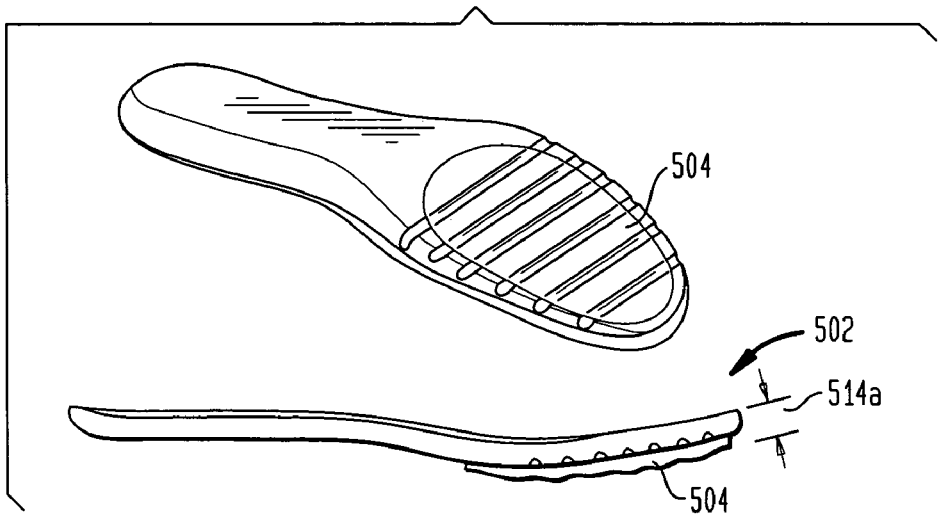
FIGS. 15(*a*)-(*c*) illustrate assembled views of the cartridge system of FIGS. 14(*a*)-(*b*).
Figure 15B:
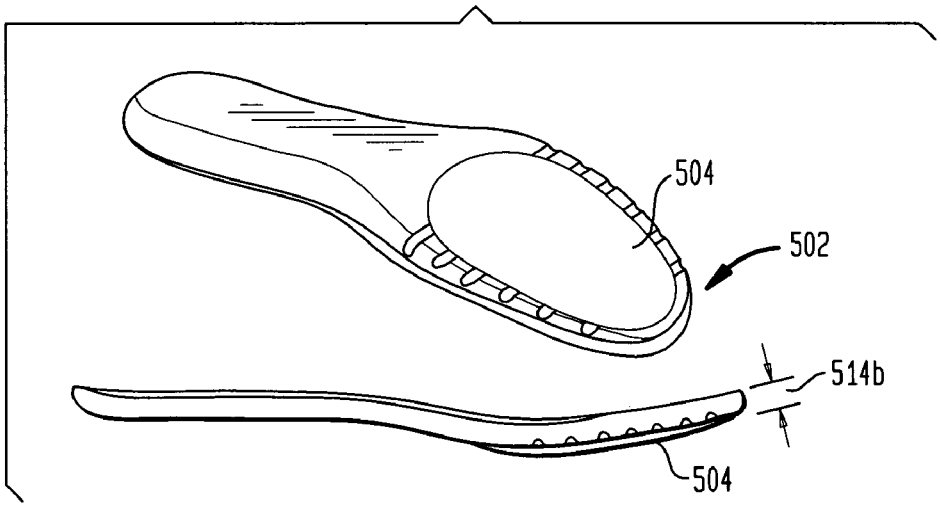
Figure 15C:
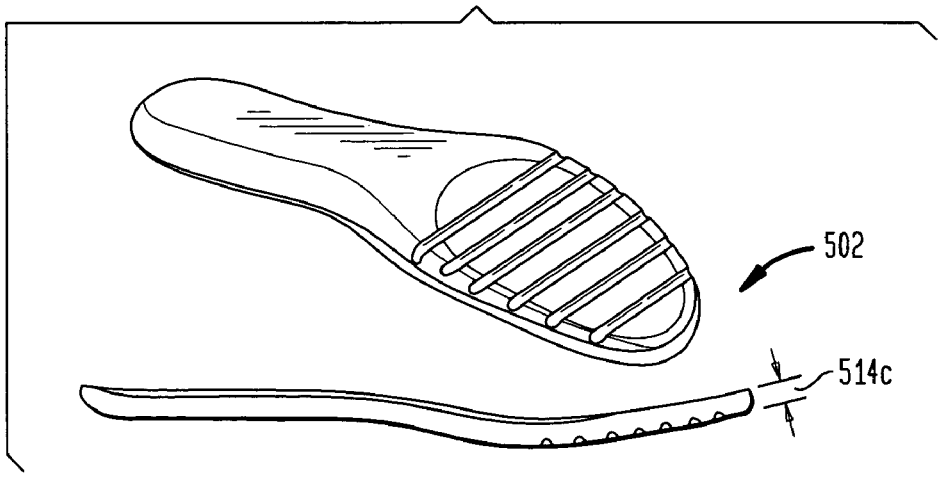

Different size cartridges 504 may be employed as in the embodiments described above. Alternatively, the cartridge 504 can be flipped over and installed in an "unmeshed" position, as seen in FIG. 14(*b*). As seen in FIG. 15(*a*), an unmeshed cartridge 504 connected to the footbed 502 creates an overall size 514(*a*), which reduces the volume available for the foot within the shoe. This is akin to the small volume created by the footbed 204(*c*) shown in FIG. 5(*c*). As seen in the configuration of FIG. 15(*b*), the "meshed" cartridge 504 connected to the footbed 502 creates an overall size 514(*b*), which reduces the volume available for the foot, but not to the extent of 514(*a*). This is akin to the medium volume crated by the footbed 402(*b*) shown in FIG. 5(*b*). As seen in FIG. 15(*c*), the cartridge 504 may be omitted so that the footbed 502 creates an overall size 514(*c*), which provides the largest volume available for the foot within the shoe. This is akin to the large volume created by the footbed 204(*a*), shown in FIG. 5(*a*).

Figure 16A:
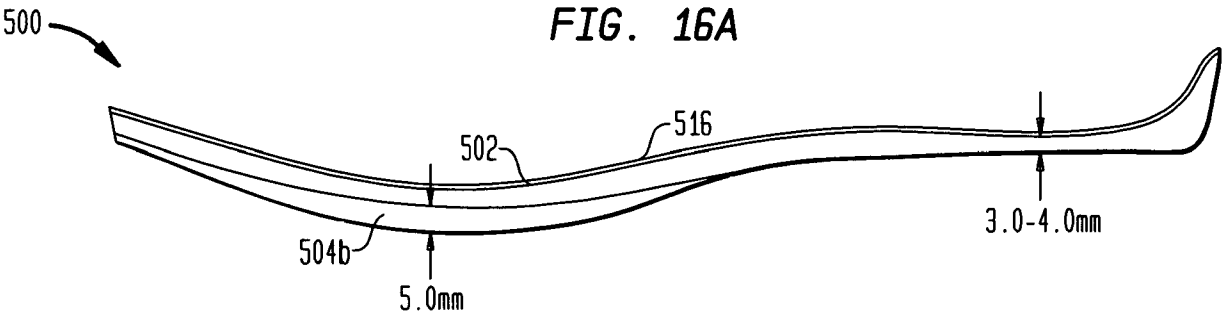
FIGS. 16(*a*)-(*c*) illustrate cross-sectional views of another cartridge system in accordance with aspects of the present invention.
Figure 16B:
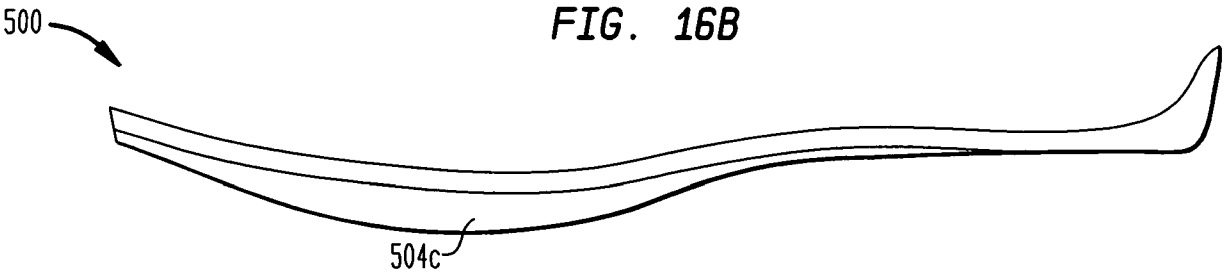
Figure 16C:
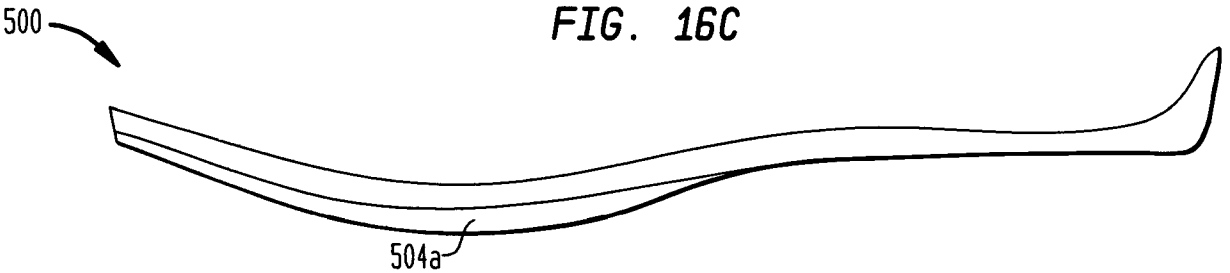

FIGS. 16(*a*)-(*c*) illustrate various size cartridges or volume attachments 504 that may be used to create different volumes in accordance with the cartridge system 500. The high volume cartridge 504(*a*), the medium volume cartridge 504(*b*) and the low volume cartridge 504(*c*) are merely examples of different cartridge sizes that may be used. As seen in FIG. 16(*a*), the top surface of the footbed 502 may also include a liner 516. As with the liner 238 discussed above, unless the slipcover 240 is used, the liner 516 will be the point of contact between the wearer's foot (or sock) and the footbed 502. The liner 516 preferably substantially or totally covers the surface of the footbed 502. The liner 238 may be, for example, a knit fabric.

Figure 17A:
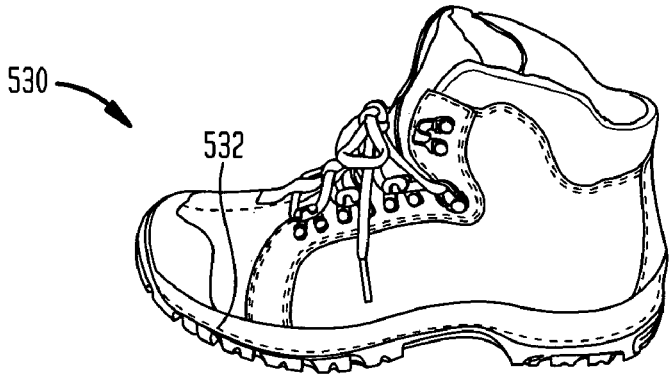
FIGS. 17(*a*)-(*c*) illustrate shoe lasting configurations for use with cartridge systems of the present invention.
Figure 17B:
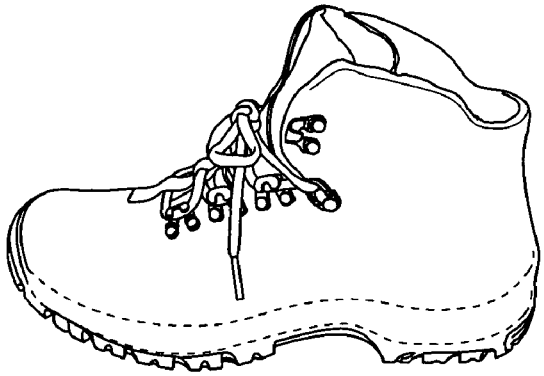
Figure 17C:
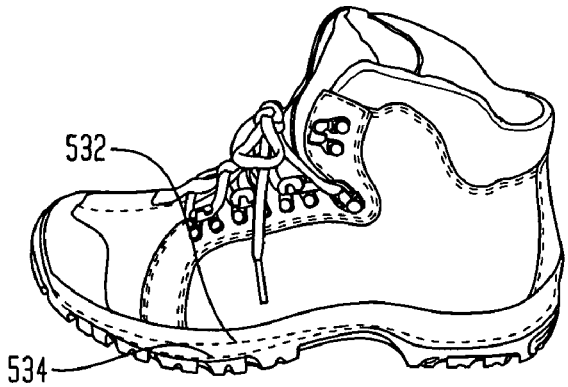

FIGS. 17(*a*)-(*c*) illustrate a shoe 530 into which the cartridge system 500 may be inserted. Conventionally, the shoe 530 may have a standard last, as seen by dashed line 532 that is substantially straight along the length of the outsole. However, in order to provide enhanced fit and comfort, it may be desirable to modify the last, as seen by dashed line 534, in order to provide additional volume in the forefoot of the shoe 530. The additional volume in the last produces a larger than normal cavity within the shoe 530, thus allowing the cartridge system 500 to provide greater fit adjustments.

Figures 18A, 18B, 18C, 19A, 19B, 19C, 20A, 20B, 20C:
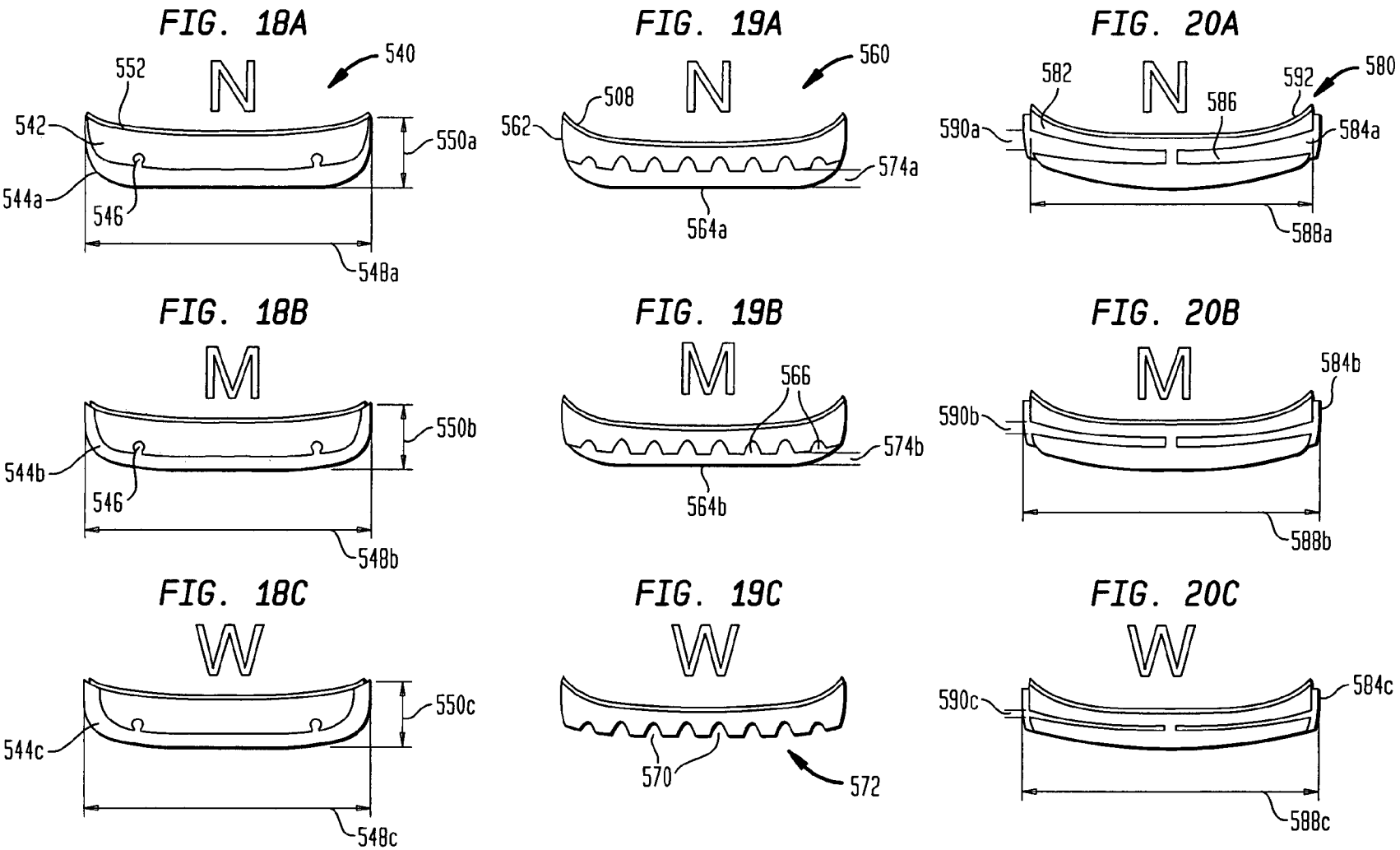
FIGS. 18(*a*)-(*c*) illustrate cross-sectional views of another interchangeable cartridge system in accordance with aspects of the present invention.
FIGS. 19(*a*)-(*c*) illustrate cross-sectional views of a further interchangeable cartridge system in accordance with aspects of the present invention.
FIGS. 20(*a*)-(*c*) illustrate cross-sectional views of yet another interchangeable cartridge system in accordance with aspects of the present invention.

FIGS. 18-20 illustrate alternative cartridge system constructions. Specifically, FIGS. 18(*a*)-(*c*) illustrate cross sections of a cartridge system 540 along the metatarsal region thereof. The cartridge system 540 includes a footbed 542 and one or more cartridges or resizing attachments 544(*a*)-(*c*). The cartridges 544 preferably include at least one tab, horn, or nodule 546 that releasably connects to a receptacle on the underside of the footbed 542. Each of the cartridges 544(*a*)-(*c*) may provide extra depth and/or width to the cartridge system 540. For example, the narrow ("N") cartridge 544(*a*) provides a width 548(*a*) and a depth 550(*a*), the medium ("M") cartridge 544(*b*) provides a width 548(*b*) and a depth 550(*b*), and the wide ("W") cartridge 544(*c*) provides a width 548(*c*) and a depth 550(*c*). Different widths 548 and depths 550 may be selected depending upon the needs of the wearer and/or the manufacturing constraints of the footwear manufacturer. The footbed 542 may also include a liner 552 and/or a stiffening member (not shown).

FIGS. 19(*a*)-(*c*) illustrate cross sections of a bottom mounting cartridge system 560 along the metatarsal region thereof. The cartridge system 560 includes a footbed 562 and one or more cartridges or resizing members 564(*a*)-(*b*). The cartridges 564(*a*)-(*b*) preferably include one or more protrusions or posts 566, which are similar to the rounded lines 510 described above. Here, the protrusions 566 desirably run at least part of the length of the cartridge 564. The cartridge 564 is insertable onto the forefoot region of the footbed 562, and the protrusions 566 preferably mate with respective grooves 570 in the lower surface 572 of the footbed 562. The cartridge 564 is secured in place due to the connection between the protrusions 566 and the grooves 570. The protrusions 566 may be of varying height and/or shape. The footbed 562 preferably may include a liner 568 and/or a stiffening member (not shown). The cartridges 564(*a*)-(*b*) provide depths 574(*a*)-(*b*), respectively. For example, the narrow ("N") cartridge 564(*a*) provides the depth 574(*a*) and the medium ("M") cartridge 564(*b*) provides a depth 574(*b*). When the cartridge 564 is omitted, a wide ("W") alternative is achieved as seen in FIG. 19(*c*). Different depths 574 may be selected depending upon the needs of the wearer and/or the manufacturing constraints of the footwear manufacturer.

FIGS. 20(*a*)-(*c*) illustrate cross sections of a side mounted cartridge system 580 along the metatarsal region thereof. The cartridge system 580 includes a footbed 582 and one or more cartridges 584(*a*)-(*c*). The cartridges 584(*a*)-(*c*) preferably include one or more elongated tabs, protrusions, plugs or other connecting members 586, which are similar to the tabs 212 described above. Here, the elongated tabs 586 may comprise a substantial portion of the cartridge 584, and desirably run at least part of the length of the cartridge 584. Preferably, a pair of cartridges 584 is insertable into either side of the forefoot region of the footbed 582. The elongated tabs 586 preferably are received within respective grooves or slots in the sides of the footbed 582.

Each of the cartridges 584(*a*)-(*c*) may be used to provide extra depth and/or width to the cartridge system 580. For example, the narrow ("N") cartridge 584(*a*) provides a width 588(*a*) and a depth 590(*a*), the medium ("M") cartridge 584(*b*) provides a width 588(*b*) and a depth 590(*b*), and the wide ("W") cartridge 584(*c*) provides a width 588(*c*) and a depth 590(*c*). Different widths 588 and depths 590 may be selected depending upon the needs of the wearer and/or the manufacturing constraints of the footwear manufacturer. The footbed 542 may include a liner 592 and/or a stiffening member (not shown).

Figures 21A, 21B, 21C, 21D:
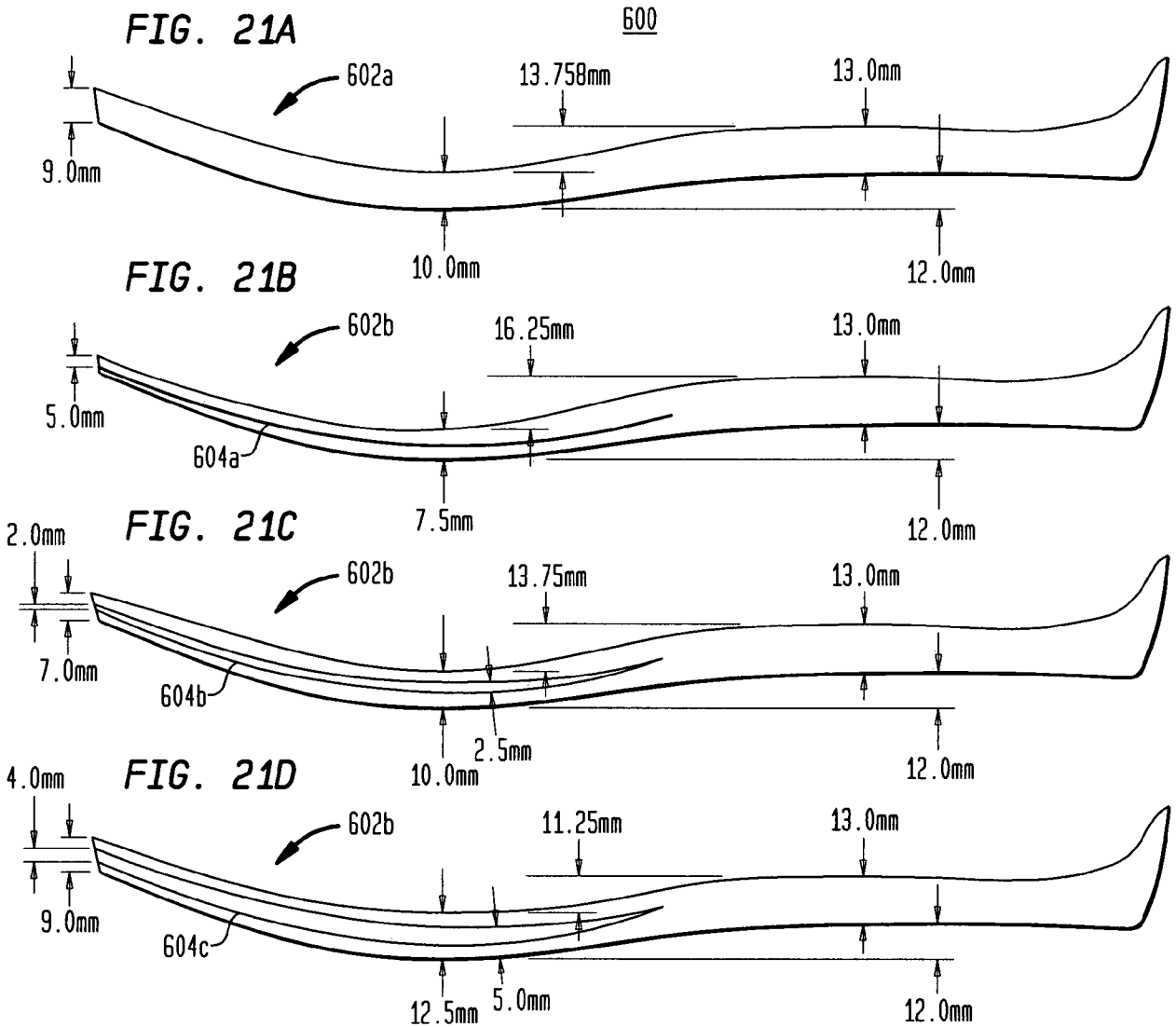
FIGS. 21(*a*)-(*d*) illustrate cross-sectional views of another interchangeable cartridge system in accordance with aspects of the present invention.
Figure 22A:
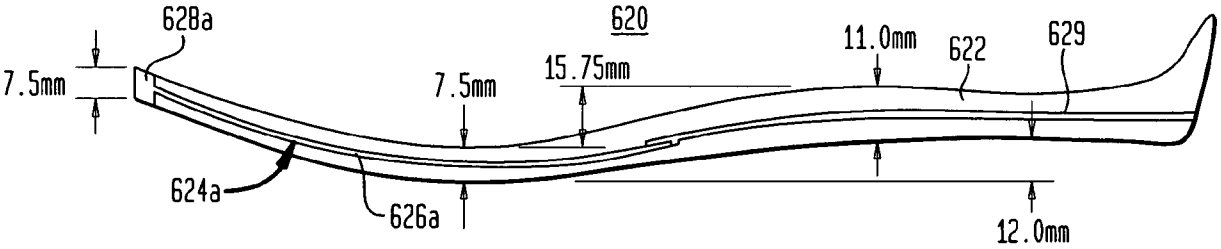
FIGS. 22(*a*)-(*c*) illustrate cross-sectional views of yet another interchangeable cartridge system in accordance with aspects of the present invention.
Figure 22B:
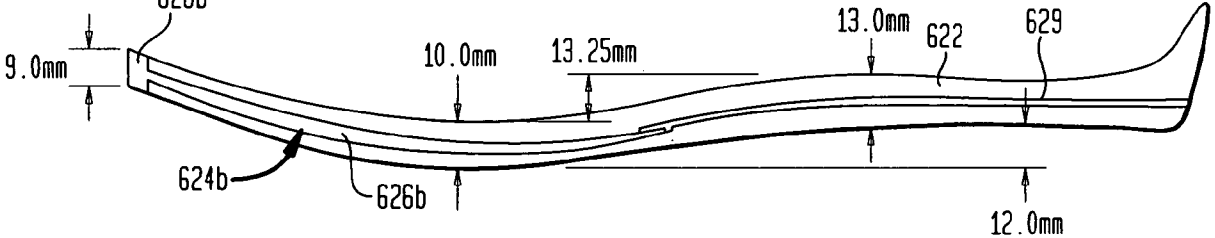
Figure 22C:
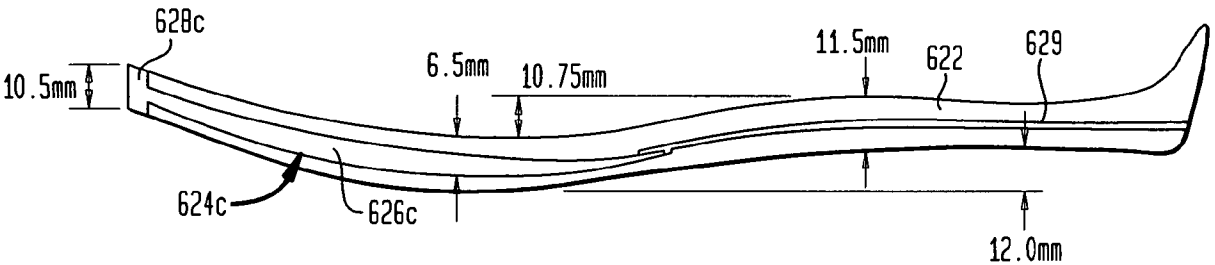
Figure 23A:
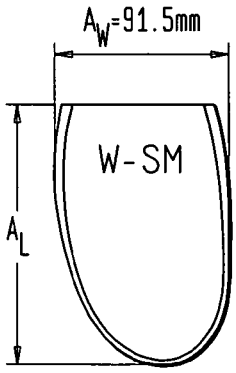
FIGS. 23(*a*)-(*i*) illustrate width and/or length adjustment using interchangeable cartridges.
Figure 23B:
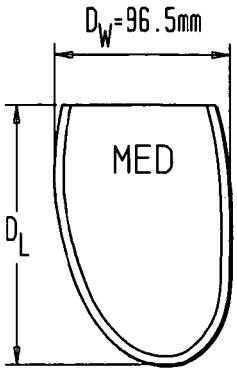
Figure 23C:
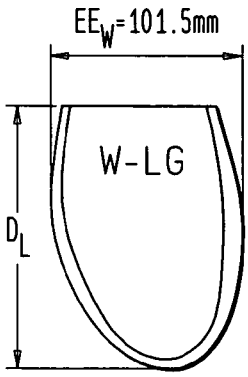
Figure 23D:
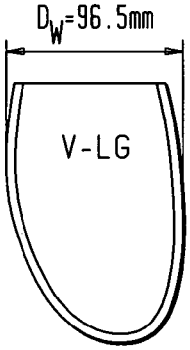
Figure 23E:
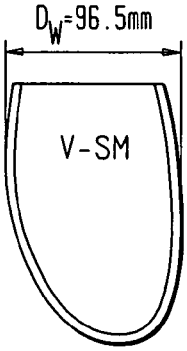
Figure 23F:
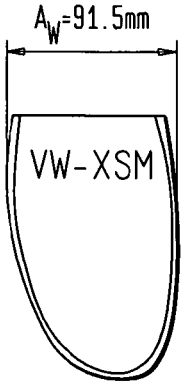
Figure 23G:
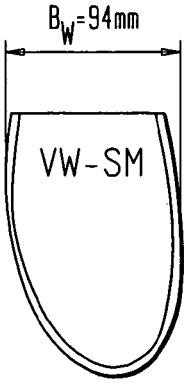
Figure 23H:
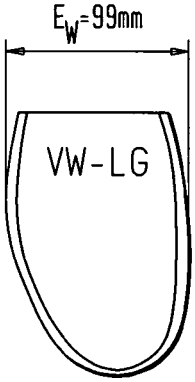
Figure 23I:
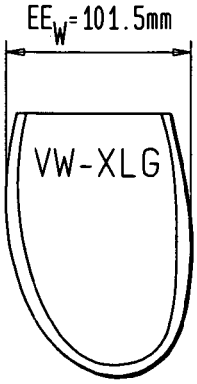

FIGS. 21-22 illustrate additional cartridge system constructions suitable for use in accordance with the present invention. FIGS. 21(*a*)-(*d*) illustrate cross sections of a cartridge system 600. The cartridge system 600 may include one or more footbeds 602(*a*)-(*b*) and one or more cartridges 604(*a*)-(*c*). As seen in FIG. 21(*a*), the footbed 602(*a*) may be used without a cartridge. As shown, the footbed 602(*a*) provides approximately 13.75 mm of depth in the metatarsal region relative to the heel region. However, it should be understood that the footbed 602(*a*) can be of any thickness in the metatarsal region or elsewhere.

As with any of the cartridge systems described above, the footbeds 602(*a*)-(*b*) and/or the cartridges 604(*a*)-(*c*) may be formed from resilient materials such as EVA foam or other such materials commonly used in shoe midsoles, insoles or sockliners. One or both of the footbed and the cartridge may be formed of multiple material layers, regions or segments which may each have a different thickness and/or a different rigidity.

The cartridges 604(*a*)-(*c*) are somewhat similar to the cartridges 404 and 404' discussed above with regard to FIGS. 10-13. Here, however, the cartridges 604(*a*)-(*c*) are inserted into a recess or slot within the front of the footbed 602(*b*) as opposed to a recess or slot along the side of the footbed 402. The cartridge 604 causes an increase in the overall thickness of the cartridge system 600. Regardless of the particular shape, it should be easy for a wearer to readily insert and remove the cartridge 604 from the front footbed 602(*b*). The footbed 602(*b*) (or the footbed 602(*a*)) may also include a stiffening member (not shown) similar to the stiffening member 206 described above.

FIGS. 21(*b*)-(*d*) illustrate cartridges 604(*a*)-(*c*) of varying thickness. The cartridge 604(*a*) is the thinnest, for example about 2 mm thick, and is sized for maximum depth in the forefoot region of the shoe. The cartridge 604(*b*) is sized for medium depth in the forefoot region of the shoe, for example on the order of 4 mm thick. The cartridge 604(*c*) is the thickest, for example approximately 6 mm thick, and is sized for minimum depth in the forefoot region of the shoe. Of course, the thickness for each cartridge is merely exemplary, and any other cartridge thickness may be employed with any gradation between 2 mm and 6 mm, greater than 6 mm or less than 2 mm.

The cartridges 604(*a*)-(*c*) can be of any number of shapes or configurations, with the principal feature being that the cartridge 604 effects an increase or decrease in the volume of the cartridge system 600. While only three cartridges 604(*a*)-(*c*) are shown, it should be understood that any number of different sized cartridges may be employed with the invention. In the medium and thick cartridges 604(*b*)-(*c*), preferably one or both of the upper and lower surfaces of the cartridge 604 may be convex. In an alternative, the upper surface of the cartridge 604(*b*) or 604(*c*) may be slightly concave and the lower surface may be slightly convex. The cartridges 604(*a*)-(*c*) may include a region having an indication means (not shown) similar to the indication means 224 on the region 222 of the cartridge 204 described above. For example, the different sized cartridges 604(*a*)-(*c*) may also include different colors, shadings, textures, lettering, numbers, etc. to indicate to a wearer what size cartridge is being used.

FIGS. 22(*a*)-(*c*) illustrate cross sections of a cartridge or refitting system 620 that is a variant of the cartridge systems 580 and 600. As shown, the cartridge system 620 may include a footbed 622 and one or more cartridges 624(*a*)-(*c*). The cartridges 624(*a*)-(*c*) preferably include one or more elongated tabs 626(*a*)-(*c*) and edges 628(*a*)-(*c*), respectively. Here, the elongated tabs 626(*a*)-(*c*) may comprise substantial portions of the cartridges 624(*a*)-(*c*), and desirably run at least part of the width of the cartridge 624. The cartridge 624 is insertable into the front of the forefoot region of the footbed 622. The elongated tabs 626(*a*)-(*c*) preferably are received within respective grooves or slots in the front of the footbed 622. Each of the cartridges 624(*a*)-(*c*) may be used to provide extra depth and/or width to the cartridge system 620.

The thin cartridge 624(*a*) provides a depth 626(*a*) and a width (see, e.g., FIG. 23(*a*)), the medium cartridge 624(*b*) provides a depth 626(*b*) and a width (see, e.g., FIG. 23(*b*)), and the wide cartridge 624(*c*) provides a depth 626(*c*) and a width (see, e.g., FIG. 23(*c*) ). Different depths 626 and widths may be selected depending upon the needs of the wearer and/or the manufacturing constraints of the footwear manufacturer. The footbed 622 may include a liner (not shown) and/or a stiffening member 629.

The edges 628(*a*)-(*c*) may protrude away from the footbed 622 by different amounts to increase the width and/or length of the cartridge system 620. For example, while the medium cartridge 624(*b*) provides a depth 626(*b*), the edge 628(*b*) may be selected to provide different widths and lengths. FIG. 23(*a*) illustrates medium cartridge "W-SM" having a small width "$A_W$" (e.g., 91.5 mm) and a small length "$A_L$". FIG. 23(*b*) illustrates medium cartridge "MED" having a medium width "$D_W$" (e.g., 96.5 mm) and a medium length "$D_L$". FIG. 23(*c*) illustrates medium cartridge "W-LG" having a large width "$EE_W$" (e.g., 101.5 mm) and the medium length "$D_L$".

FIGS. 23(*d*)-(*e*) illustrate, for example, two cartridges having the same width, for example 96.5 mm. However, the cartridge in FIG. 23(*d*) may have a depth of 7.5 mm and the cartridge in FIG. 23(*e*) may have a depth of 12.5 mm.

FIGS. 23(*f*)-(*i*) illustrate four cartridges having different widths and depths. By way of example only, the extra small cartridge "VW-XSM" of FIG. 23(*f*) may have a width $A_W$ of 91.5 mm and a depth of 12.5 mm. The small cartridge "VW-SM" of FIG. 23(*g*) may have a width $B_W$ of 94 mm and a depth of 11.75 mm. The large cartridge "VW-LG" of FIG. 23(*h*) may have a width $E_W$ of 99 mm and a depth of 8.75 mm. The extra large cartridge "VW-XLG" of FIG. 23(*i*) may have a width $EE_W$ of 101.5 mm and a depth of 7.5 mm.

Figure 24A:
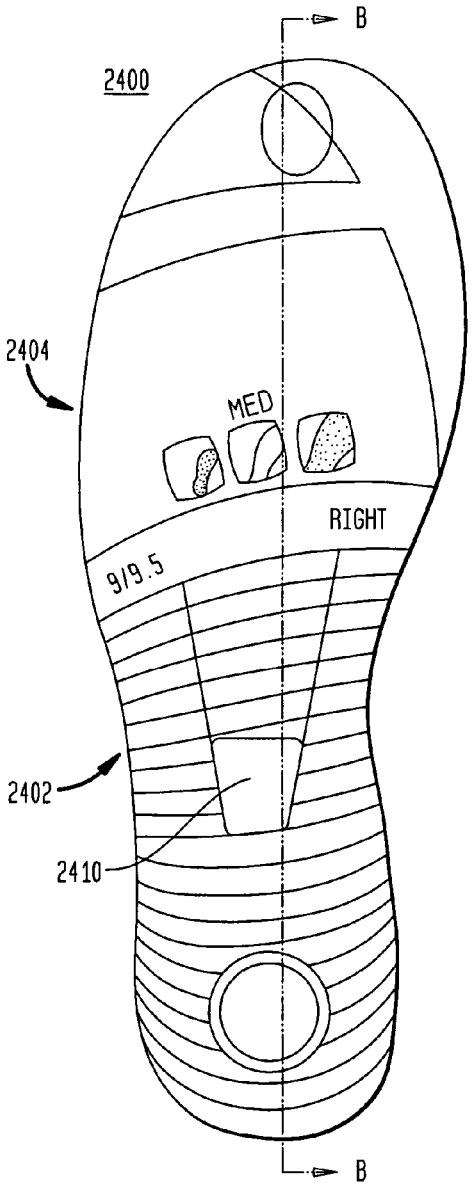
FIGS. 24(*a*)-(*h*) illustrate another footbed and cartridge system in accordance with the present invention.
Figure 24B:
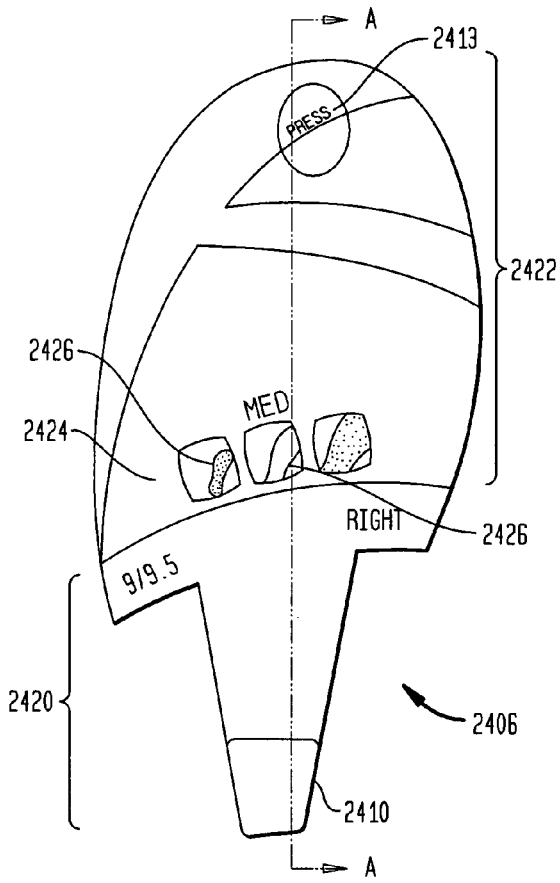
Figures 25A, 25B, 25C, 25D:
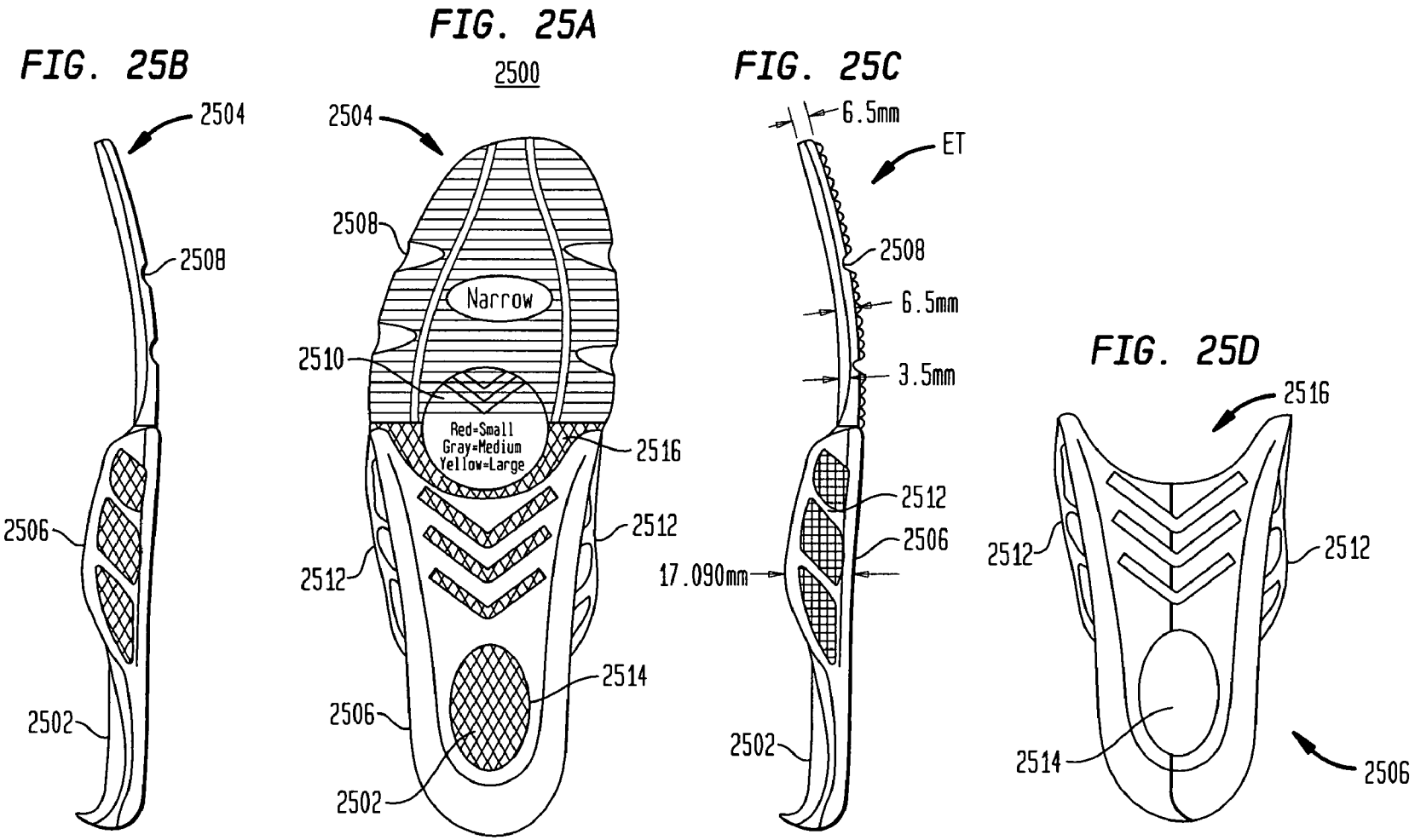
FIGS. 25(*a*)-(*g*) illustrate alternative footbed and cartridge systems in accordance with the present invention.
Figure 25G:
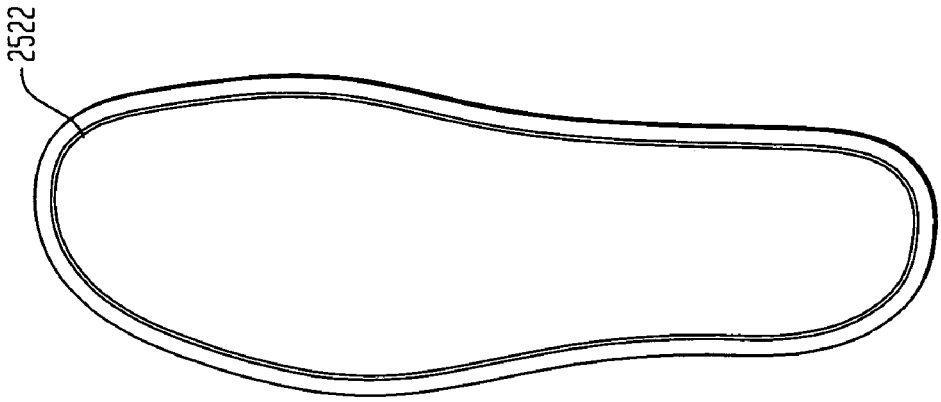
Figure 25F:
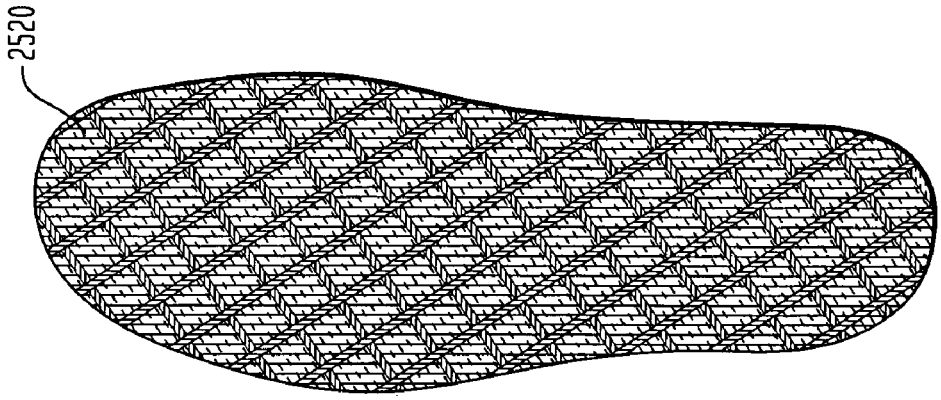
Figure 25E:
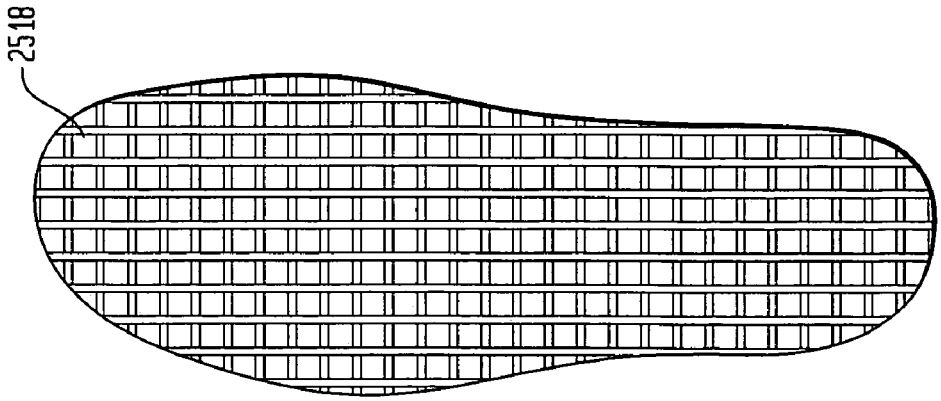
Figure 26A:
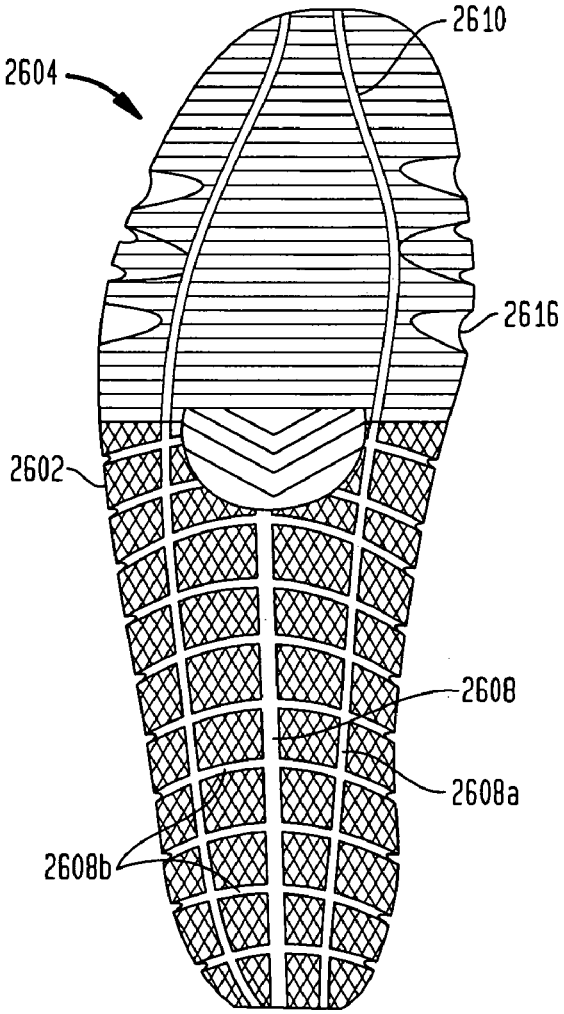
FIGS. 26(*a*)-(*g*) illustrate a further footbed and cartridge system in accordance with aspects of the present invention.
Figure 26B:
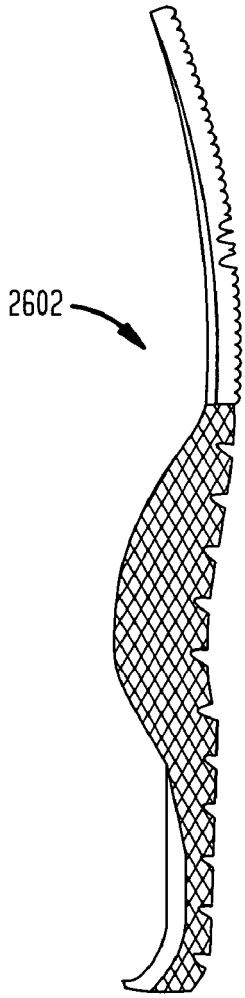
Figure 26C:
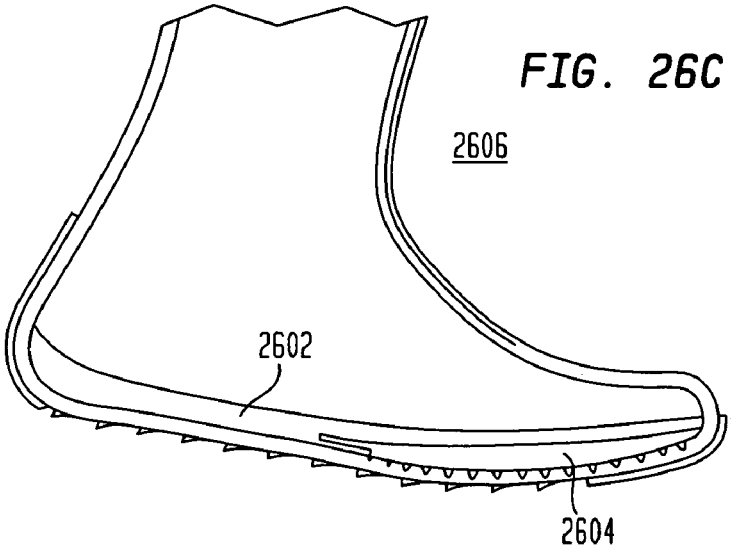
Figure 26D:
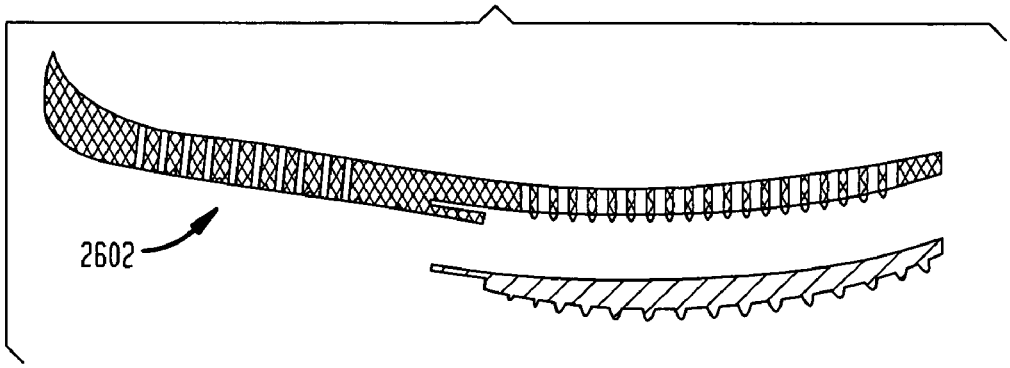
Figure 26E:
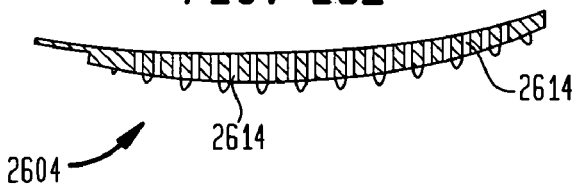
Figure 26F:
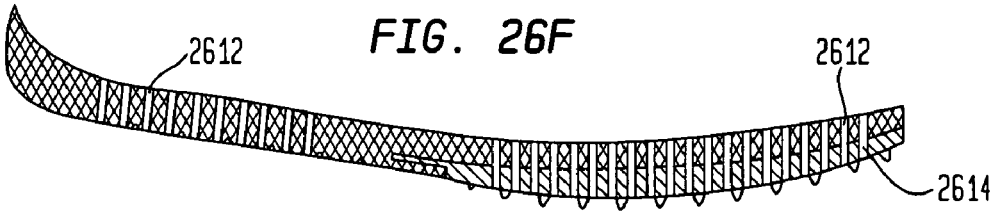
Figure 26G:
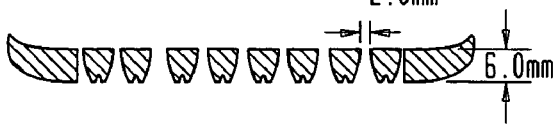

FIGS. 24(*a*)-(*h*) illustrate a further embodiment of the present invention. FIG. 24(*a*) presents a bottom view of cartridge system 2400, which is similar to the cartridge system 200 discussed above. The cartridge system 2400 includes a footbed, insock, or other shaped area 2402 for supporting portions of the foot, as well as a cartridge or resizing member 2404. The footbed 2402 need not extend the entire length of the foot from the toes to the heel. For instance, the footbed 2402 may only be positioned at the toe/phalanges region of the shoe, the metatarsal region of the shoe, both the phalanges and metatarsal regions, or extend from the toes through the high point of the longitudinal arch region of the foot. Alternatively, the footbed 2402 may only be positioned in the heel region of the shoe, for instance positioned from the high point of the longitudinal arch of the foot rearward to the back of the heel.

FIG. 24(*b*) illustrates the bottom view of the cartridge 2404 without the footbed 2402. As explained above with regard to the system 200, the cartridge 2404 is insertable into the footbed 202 and is secured in place by a releasable fastening mechanism. The cartridge 2404 may cover the entire forefoot area, although it may also only cover a portion of the forefoot area. By way of example only, the cartridge 2404 may cover the area from the metatarsals forward, the metatarsals only, the phalanges only, portions of the cuneiform bones, etc. As shown in FIG. 24(*b*) and the sectional view of FIG. 24(*c*) taken along the A-A line of FIG. 24(*b*), the cartridge 2404 desirably includes a connection member 2406 to engage a receptacle or channel 2408 (see FIG. 24(*e*)) on the footbed 2402. The end of the connection member 2406 desirably has a lip or overhang 2410 to assist in a secure and releasable connection to the receptacle 2408. The cartridge 2404 may also include additional fastening means, such as a post or other protruding member 2412, akin to the post 216 discussed above. As seen in the enlarged view of FIG. 24(*d*), the post 2412 may have beveled, chamfered or angled edges. As seen in FIG. 24(*b*), the bottom of the cartridge 2404 may include a design, texture or other identifier 2413 to identify where the post 2412 is located.

FIG. 24(*e*) illustrates a cutaway view of the footbed 2402 along the B-B line of FIG. 24(*a*). The receptacle or channel 2408 is visible in the cutaway view. The receptacle/channel 2408 is desirably on the order of 0.5 mm in height, such as between about 0.25 and 1.0 mm. Preferably the receptacle 2408 includes an opening 2414 at the end thereof. The opening 2414 should be positioned to align with the overhang or lip 2410 of the cartridge 2404. The lip 2410 provides a positive lock with the opening 2414. In operation, the connection member 2406 of the cartridge 2404 is inserted into the channel 2408. Once the lip 2410 moves into alignment with the opening 2414, the lip 2410 will move downward causing the lip 2410 to form a positive lock with the opening 2414. To remove the cartridge 2404, the user can depress the lip 2410 while pulling the cartridge 2404 away in order to disengage the positive lock. The footbed 2402 may also include additional fastening means, such as a receptacle, recess, or other opening 2416, akin to the receptacle 218 discussed above. As seen in the enlarged view of FIG. 24(*f*), the receptacle 2416 may have beveled, chamfered or angled edges complementary to the edges of the post 2412.

In order to assemble the cartridge system 2400, the user may line up the connection member 2406 with the receptacle 2408 and then insert the connection member 2406 fully into the receptacle 2408. The user may push on the identifier 2413 to ensure that the post 2412 engages the receptacle 2416. FIG. 24(*g*) illustrates a cutaway view of the cartridge system 2400 showing the cartridge 2404 inserted into the footbed 2402. As seen here, the overhang 2410 is received by the opening 2414. The user will know that the cartridge 2404 is fully inserted into the footbed 2402 because the overhang 2410 will be visible, as seen in FIG. 24(*b*). When sliding the cartridge 2404 out of the footbed 2402, the user can press on the overhang 2410 to help disengagement.

It should be understood that depending upon the thickness of the cartridge 2404 and the height provided for receiving the cartridge 2404 in the forefoot section of the footbed 2402, there may be a thickness differential between the bottom surface of the cartridge 2404 and the bottom surface of the heel section of the footbed 2402. In accordance with the present invention, the footbed 2402 is preferably configured to have between 1 and 5 mm of space in the forefoot region to receive the cartridge 2404 (e.g., the heel section of the footbed 2402 extends down approximately 1-5 mm relative to the forefoot section for a bottom-fitting cartridge 2404). In this case, surfaces of the cartridge 2404 and/or the footbed 2402 may be tapered or blended to provide a substantially continuous interface when the two components are interconnected. By way of example only, if the forefoot section of the footbed 2402 allocates 2.5 mm for a cartridge 2404 (e.g., the bottom surface of the heel portion of the footbed 2402 extends approximately 2.5 mm relative to the bottom surface of the forefoot portion of the footbed 2402), and the selected cartridge 2404 is 5 mm, then the rear section of the main portion of the cartridge 2404 adjacent the connection member 2406 may taper in thickness to approximately 2.5 mm to achieve a generally continuous interface with the heel section of the footbed 2402. Conversely, if the forefoot section of the footbed 2402 allocates 5 mm for a cartridge 2404 (e.g., the bottom surface of the heel portion of the footbed 2404 extends approximately 5 mm below the bottom surface of the forefoot portion of the footbed 2402), and the selected cartridge 2404 is 2.5 mm, then the front portion of the heel section of the footbed 2402 which abuts the cartridge 2404 may taper or narrow in thickness to approximately 2.5 mm to achieve a generally continuous interface with the rear section of the cartridge 2404. Of course, other dimensions are possible for the footbed 2402 and cartridge 2404. Furthermore, such tapering or blending may be employed with any of the embodiments of the invention where there may be a thickness differential between a selected cartridge and the footbed, regardless of whether the cartridge is disposed below a forefoot section of the footbed, above a forefoot section of the footbed, or elsewhere along the footbed. In addition, the frontmost portion of the cartridge and/or the footbed may be tapered/blended in any of the embodiments herein. For instance, the toe section of the cartridge 2404 may be contoured or otherwise shaped to have a reduced thickness relative to a metatarsal section of the cartridge 2404.

As shown in the enlarged view of FIG. 24(*h*), the post 2412 interlocks with the receptacle 2416 to ensure that the front of the cartridge 2404 is secured to the front of the footbed 2402. While male fastening mechanisms have been shown on the cartridge 2404 and female fastening mechanisms have been shown on the footbed 2402, it is possible for female fastening mechanisms to be on the cartridge 2404 and male fastening mechanisms to be on the footbed 2402, or various combinations of complementary male and female fastening mechanisms to be on both the footbed 2402 and the cartridge 2404.

In an alternative, the footbed 2402 may include a liner, covering or top layer 2418 akin to the liner 238 discussed above. See FIG. 24(*g*). The liner 2418 may be made of the same materials as the liner 238, and may also have antimicrobial and/or anti-odor qualities as with the cover 248. While not shown, the footbed 2402 may optionally include a stiffening, stabilizing, or reinforcement member such as the stiffening member 206.

As with the cartridge 204, the bottom of the cartridge 2404 may include a region 2424 that is used to identify the type of cartridge 2404, which is akin to the region 222 discussed above. For example, the region 2424 in FIG. 24(*b*) preferably has indicators 2426 representing small, medium and large sizes. As shown in this figure, the medium ("MED") size may have a different color, shading, texture, etc. to indicate that the cartridge 2404 is medium-sized. Alternatively, the indicators 'N', 'M', and 'W', representing narrow, medium and wide, respectively, may be used in place of the small ('SM'), medium ('M') and large ('L') identifiers. Also of importance is the indication of shoe sizing, for instance 9/9.5, and left/right identifiers on the cartridge and/or footbed (not shown). Such indicators allow for easier matching of cartridges to footbeds in the retail and manufacturing sites. Model numbers (not shown) may be placed on the cartridge and/or footbed for easier matching of cartridges and footbeds at manufacturing and retail sites.

As with other alternatives discussed herein, the footbed 2402 and/or the cartridge 2404 may be formed from resilient materials such as EVA or PU foams or other such materials commonly used in shoe midsoles, insoles or sockliners. One or both of the footbed 2402 and the cartridge 2404 may be formed of multiple material layers, regions and/or segments, which may each have a different thickness and/or a different rigidity. For instance, a first zone of the cartridge 2404 may have one hardness and a second zone of the cartridge 2404 may have a different hardness. By way of example in FIGS. 24(*b*) and (*c*), zone 2420 may have a first hardness while zone 2422 may have second hardness. In this case, the zone 2422 would underlie the metatarsal region of the foot, and thus may be selected to be shock absorbing and softer than the zone 2422.

Alternatively, the footbed 2402 or the cartridge 2404 may comprise multiple layers of different rigidity as discussed above with regard to the footbed 202 and the cartridge 204. Alternatively, the footbed 2402 may have different levels of rigidity in the forefoot and heel regions, respectively. The footbed 202 or the cartridge 204 could also have a first segment about the first metatarsal of a first rigidity and a second segment about the fifth metatarsal of a second rigidity.

The footbeds and cartridges of the present invention may be adapted for particular environments, conditions, and/or activities. By way of example only, wet, hot or humid environments and conditions may benefit from footbeds and cartridges that drain water or ventilate heat away from the foot. Users performing activities requiring the article of footwear to support heavy loads will benefit from footbeds and cartridges that are reinforced to handle such loads. Footbeds and cartridges particularly adapted to such situations will now be described.

FIGS. 25(*a*)-(*c*) illustrate an adjustable footbed cartridge system 2500, which includes a footbed 2502 and one or more cartridges 2504 in conjunction with a support saddle 2506. The footbed 2502 may be of the same or a different configuration than the footbeds described elsewhere herein. As shown, the cartridge 2504 preferably includes more flex grooves, indentations, score lines, siping or flex areas 2508, for instance on the bottom thereof. A single fastening device such as tab 2510 preferably extends from the cartridge 2504 and is securely received by the footbed 2502.

The support saddle 2506 is shown by itself in FIG. 25(*d*). Preferably, the support saddle 2506 is flexible while providing enhanced foot support under extreme loading conditions, which may occur, by way of example only, when a soldier carries a heavy pack or is moving heaving equipment on a mission, when a construction worker is lifting heavy beams or operating heavy machinery such as a jackhammer, or when a mover is lifting furniture, pianos, etc. While the support saddle 2506 desirably comprises a cross-linked polymer, alternative materials, such as TPU may be employed. The support saddle 2506 may include sidewall members 2512, which may be positioned on the medial and/or lateral sides of the support saddle 2506. The sidewall members 2512 enhance the transverse support the support saddle 2506 provides to the footbed 2502. A heel cutout 2514 can permit enhanced cushioning or extra padding in the heel region of the footbed 2502. A cutout or contoured region 2516 is preferably provided to enable cartridges 2504 of various sizes and thicknesses to connect to the footbed 2502 without obstruction by the support saddle 2506. Of course, it should be understood that the support saddle 2506 may be used in an article of footwear with or without an adjustable footbed cartridge system, for instance with or without a conventional footbed.

The footbed 2502, cartridge 2504 and/or the support saddle 2506 may also be used in combination with insole boards, lasting boards and/or insulation boards, which may be positioned above or below the footbed 2502, the cartridge 2504, and/or the support saddle 2506 within a shoe, boot or other article of footwear. FIG. 25(*e*)illustrates a top view of an insole board 2518 that is preferably bulletproof and puncture proof. The insole board 2518 may comprise, for example, aramid blend fibers such as KEVLAR. While the insole board 2518 may be used in any number of environments and conditions, it is particularly suited for desert and urban warfare. FIG. 25(*e*) illustrates a top view of insulation board 2520, which preferably includes non-woven fibers. While the insulation board 2520 may be used in any number of environments and conditions, it is particularly suited for mountain regions and cold environments. FIG. 25(*g*) illustrates a top view of a lasting board 2522, which preferably includes a heat reflective coating or layer. While the lasting board 2522 may be used in any number of environments and conditions, it is particularly suited for desert regions and hot environments. Alternatively, the heat reflective coating or layer may be applied on the insole board 2518.

FIGS. 26(*a*) and 26(*b*) depict bottom and side views, respectively, of an adjustable footbed and cartridge system 2600 in accordance with the present invention. As with other adjustable systems discussed above, footbed 2602 may be used alone or in combination with one or more cartridges 2604 that are used to vary the volume within the shoe, boot or other article of footwear. The footbed 2602 may also be used in combination with the support saddle 2506 and other components discussed herein. FIG. 26(*c*) illustrates the footbed 2602 and one cartridge 2604 positioned within a bootie 2606, such as an air mesh bootie, that may be used in combination with an article of footwear such as a boot, sneaker, water shoe, etc.

Returning to FIG. 26(*a*), it can be seen that the footbed 2602 preferably includes one or more channels or pathways 2608 that are adapted to channel water away from the footbed 2602 and out of the inside of the article of footwear. The channels 2608 may include longitudinal channels 2608*a* that run substantially or generally lengthwise along the footbed 2602 and/or transverse channels 2608*b* that run substantially or generally from the medial side to the lateral side of the footbed 2602. Alternatively, the channels 2608 may run in any direction or path along the footbed 2602. The cartridge 2604 may also include one or more channels 2610 therein. Preferably, at least one of the channels 2610 aligns with at least one of the channels 2608. The channels 2608 and 2610 are adapted to break the capillary effect and drive water away from the boot.

As best seen in the side view of FIG. 26(*d*), the footbed 2602 preferably also includes, either alone or in combination with the channels 2608, perforations or vertical pathways 2612 running from the top or foot contacting surface of the footbed 2602 to the bottom thereof. The pathways 2612 promote water drainage away from the top surface of the footbed 2602. The sectional view of FIG. 26(*e*) shows that the cartridge 2604 preferably also includes perforations or vertical pathways 2614 therein. As with the footbed pathways 2612, the cartridge pathways 2614 promote water drainage. Most preferably, the cartridge pathways 2614 align with the footbed pathways 2612 when the cartridge 2604 is connected to the footbed 2602, as seen in the sectional view of FIG. 26(*f*). Furthermore, as best seen in FIG. 26(*a*), the cartridge 2604 may include flex joints 2616 therein.

The footbed 2602 preferably comprises perforated PU having the pathways or drainage holes 2612 therein that allow water or moisture that has accumulated inside the cavity of the article of footwear near the foot to drain through the footbed 2602. The pathways 2612 may be of any shape and size. The pathways 2612 preferably are large enough to allow water to drain yet small enough to not inhibit the cushioning properties of the footbed 2602. The pathways 2612 may also allow air to flow between the outside environment and the cavity of the article of footwear, which provides ventilation and thus added comfort to the wearer's foot.

FIG. 26(*g*) shows a generally transverse cross-section of the footbed 2602, showing the pathways 2612. As shown here, the pathways 2612 may be tapered toward the top of the footbed 2602 to allow easy drainage of water through the footbed 2602 while still providing sufficient support on the top of the footbed 2602 for the wearer.

As described above, the present invention includes many variants that enable a user to effectively create a "custom" footbed by selecting an appropriate cartridge. It should be understood that different combinations of widths, depths and/or lengths may be selected for different cartridges depending upon the needs of the wearer and/or the manufacturing constraints of the footwear manufacturer. This permits the shoe to be manufactured, for instance, using whole sizes and standard dimensions, while allowing the wearer to achieve a comfortable fit with any of the cartridge systems and/or slipcovers of the present invention. While different embodiments described above illustrate specific features, it is within the scope of the present invention to combine or interchange different features among the various embodiments to create other variants.

For instance, the stiffening member 206 of FIGS. 6(*a*)-(*b*) may be used to reinforce any of the cartridge systems as shown in FIGS. 10-16 and 19-21. Bottom-positioned cartridges such as those shown in any of FIGS. 2-5, 14-16, 18-19, and 24-26 could be used in combination with any of the center-placed cartridges shown in FIGS. 10-13. This can enable the wearer to mix and match cartridges of different sizes, styles, and/or placements to obtain the most comfortable fit. Any connection member may be used in any of the embodiments to secure a cartridge to a footbed. The placement of the connecting/parting line between the cartridge and footbed may be located behind the flex area for any of the configurations herein. In addition, a protruding member such as the post 216, and/or an opening such as the recess 218 as best illustrated in FIGS. 2(*b*)-(*c*) can also be employed with any of the embodiments shown in FIGS. 10-23 to more easily permit the wearer to connect or disconnect a resizing member from the footbed or other shaped area. Each cartridge may cover all or part of the forefoot region, such as at least the metatarsals forward to the tips of the toes. Furthermore, while most of the embodiments of the footbed discussed herein include a forefoot region, it is possible to provide alternative footbeds that do not include a forefoot region. In this case, the cartridge would comprise the forefoot portion of the cartridge system and the footbed would comprise the heel portion of the cartridge system. Different cartridge and footbed configurations may be used in different environments and may be adapted to include features or elements suitable for such environments. For instance, the drainage system of FIG. 26 or the insole boards, lasting boards and insulation boards of FIG. 25 may be used with any cartridge and footbed system herein. One or both of the cartridge and the footbed in any embodiment may include a mating surface (e.g., a surface in contact with the other one of the footbed or cartridge) with a high coefficient of friction material or coating to prevent slippage between the footbed and cartridge. The cartridges in any of the embodiments may comprise EVA, PU, gel or other suitable cushioning material.

By way of example only, the present invention may be provided in kit form at a retailer. Multiple cartridges and/or footbeds can be supplied with a given article of footwear, and the wearer may select the appropriate combination of components as desired. Furthermore, different cartridges of the same size may have different densities or hardness. In this case, a wearer may swap out one cartridge for another based on the density/hardness. Optionally, a wearer may swap out one cartridge for another in order to provide rejuvenated cushioning, thereby extending the life of the shoe. Advantageously, the wearer does not have to replace the entire footbed and, therefore, can do so at a greatly reduced cost.

The many cartridge systems of the present invention make it possible to address fit through a customizable fit system. In addition, the interchangeable and removable cartridges permit the footwear manufacturer to address the needs of the population without having to supply all of the sizes required in conventional sizing systems. For example, commonly manufactured men's shoe sizes in the U.S. can range from size 6 up to size 14. Half sizes are standard. Thus, from size 6 up to and including size 14 there are 17 incremental sizes that must be accounted for. This necessitates 17 separate molds for the various shoe sizes.

The cartridges of the present invention allow the same range of foot sizes to be serviced with a predetermined set of sizing units. This is preferably done by eliminating, for example, half sizes. This immediately reduces the number of molds in the above example from 17 to 9, which can substantially reduce the capital investment for manufacturing. Of course, it should be understood that the whole sizes could be eliminated instead of the half sizes. In this case, shoes would be supplied in sizes such as 6½, 7½, 8½, 9½, 10½, 11½, 12½, 13½, etc. It is also possible to supply shoes in sizing units based upon the quarter size, for instance sizes 7¼, 8¼, 9¼ etc., or upon the three-quarter size, for instance 7¾, 8¾, 9¾, etc.

European, English, Japanese and other size scales differ from the scale in the United States. Nonetheless, the cartridges of the present invention permit equivalent reductions in these other size scales. Furthermore, the cartridges permit girth adjustment allowing customization for wider or narrower feet, for instance from A through EEE.

Generally, sizing units in accordance with the present invention may be based upon any incremental sizing within a given size. The sizing units are preferably spaced in increments ("sizing increments") of whole sizes, for example with a first size at 7⅝ and the next larger size at 8⅝. However, the spacing between sizes need not be a whole size—larger or smaller size spacing is possible. For instance, depending upon the structure of the cartridges, the sizing units for U.S. men's footwear could be 5, 6½, 8, 9½, 11, 12½, 14, etc. This example would result in even fewer molds and fewer SKUs for each model than the whole sizing examples. Alternatively, the sizing units could be 5, 5¾, 6½, 7¼, 8, 8¾, 9, etc. While more molds and SKUs would be required than in the whole sizing example, there is still a reduction in the number of molds and SKUs required in conventional footwear.

Because the cartridges of the present invention allow the footwear manufacturer to address the needs of the population with fewer shoe sizes, there can be a significant reduction in manufacturing costs aside from capital investments in the molds themselves. In particular, fewer molds of different sizes require fewer production changes and delays when molds are changed. In addition, the cost and time required to design, template and produce the molds for all shoe sizes in a particular style will be reduced because there are fewer shoe sizes to account for. Furthermore, it is possible to make more molds of the same size, which can help increase production throughput, as there are more molds to manufacture more shoes of one size at the same time. The savings in the development and production of molds may be significant and may save 15-25% or more of the cost that would be incurred without the benefits of the present invention.

Figure 27:
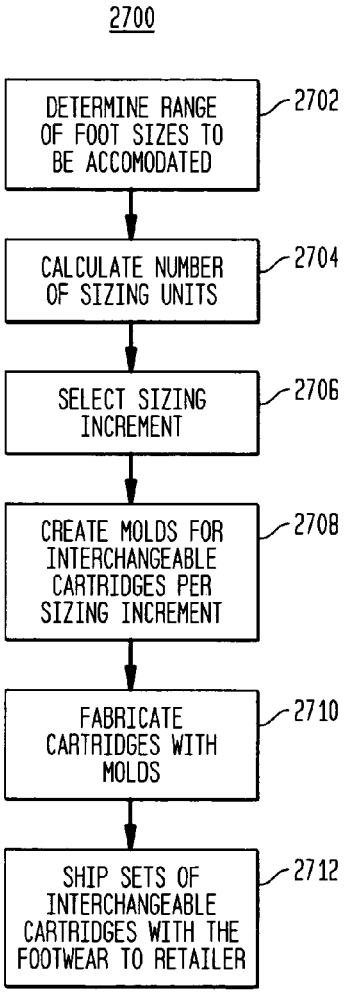
FIG. 27 is a flow diagram illustrating a footwear development process according to aspects of the present invention.

Flow diagram 2700 of FIG. 27 illustrates how a sizing system utilizing footbeds and interchangeable cartridges may be developed. As seen in step 2702, the range of foot sizes is initially determined. This may be done through statistical examination of a target population. By way of example only, when developing a men's hiking boot, substantially all of the population, such as 95%, may fall between sizes 6 and 14. The number of sizing units is calculated in step 2704 and the sizing increment is selected in step 2706. These steps may occur at the same time, or with the sizing increment selected first. Next, molds are created for the interchangeable cartridges, as shown in step 2708. Molds for footbeds and lasts for the articles of footwear may also be fabricated at this time. Then as shown in step 2710 the cartridges are fabricated using the molds. Of course, it should be understood that the footbeds and footwear may be fabricated here as well. Once fabrication is complete, the cartridges, footbeds and articles of footwear are shipped to retailers, wholesalers, warehouses, etc. in step 2712.

The sizing and development process is preferably done by computer. For instance, population information may be stored in a computer database logically or physically connected to a computer, such as a general purpose desktop or laptop computer, workstation, etc. A user may select the sizing increment and sizing units based upon the stored information and a sizing output calculated by the computer. The resultant sizing output may be exported to a program that generates mold templates to fabricate the molds.

The population information is desirably associated with the type of footwear being developed. For instance, hiking shoe wearers or runners may typically purchase footbeds having a specific hardness, or different footbeds having different hardness. Here, a given cartridge thickness in a particular size may be offered in multiple hardness choices. In this way, different hikers or runners could select the same size cartridge with different hardness based upon their individual preference. Alternatively, one wearer could select two cartridges of the same thickness but of different hardness in order to use the cartridges in different conditions or environments.

A manufacturer will be able to reduce shipping and warehousing costs because the manufacturer can make and ship selected sizes in bulk. Because fewer sizes will be manufactured, it becomes possible to adequately stock warehouses with footwear. Fewer sizes allow for greater redundancy of inventory for those sizes manufactured. Thus, there is less likelihood that a particular size will be sold out or unavailable. Fewer sizes also make it less complex and more efficient to manage warehousing and shipping. Furthermore, when purchasing a line of footwear, many businesses may refuse partial shipments. Partial shipments can often arise when producing a larger number of SKUs in a product line. If there are manufacturing delays and only some SKUs are produced, the customer may refuse the partial shipment, resulting in substantial lost sales. Therefore, reducing the number of SKUs improves the likelihood that the full product line will be available for shipment.

Retailers commonly purchase footwear based on a size curve that attempts to approximate the size curve within the target population. The terms "gut" and "fringe" sizes are commonly used to describe sizes within the size curve; gut referring to sizes where it is expected there will be more sales volume and fringe where it is expected there will be less sales volume.

Retail stores will also greatly benefit from the cartridge systems of the present invention. Reducing the number of sizes to stock means that stores can stock more of any given size. This is important as it allows retailers to more efficiently manage inventory, reducing lost sales due to size "stock outs" or depletions. With the present invention, inventory management at the warehouse level is also more efficient, allowing for improved inventory replenishment and reducing the potential for lost sales from the retailer, e.g., due to site stock out situations.

Figure 28:
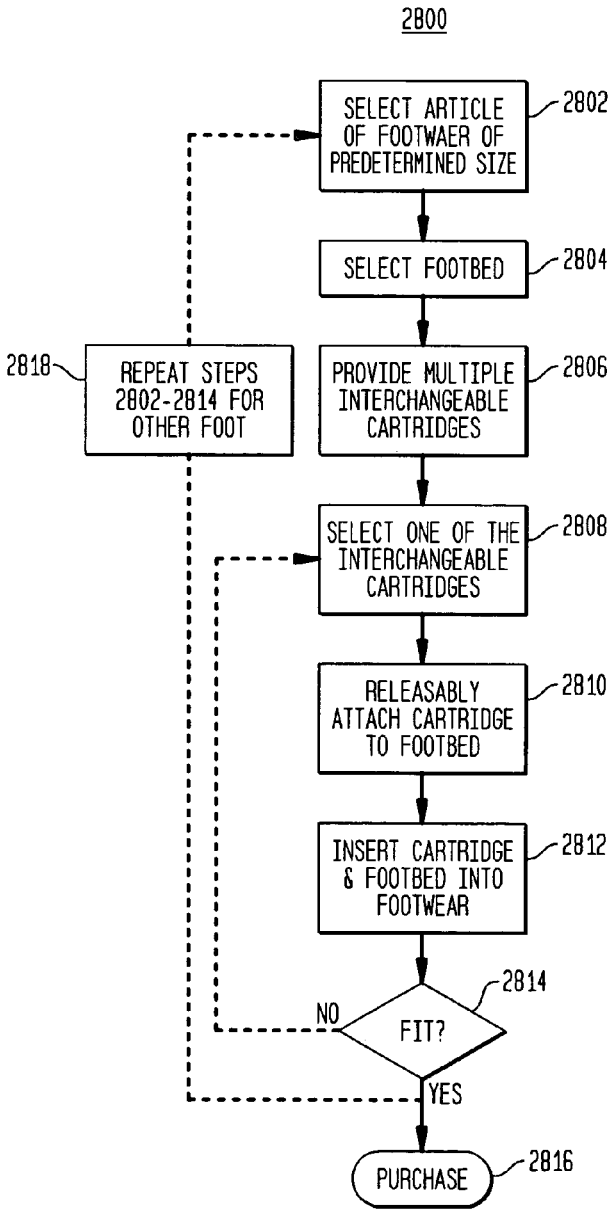
FIG. 28 is a flow diagram illustrating a method of fitting footwear in accordance with aspects of the present invention.

Flow diagram 2800 of FIG. 28 illustrates how an article of footwear may be fitted when employing a cartridge system of the present invention. For example, a wearer may select an article of footwear as shown in step 2802. The article of footwear has a size that generally corresponds to the wearer's foot. By way of example only, a person who normally wears a men's size 10.5 shoe may select an article of footwear of size 11. Then, in step 2804, a footbed is provided. The size of the footbed should correspond to the size of the article of footwear. The footbed may come with the article of footwear or may be sold separately. Here, multiple footbeds of the same size may be provided, and may vary based upon materials, cost, hardness, anti-microbial coatings or coverings, drainage, support, etc. In this case, the user may select one of the footbeds based on his or her own personal preference. Next, in step 2806, a set of interchangeable cartridges are provided. In step 2808 the wearer selects one of the cartridges and in step 2810 the cartridge is attached to the footbed. In turn, the footbed is inserted into the article of footwear in step 2812 and the wearer tries it on. A decision is made at step 2814 as to whether the fit is comfortable. If so, the wearer may end the process with a purchase as in step 2816 or repeat the process for the other foot as in step 2818. If the fit is not acceptable, the process may return to step 2808 where another one of the cartridges is selected.

Figure 29:
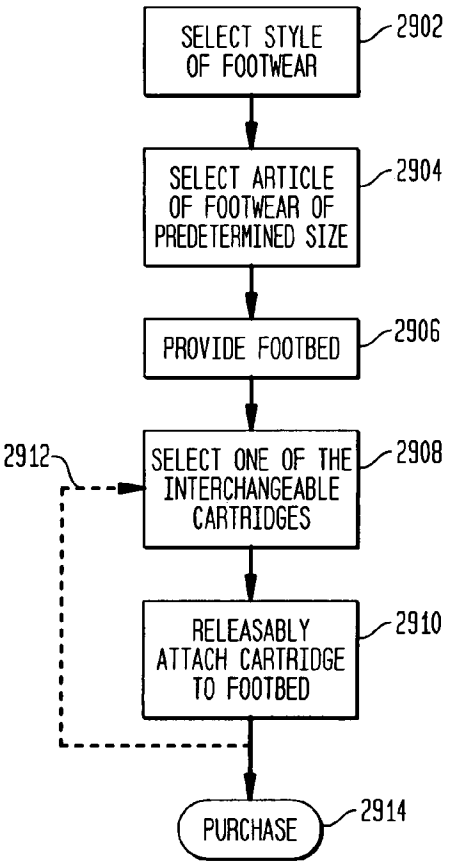
FIG. 29 is a flow diagram illustrating a method of selecting footwear in accordance with aspects of the present invention.

Flow diagram 2900 of FIG. 29 illustrates how an article of footwear may be selected when employing a cartridge system of the present invention. Here, a purchaser selects a style of footwear in step 2902. This step may include selecting a brand, model, color combination, etc. Then, a specific article of footwear of a given size is selected in step 2904. Then, in step 2906, a footbed is provided. The size of the footbed should correspond to the size of the article of footwear. The footbed may come with the article of footwear or may be sold separately. Here, multiple footbeds of the same size may be provided, and may vary based upon materials, cost, hardness, anti-microbial coatings or coverings, drainage, support, etc. In this case, the user may select one of the footbeds based on his or her own personal preference. Then in step 2908 a cartridge is selected and attached to the footbed in step 2910. As in the flow diagram 2800, the wearer may try on the footbed and cartridge combination in the article of footwear to ensure a desired fit. If the fit is not proper, the process returns to step 2908 as shown by dotted line 2912, SO that a different sized cartridge may be selected. Once the fit is proper, the wearer may proceed to purchase the article of footwear, footbed and cartridge in step 2914.

Figure 30:
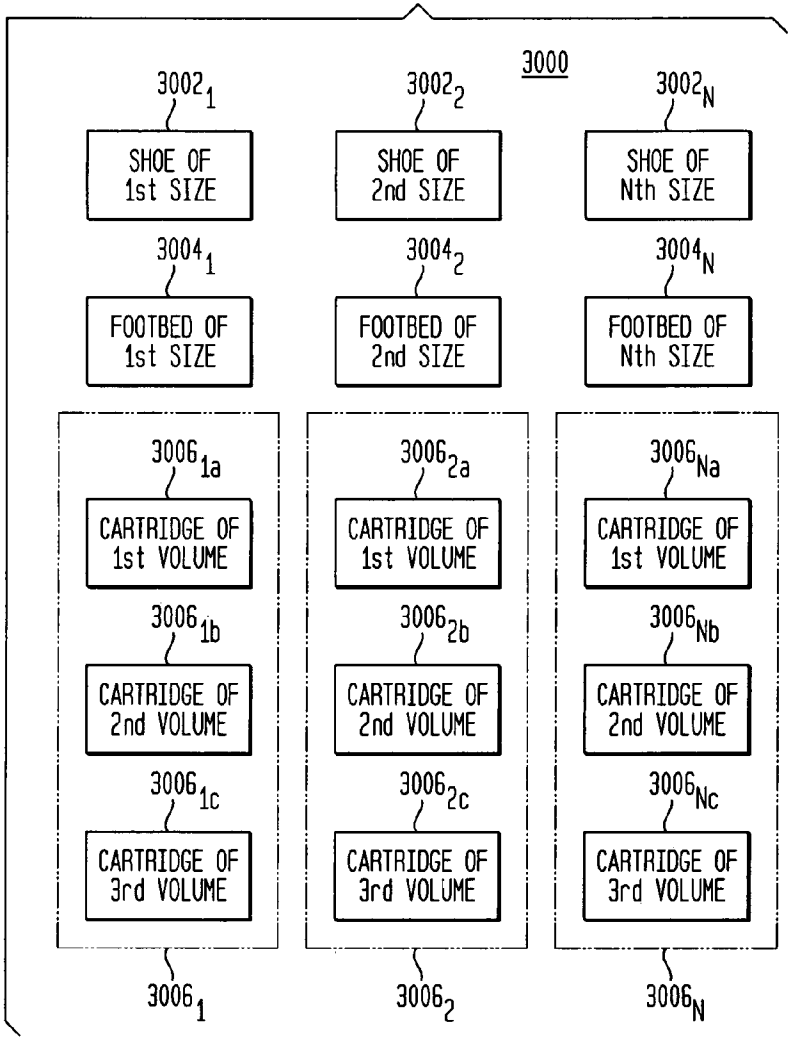
FIG. 30 illustrates a footwear system in accordance with aspects of the present invention.

FIG. 30 illustrates a system 3000 offering kits of footwear in combination with footbeds and cartridges. Here, it can be seen that multiple shoes $\mathbf{3002}_1$, $\mathbf{3002}_2$, . . . , $\mathbf{3002}_N$ are offered in different sizes. While three sizes are shown, any number of sizes may be offered. Footbeds $\mathbf{3004}_1$, $\mathbf{3004}_2$, . . . , $\mathbf{3004}_N$ are provided that correspond to the shoes $\mathbf{3002}_1$, $\mathbf{3002}_2$, . . . , $\mathbf{3002}_N$. While a single footbed is shown for each size of shoe, it should be understood that multiple footbeds may be provided per shoe. In this case, different footbeds may each have a different hardness, or may have other traits such as an anti-microbial lining, drainage holes or pathways, etc. Alternatively, multiple identical footbeds may also be included so that a wearer may replace a worn footbed with a new footbed. Sets of interchangeable cartridges $\mathbf{3006}_1$, $\mathbf{3006}_2$, . . . , $\mathbf{3006}_N$ are also provide for each shoe, and which fit with a corresponding footbed. For instance, any of the cartridges $\mathbf{3006}_1$ fit the footbed $\mathbf{3004}_1$ and are configured for shoe $\mathbf{3002}_1$. Each footbed within a given set may have a different sizing/volume. Here, three cartridges $\mathbf{3006}_{1a}$, $\mathbf{3006}_{1b}$, and $\mathbf{3006}_{1c}$ are provided in set $\mathbf{3006}_1$, three cartridges $\mathbf{3006}_{2a}$, $\mathbf{3006}_{2b}$, and $\mathbf{3006}_{2C}$ are provided in set $\mathbf{3006}_2$, and three cartridges $\mathbf{3006}_{Na}$, $\mathbf{3006}_{Nb}$, and $\mathbf{3006}_{Nc}$ are provided in set $\mathbf{3006}_N$. However, any number of cartridges may be provided in a set. Furthermore, each set may have multiple cartridges of the same sizing/volume. In this case, one of the cartridges may have a first hardness and another one of the same size cartridges may have a different hardness. Or multiple identical cartridges may be included in a set so that a wearer may purchase two or more and refresh the system if one of the cartridges becomes overly worn.

In addition to manufacturing, shipping and stocking costs, the administrative and accounting savings cannot be underestimated. The reduction in SKUs in each product line reduces the time and effort required to track the inventory, track the purchasing and consumption of materials. The whole supply chain benefits.

Because the cartridges of the present invention allow the same shoes to fit more of the population, the cartridges extend the market of potential customers. It is not possible to simply create a line of shoes with a reduced size offering (e.g., only whole sizes) and expect to provide an accurate fit to the majority of a population. This will detract from the overall fit and comfort of the shoe. Since the largest anatomical variation within a population occurs in forefoot volume and girth, a cartridge system with forefoot adjustments provides improved fit for the largest population segment. Thus, stores can sell more shoes to more of the population. In turn, the increased pool of customers can generate intangible benefits in addition to the financial benefits discussed above. For example, as anyone whose feet fall into an outlier size can attest, it is very difficult to find shoes that fit. In the clothing industry, a similar sizing problem is addressed by the "big and tall" clothing stores. However, few comparable shoe stores exist. Therefore, once a customer locates a comfortable pair of shoes in the right size, he or she may buy multiple pairs of the same shoe just to have the right size for future wear. Not only does this activity increase sales, but the knowledge that a particular vendor makes shoes that fit the "hard to fit" customer generates goodwill for that vendor.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims. As discussed above, features in any one of the embodiments described herein may be incorporated into any of the other embodiments.

The invention claimed is:

1. A cartridge system for adjusting sizing in an article of footwear, comprising:

a footbed having a forefoot region, the footbed being removably insertable into the article of footwear; and a cartridge having a predetermined sizing and including a connection member for releasably attaching the cartridge to the forefoot region of the footbed;

wherein the cartridge adjusts the volume available to a wearer's foot within a forefoot region of the article of footwear, and wherein the footbed includes a top surface for supporting the wearer's foot and a bottom surface remote from the top surface, and the cartridge is connectable to the bottom surface of the footbed.

2. The cartridge system of claim 1, wherein the connection member is insertable into a receptacle on the footbed.

3. The cartridge system of claim 2, wherein the connection member has a length of at least 5 mm.

4. The cartridge system of claim 1, wherein the footbed includes a stiffening member therein.

5. The cartridge system of claim 4, wherein the stiffening member is disposed in a heel region of the footbed.

6. The cartridge system of claim 1, wherein the cartridge further includes a fastening member for releasably securing the cartridge to the forefoot region of the footbed.

7. The cartridge system of claim 6, wherein the connection member is disposed along a posterior region of the cartridge and the fastening member is disposed along an anterior region of the cartridge.

8. The cartridge system of claim 1, wherein the cartridge includes a flex area on at least one of medial and lateral sides of the cartridge.

9. The cartridge system of claim 1, wherein the footbed comprises a pair of footbeds and the cartridge comprises a pair of cartridges, a first one of the footbeds and a first one of the cartridges being adapted for use with the wearer's left foot, and a second one of the footbeds and a second one of the cartridges being adapted for use with the wearer's right foot.

10. The cartridge system of claim 9, wherein the predetermined sizing of the first cartridge is different than the predetermined sizing of the second cartridge.

11. The cartridge system of claim 1, wherein the cartridge includes a sizing identifier for indicating the predetermined sizing.

12. The cartridge system of claim 11, wherein the cartridge includes a first surface adjacent to the footbed and a second surface remote from the first surface, and the sizing identifier is disposed on the second surface.

13. The cartridge system of claim 1, wherein the cartridge comprises a plurality of cartridges each having a different predetermined sizing.

14. A cartridge system for adjusting sizing in an article of footwear, comprising:

a footbed having a forefoot region, the footbed being removably insertable into the article of footwear; and a cartridge having a predetermined sizing and including a connection member for releasably attaching the cartridge to the forefoot region of the footbed, the cartridge further including a fastening member for releasably securing the cartridge to the forefoot region of the footbed, the connection member being disposed along a posterior region of the cartridge and the fastening member being disposed along an anterior region of the cartridge;

wherein the cartridge adjusts the volume available to a wearer's foot within a forefoot region of the article of footwear and wherein the fastening member is a post operable to connect to a receptacle in a toe region of the footbed.

15. A cartridge system for adjusting sizing in an article of footwear, comprising:

a footbed having a forefoot region, the footbed being removably insertable into the article of footwear;

a cartridge having a predetermined sizing and including a connection member for releasably attaching the cartridge to the forefoot region of the footbed, the cartridge adjusts the volume available to a wearer's foot within a forefoot region of the article of footwear, the cartridge includes a sizing identifier for indicating the predetermined sizing, and the cartridge includes a first surface adjacent to the footbed and a second surface remote from the first surface, and the sizing identifier is disposed on the second surface; and further comprising a slipcover adapted to receive the footbed and the cartridge therein, the slipcover including an exposed opening configured so that the sizing identifier is readily observable through the exposed opening.

16. A cartridge system for adjusting forefoot sizing in an article of footwear, comprising:

a footbed having a forefoot region and a heel region, the heel region including a receptacle therein; and a cartridge having a first section of predetermined sizing in communication with the forefoot region of the footbed and a second section including at least one tab for releasably connecting the cartridge to the receptacle in the heel region of the footbed;

wherein the first section of the cartridge includes a first surface adjacent to the footbed and a second surface remote from the first surface, and the cartridge further includes a sizing identifier for indicating the predetermined sizing, the sizing identifier being disposed on the second surface of the first section, and wherein the first surface of the first section includes a fastening member for releasably securing the cartridge to the forefoot region of the footbed.

17. The cartridge system of claim 16, wherein the tab includes a first end connected to the first section and a second end remote from the first end.

18. The cartridge system of claim 17, wherein the receptacle of the footbed includes an exterior opening and the second section includes a lip member that is received in the exterior opening.

19. The cartridge system of claim 16, wherein the tab is at least 30 mm in length.

20. The cartridge system of claim 19, wherein the first section has a thickness on the order of 2.5 mm.

21. The cartridge system of claim 16, wherein the first section has a thickness of at least 2 mm.

22. The cartridge system of claim 16, wherein the footbed includes sizing identification thereon.

23. The cartridge system of claim 16, wherein the cartridge provides forefoot sizing adjustment in the article of footwear but does not provide sizing adjustment in a heel region of the article of footwear.

24. A cartridge system for adjusting sizing in an article of footwear, comprising:

a footbed having a forefoot region, a heel region, a top surface for supporting a wearer's foot and a bottom surface remote from the top surface; and a plurality of cartridges each having a first section of predetermined sizing adapted to mate with the forefoot region of the footbed and connection means for releasable connection to the footbed;

wherein the volume available to a wearer's foot within a forefoot region of the article of footwear is adjusted by selecting one of the plurality of cartridges based on the predetermined sizing, and wherein each of the plurality of cartridges is connectable to the bottom surface of the footbed.

25. The cartridge system of claim 24, wherein the connection means attaches each cartridge to the heel region of the footbed.

26. The cartridge system of claim 25, wherein each of the cartridges further includes fastening means for releasably securing the first section to the forefoot region of the footbed.

27. An article of footwear, comprising:

an outsole for contacting the ground;

an upper attached to the outsole, the upper and outsole defining an enclosure for receiving a wearer's foot;

a footbed including a top surface for supporting a wearer's foot, a bottom surface remote from the top surface and having an anterior region and a posterior region, the posterior region including a receptacle therein, and the footbed being removably insertable into the enclosure; and at least one cartridge having a first section of predetermined sizing for mating to the anterior region of the footbed and a second section including at least one tab for releasably connecting the cartridge to the receptacle in the posterior region of the footbed;

wherein the at least one cartridge is connectable to the bottom surface of the footbed.

28. A cartridge comprising an anterior forefoot section of a predetermined thickness and a posterior connection section adjacent to the forefoot section, the connection section including a tab that is adapted for removable insertion into a footbed, and the forefoot section of the cartridge being adapted for positioning in a mating relationship with a bottom surface of the footbed, the forefoot section of the cartridge including a post for releasably securing the cartridge in the mating relationship with the footbed, wherein the post is operable to connect to a receptacle in a toe region of the footbed.

29. The cartridge of claim 28, wherein the tab includes a lip member at a first end thereof remote from the forefoot section of the cartridge, the lip member being adapted for releasable connection to a receptacle opening in the footbed.

30. A footbed comprising a forefoot section, a heel section attached to the forefoot section, a top surface for supporting the wearer's foot and a bottom surface remote from the top surface, the bottom surface along the forefoot section including a mating region adapted to receive a cartridge so that the cartridge is connectable to the bottom surface of the forefoot section, the cartridge being interchangeable with other cartridges of different thickness, and the footbed having a connection region adapted to receive a connector of the cartridge, the connection region being adapted to removably secure the connector.

31. The footbed of claim 30, wherein the mating region includes first fastening means for detachable connection to second fastening means of the cartridge, and the connection region includes an interior channel and an exterior window adjacent thereto, the interior channel being adapted to receive a tab section of the cartridge connector and the exterior window being adapted to receive a lip member of the cartridge connector.

* * * * *

UNITED STATES PATENT AND TRADEMARK OFFICE

CERTIFICATE OF CORRECTION

PATENT NO. : 7,681,333 B2
APPLICATION NO. : 11/259563
DATED : March 23, 2010
INVENTOR(S) : Douglas E. Clark et al.

It is certified that error appears in the above-identified patent and that said Letters Patent is hereby corrected as shown below:

On the face of the patent, and in Column 1, lines 1 and 2, the title should read --SHOE FOOTBED WITH INTERCHANGEABLE CARTRIDGES--.

Col. 28, Line 66, “SO” should read --so--.

Col. 32, Claim 30, Line 64, “thickness” should read --thicknesses--.

Signed and Sealed this
Fourteenth Day of June, 2011

David J. Kappos

David J. Kappos
*Director of the United States Patent and Trademark Office*